United States Patent [19]

Kubo et al.

[11] Patent Number: 4,777,097

[45] **Date of Patent: * Oct. 11, 1988**

[54] COMPOSITE MATERIAL INCLUDING ALUMINA-SILICA SHORT FIBER REINFORCING MATERIAL AND ALUMINUM ALLOY MATRIX METAL WITH MODERATE COPPER AND MAGNESIUM CONTENTS

[75] Inventors: Masahiro Kubo; Tadashi Dohnomoto; Atsuo Tanaka, all of Toyoto; Hidetoshi Hirai, Kariya, all of Japan

[73] Assignee: Toyota Jidosha Kabushiki Kaisha, Toyota, Japan

[ * ] Notice: The portion of the term of this patent subsequent to May 20, 2003 has been disclaimed.

[21] Appl. No.: 7,790

[22] Filed: Jan. 28, 1987

[30] Foreign Application Priority Data

Jan. 31, 1986 [JP] Japan ..... 61-19793
Mar. 4, 1986 [JP] Japan ..... 61-46498

[51] Int. Cl.[4] ..... B32B 5/02; B32B 15/14
[52] U.S. Cl. ..... 428/614; 420/533
[58] Field of Search ..... 428/614; 420/533

[56] References Cited

U.S. PATENT DOCUMENTS 4,444,603 4/1984 Yamatsuta et al. ..... 428/614
4,590,132 5/1986 Dohnomoto et al. ..... 428/614
4,601,956 7/1986 Dohnomoto et al. ..... 428/614

*Primary Examiner*—L. Dewayne Rutledge
*Assistant Examiner*—David W. Schumaker
*Attorney, Agent, or Firm*—Oblon, Fisher, Spivak, McClelland & Maier

[57] ABSTRACT

A composite material is made from alumina-silica type short fibers embedded in a matrix of metal. The matrix metal is an alloy consisting essentially of from approximately 2% to approximately 6% of copper, from approximately 0.5% to approximately 3.5% of magnesium, and remainder substantially aluminum. The short fibers have a composition of from about 35% to about 80% of $Al_2O_3$ and from about 65% to about 20% of $SiO_2$ with less than about 10% of other included constituents, and may be either amorphous or crystalline, in the latter case optionally containing a proportion of the mullite crystalline form. The fiber volume proportion of the alumina-silica type short fibers is between approximately 5% and approximately 50%, and may more desirably be between approximately 5% and approximately 40%. If the alumina-silica short fibers are formed from amorphous alumina-silica material, the magnesium content of the aluminum alloy matrix metal may desirably be between approximately 0.5% and approximately 3%. And, in the desirable case that the fiber volume proportion of the alumina-silica type short fibers is between approximately 30% and approximately 40%, then the copper content of the aluminum alloy matrix metal is desired to be between approximately 2% and approximately 5.5%.

18 Claims, 31 Drawing Sheets

CRYSTALLINE ALUMINA-SILICA SHORT FIBERS
AT VOLUME PROPORTION 20% ( $Al_2O_3$ CONTENT 65% )

CRYSTALLINE ALUMINA-SILICA SHORT FIBERS AT VOLUME PROPORTION 10% ( $Al_2O_3$ CONTENT 65% )

CRYSTALLINE ALUMINA-SILICA SHORT FIBERS AT VOLUME PROPORTION 5% ( $Al_2O_3$ CONTENT 65% )

CRYSTALLINE ALUMINA-SILICA SHORT FIBERS AT VOLUME PROPORTION 40% ( $Al_2O_3$ CONTENT 65% )

CRYSTALLINE ALUMINA-SILICA SHORT FIBERS AT VOLUME PROPORTION 30% ( $Al_2O_3$ CONTENT 65% )

CRYSTALLINE ALUMINA-SILICA SHORT FIBERS AT VOLUME PROPORTION 10% ( $Al_2O_3$ CONTENT 49% )

CRYSTALLINE ALUMINA-SILICA SHORT FIBERS AT VOLUME PROPORTION 30% ( $Al_2O_3$ CONTENT 35% )

CRYSTALLINE ALUMINA-SILICA SHORT FIBERS AT VOLUME PROPORTION 10% ( $Al_2O_3$ CONTENT 35% )

AMORPHOUS ALUMINA-SILICA SHORT FIBERS AT VOLUME PROPORTION 10% ( $Al_2O_3$ CONTENT 49% )

AMORPHOUS ALUMINA-SILICA SHORT FIBERS
AT VOLUME PROPORTION 5% ( $Al_2O_3$ CONTENT 49% )

AMORPHOUS ALUMINA-SILICA SHORT FIBERS AT VOLUME PROPORTION 40% ( $Al_2O_3$ CONTENT 49% )

AMORPHOUS ALUMINA-SILICA SHORT FIBERS AT VOLUME PROPORTION 30% ( $Al_2O_3$ CONTENT 49% )

CRYSTALLINE ALUMINA-SILICA SHORT FIBERS AT VOLUME PROPORTION 20% ( $Al_2O_3$ CONTENT 72% )

CRYSTALLINE ALUMINA-SILICA SHORT FIBERS AT VOLUME PROPORTION 10% ( $Al_2O_3$ CONTENT 72% )

CRYSTALLINE ALUMINA-SILICA SHORT FIBERS AT VOLUME PROPORTION 5% ( $Al_2O_3$ CONTENT 72% )

CRYSTALLINE ALUMINA-SILICA SHORT FIBERS AT VOLUME PROPORTION 40% ( $Al_2O_3$ CONTENT 72% )

CRYSTALLINE ALUMINA-SILICA SHORT FIBERS AT VOLUME PROPORTION 30% ( $Al_2O_3$ CONTENT 72% )

AMORPHOUS ALUMINA-SILICA SHORT FIBERS AT VOLUME PROPORTION 10% ( $Al_2O_3$ CONTENT 72% )

AMORPHOUS ALUMINA-SILICA SHORT FIBERS AT VOLUME PROPORTION 30% ( $Al_2O_3$ CONTENT 72% )

CRYSTALLINE ALUMINA-SILICA SHORT FIBERS AT VOLUME PROPORTION 10% ( $Al_2O_3$ CONTENT 77% )

AMORPHOUS ALUMINA-SILICA SHORT FIBERS AT VOLUME PROPORTION 30% ( $Al_2O_3$ CONTENT 77% )

COMPOSITE MATERIAL INCLUDING ALUMINA-SILICA SHORT FIBER REINFORCING MATERIAL AND ALUMINUM ALLOY MATRIX METAL WITH MODERATE COPPER AND MAGNESIUM CONTENTS

BACKGROUND OF THE INVENTION

The present invention relates to a composite material made up from reinforcing fibers embedded in a matrix of metal, and more particularly relates to such a composite material utilizing alumina-silica type short fiber material as the reinforcing fiber material, and aluminum alloy as the matrix metal, i.e. to an alumina-silica short fiber reinforced aluminum alloy.

Further, the present inventors wish hereby to attract the attention of the examining authorities to copending patent application Ser. Nos. 868,541; 868,542; 868,750; 895,811; 901,196; 911,880; and 001,924 which may be considered to be material to the examination of the present patent application.

As fiber reinforced aluminum alloys related to the present invention, there have been disclosed in the following U.S. patent applications filed by an Applicant the same as the Applicant of the parent Japanese patent applications of which Convention priority is being claimed for the present patent application—Ser. Nos. (1) 868,542; (2) 868,750; and (3) 868,541—respectively: (1) a composite material including silicon carbide short fibers in a matrix of aluminum alloy having a copper content of from approximately 2% to approximately 6%, a magnesium content of from approximately 2% to approximately 4%, and remainder substantially aluminum, with the volume proportion of said silicon carbide short fibers being from approximately 5% to approximately 50%; (2) a composite material including alumina short fibers in a matrix of aluminum alloy having a copper content of from approximately 2% to approximately 6%, a magnesium content of from approximately 0.5% to approximately 4%, and remainder substantially aluminum, with the volume proportion of alumina short fibers being from approximately 5% to approximately 50%, and (3) a composite material including silicon carbide short fibers in a matrix of aluminum alloy having a copper content of from approximately 2% to 6%, a magnesium content of from approximately 0% to approximately 2%, and remainder substantially aluminum, with the volume proportion of said silicon carbide short fibers being from approximately 5% to approximately 50%. However, it is not hereby intended to admit any of the above identified documents as prior art to the present patent application except to the extent in any case mandated by applicable law.

In the prior art, the following aluminum alloys of the cast type and of the wrought type have been utilized as matrix metal for a composite material:

Cast type aluminum alloys

JIS standard AC8A (from about 0.8% to about 1.3% Cu, from about 11.0% to about 13.0% Si, from about 0.7% to about 1.3% Mg, from about 0.8% to about 1.5% Ni, remainder substantially Al)

JIS standard AC8B (from about 2.0% to about 4.0% Cu, from about 8.5% to about 10.5% Si, from about 0.5% to about 1.5% Mg, from about 0.1% to about 1% Ni, remainder substantially Al)

JIS standard AC4C (Not more than about 0.25% Cu, from about 6.5% to about 7.5% Si, from about 0.25% to about 0.45% Mg, remainder substantially Al)

AA standard A201 (from about 4% to about 5% Cu, from about 0.2% to about 0.4% Mn, from about 0.15% to about 0.35% Mg, from about 0.15% to about 0.35% Ti, remainder substantially Al)

AA standard A356 (from about 6.5% to about 7.5% Si, from about 0.25% to about 0.45% Mg, not more than about 0.2% Fe, not more than about 0.2% Cu, remainder substantially Al)

Al—from about 2% to about 3% Li alloy (DuPont).

Wrought type aluminum alloys

JIS standard 6061 (from about 0.4% to about 0.8% Si, from about 0.15% to about 0.4% Cu, from about 0.8% to about 1.2% Mg, from about 0.04% to about 0.35% Cr, remainder substantially Al)

JIS standard 5056 (not more than about 0.3% Si, not more than about 0.4% Fe, not more than about 0.1% Cu, from about 0.05% to about 0.2% Mn, from about 4.5% to about 5.6% Mg, from about 0.05% to about 0.2% Cr, not more than about 0.1% Zn, remainder substantially Al)

JIS standard 7075 (not more than about 0.4% Si, not more than about 0.5% Fe, from about 1.2% to about 2.0% Cu, not more than about 0.3% Mn, from about 2.1% to about 2.9% Mg, from about 0.18% to about 0.28% Cr, from about 5.1% to about 6.1% Zn, about 0.2% Ti, remainder substantially Al).

Previous research relating to composite materials incorporating aluminum alloys as their matrix metals has generally been carried out from the point of view and with the object of improving the strength and so forth of existing aluminum alloys without changing their composition, and therefore these aluminum alloys conventionally used in the manufacture of such prior art composite materials have not necessarily been of the optimum composition in relation to the type of reinforcing fibers utilized therewith to form a composite material, and therefore, in the case of using one or the other of such conventional above mentioned aluminum alloys as the matrix metal for a composite material, the optimization of the mechanical characteristics, and particularly of the strength, of the composite material using such an aluminum alloy as matrix metal has not heretofore been satisfactorily attained.

SUMMARY OF THE INVENTION

The inventors of the present application have considered the above mentioned problems in composite materials which use such conventional aluminum alloys as matrix metal, and in particular have considered the particular case of a composite material which utilizes alumina-silica type short fibers as reinforcing fibers, since such alumina-silica type short fibers, among the various reinforcing fibers used conventionally in the manufacture of a fiber reinforced metal composite material, are relatively inexpensive, have particularly high strength, and are exceedingly effective in improving the high temperature stability and the strength of the composite material. And the present inventors, as a result of various experimental researches to determine what composition of the aluminum alloy to be used as the matrix metal for such a composite material is optimum, have discovered that an aluminum alloy having a content of copper and a content of magnesium within certain limits, and containing substantially no silicon, nickel, zinc, and so forth is optional as matrix metal, particularly in view of the bending strength characteristics of the resulting composite material. The present invention is based on the knowledge obtained from the results of the various experimental researches carried out by the inventors of the present application, as will be detailed later in this specification.

Accordingly, it is the primary object of the present invention to provide a composite material utilizing alumina-silica type short fibers as reinforcing material and aluminum alloy as matrix metal, which enjoys superior mechanical characteristics such as bending strength.

It is a further object of the present invention to provide such a composite material utilizing alumina-silica type short fibers as reinforcing material and aluminum alloy as matrix metal, which is cheap.

It is a further object of the present invention to provide such a composite material utilizing alumina-silica type short fibers as reinforcing material and aluminum alloy as matrix metal, which, for similar values of mechanical characteristics such as bending strength, can incorporate a lower volume proportion of reinforcing fiber material than prior art such composite materials.

It is a further object of the present invention to provide such a composite material utilizing alumina-silica type short fibers as reinforcing material and aluminum alloy as matrix metal, which is improved over prior art such composite materials as regards machinability.

It is a further object of the present invention to provide such a composite material utilizing alumina-silica type short fibers as reinforcing material and aluminum alloy as matrix metal, which is improved over prior art such composite materials as regards workability.

It is a further object of the present invention to provide such a composite material utilizing alumina-silica type short fibers as reinforcing material and aluminum alloy as matrix metal, which has good characteristics with regard to amount of wear on a mating member.

It is a yet further object of the present invention to provide such a composite material utilizing alumina-silica type short fibers as reinforcing material and aluminum alloy as matrix metal, which is not brittle.

It is a yet further object of the present invention to provide such a composite material utilizing alumina-silica type short fibers as reinforcing material and aluminum alloy as matrix metal, which is durable.

It is a yet further object of the present invention to provide such a composite material utilizing alumina-silica type short fibers as reinforcing material and aluminum alloy as matrix metal, which has good wear resistance.

It is a yet further object of the present invention to provide such a composite material utilizing alumina-silica type short fibers as reinforcing material and aluminum alloy as matrix metal, which has good uniformity.

According to the most general aspect of the present invention, these and other objects are attained by a composite material comprising a mass of alumina-silica short fibers embedded in a matrix of metal, said alumina-silica short fibers having a composition of from about 35% to about 80% of $Al_2O_3$ and from about 65% to about 20% of $SiO_2$ with less than about 10% of other included constituents; said matrix metal being an alloy consisting essentially of from approximately 2% to approximately 6% of copper, from approximately 0.5% to approximately 3.5% of magnesium, and remainder substantially aluminum; and the volume proportion of said alumina-silica short fibers being from about 5% to about 50%. Optionally, said alumina-silica short fibers may have a composition of from about 35% to about 65% of $Al_2O_3$ and from about 65% to about 35% of $SiO_2$ with less than about 10% of other included constituents; or, alternatively, said alumina-silica short fibers may have a composition of from about 65% to about 80% of $Al_2O_3$ and from about 35% to about 20% of $SiO_2$ with less than about 10% of other included constituents.

According to the present invention as described above, as reinforcing fibers there are used alumina-silica type short fibers, optionally having a relatively high content of $Al_2O_3$, which have high strength, and are exceedingly effective in improving the high temperature stability and strength of the resulting composite material, and as matrix metal there is used an aluminum alloy with a copper content of from approximately 2% to approximately 6%, a magnesium content of from approximately 0.5% to approximately 2%, and the remainder substantially aluminum, and the volume proportion of the alumina-silica short fibers is desirably from approximately 5% to approximately 50%, whereby, as is clear from the results of experimental research carried out by the inventors of the present application as will be described below, a composite material with superior mechanical characteristics such as strength can be obtained.

Preferably, the fiber volume proportion of said short fibers may be between approximately 5% and approximately 40%. Even more preferably, the fiber volume proportion of said short fibers may be between approximately 30% and approximately 40%, with the copper content of said aluminum alloy matrix metal being between approximately 2% and approximately 5.5%. The short fibers may be composed of amorphous alumina-silica material; or, alternatively, said short fibers may be crystalline, and optionally may have a substantial mullite crystalline content.

Also according to the present invention, in cases where it is satisfactory if the same degree of strength as a conventional alumina-silica type short fiber reinforced aluminum alloy is obtained, the volume proportion of alumina-silica type short fibers in a composite material according to the present invention may be set to be lower than the value required for such a conventional composite material, and therefore, since it is possible to reduce the amount of alumina-silica short fibers used, the machinability and workability of the composite material can be improved, and it is also possible to reduce the cost of the composite material. Further, the characteristics with regard to wear on a mating member will be improved.

As will become clear from the experimental results detailed hereinafter, when copper is added to aluminum to make the matrix metal of the composite material according to the present invention, the stength of the aluminum alloy matrix metal is increased and thereby the strength of the composite material is improved, but that effect is not sufficient if the copper content is less than 2%, whereas if the copper content is more than 6% the composite material becomes very brittle, and has a tendency rapidly to disintegrate. Therefore the copper content of the aluminum alloy used as matrix metal in the composite material of the present invention is required to be in the range of from approximately 2% to approximately 6%, and more preferably is desired to be in the range of from approximately 2% to approximately 5.5%.

Furthermore, oxides are inevitably always present on the surface of such alumina-silica short fibers used as reinforcing fibers, and if as is contemplated in the above magnesium, which has a strong tendency to form as oxide, is contained within the molten matrix metal, such magnesium will react with the oxides on the surfaces of the alumina-silica short fibers, and reduce the surfaces of the alumina-silica short fibers, as a result of which the affinity of the molten matrix metal and the alumina-silica short fibers will be improved, and by this means the strength of the composite material will be improved with an increase in the content of magnesium, as experimentally has been established as will be described in the following up to a magnesium content of approximately 2% to 3%. If however the magnesium content exceeds approximately 3.5%, as will also be described in the following, the strength of the composite material decreases rapidly. Therefore the magnesium content of the aluminum alloy used as matrix metal in the composite material of the present invention is desired to be from approximately 0.5% to approximately 3.5%, and preferably from approximately 0.5% to approximately 3%, and even more preferably from approximately 1.5% to approximately 3%.

Furthermore, in a composite material with an aluminum alloy of the above composition as matrix metal, as also will become clear from the experimental researches given hereinafter, if the volume proportion of the alumina-silica type short fibers is less than 5%, a sufficient strength cannot be obtained, and if the volume proportion of the alumina-silica type short fibers exceeds 40% and particularly if it exceeds 50% even if the volume proportion of the alumina-silica type short fibers is increased, the stength of the composite material is not very significantly improved. Also, the wear resistance of the composite material increases with the volume proportion of the alumina-silica type short fibers, but when the volume proportion of the alumina-silica type short fibers is in the range from zero to approximately 5% said wear resistance increases rapidly with an increase in the volume proportion of the alumina-silica type short fibers, whereas when the volume proportion of the alumina-silica type short fibers is in the range of at least approximately 5%, the wear resistance of the composite material does not very significantly increase with an increase in the volume proportion of said alumina-silica type short fibers. Therefore, according to one characteristic of the present invention, the volume proportion of the alumina-silica type short fibers is required to be in the range of from approximately 5% to approximately 50%, and preferably is required to be in the range of from approximately 5% to approximately 40%.

The alumina-silica short fibers in the composite material of the present invention may be made either of amorphous alumina-silica short fibers or of crystalline alumina-silica short fibers (alumina-silica short fibers including mullite crystals ($3Al_2O_3.2SiO_2$)), and in the case that crystalline alumina silica short fibers are used as the alumina-silica short fibers, if the aluminum alloy has the above described composition, then, irrespective of the amount of the mullite crystals in the crystalline alumina-silica fibers, compared to the case that aluminum alloys of other compositions are used as matrix metal, the stength of the composite material can be improved.

As a result of other experimental research carried out by the inventors of the present application, regardless of whether the alumina-silica short fibers are formed of amorphous alumina-silica material or are formed of crystalline alumina-silica material, when the volume proportion of the alumina-silica short fibers is in the relatively high portion of the above described desirable range, that is to say is from approximately 30% to approximately 40%, it is preferable that the copper content of the aluminum alloy should be from approximately 2% to approximately 5.5%. Therefore, according to another detailed characteristic of the present invention, when the volume proportion of the alumina-silica short fibers is from approximately 30% to approximately 40%, the copper content of the aluminum alloy should be from approximately 2% to approximately 5.5%.

Also when amorphous alumina-silica short fibers are used as the alumina-silica short fibers, it is preferable for the magnesium content to be from approximately 0.5% to approximately 3%. Therefore, according to yet another detailed characteristic of the present invention, when for the alumina-silica short fibers there are used amorphous alumina-silica short fibers, the magnesium content of the aluminum alloy should be from approximately 0.5% to approximately 3%, and, when the volume proportion of said amorphous alumina-silica short fibers is from approximately 30% to 40%, the copper content of the aluminum alloy should be from approximately 2% to approximately 5.5% and the magnesium content should be from approximately 0.5% to approximately 3%.

If, furthermore, the copper content of the aluminum alloy used as matrix metal of the composite material of the present invention has a relatively high value, if there are unevennesses in the concentration of the copper or the magnesium within the aluminum alloy, the portions where the copper concentration or the magnesium concentration is high will be brittle, and it will not therefore be possible to obtain a uniform matrix metal or a composite material of good and uniform quality. Therefore, according to another detailed characteristic of the present invention, in order that the concentration of copper within the aluminum alloy matrix metal should be uniform, such a composite material of which the matrix metal is aluminum alloy of which the copper content is at least 0.5% and is less than 3.5% is subjected to liquidizing processing for from about 2 hours to about 8 hours at a temperature of from about 480° C. to about 520° C., and is preferably further subjected to aging processing for about 2 hours to about 8 hours at a temperature of from about 150° C. to 200° C.

Further, the alumina-silica short fibers used in the composite material of the present invention may either be alumina-silica non continuous fibers or may be alumina-silica continuous fibers cut to a predetermined length. Also, the fiber length of the alumina-silica type short fibers is preferably from approximately 10 microns to approximately 7 cm, and particularly is from approximately 10 microns to approximately 5 cm, and the fiber diameter is preferably from approximately 1 micron to approximately 30 microns, and particularly is from approximately 1 microns to approximately 25 microns.

Furthermore, when the composition of the matrix metal is determined as specified above, according to the present invention, since a composite material of high strength is obtained irrespective of the orientation of the alumina-silica fibers, the fiber orientation may be any of, for example, one directional fiber orientation, two dimensional random fiber orientation, or three dimensional random fiber orientation, but, in a case where high strength is required in a particular direction, then in cases where the fiber orientation is one directional random fiber orientation or two dimensional random fiber orientation, it is preferable for the particular desired high stength direction to be the direction of such one directional orientation, or a direction parallel to the plane of such two dimensional random fiber orientation.

It should be noted that in this specification all percentages, except in the expression of volume proportion of reinforcing fiber material, are percentages by weight, and in expressions of the composition of an aluminum alloy, "substantially aluminum" means that, apart from aluminum, copper and magnesium, the total of the inevitable metallic elements such as silicon, iron, zinc, manganese, nickel, titanium, and chromium included in the aluminum alloy used as matrix metal is not more than about 1%, and each of said impurity type elements individually is not present to more than about 0.5%. Further, in expressions relating to the composition of the alumina-silica type short fibers, the expression "substantially $SiO_2$" means that, apart from the $Al_2O_3$ and the $SiO_2$ making up the alumina-silica short fibers, other elements are present only to such extents as to constitute impurities. It should further be noted that, in this specification, in descriptions of ranges of compositions, temperatures and the like, the expressions "at least", "not less than", "at most", "no more than", and "from ... to ..." and so on are intended to include the boundary values of the respective ranges.

BRIEF DESCRIPTION OF THE DRAWINGS

The present invention will now be described with respect to the preferred embodiments thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified; like reference numerals, unless otherwise so specified, denote the same parts and gaps and spaces and so on in the various figures; and:

DESCRIPTION OF THE PREFERRED EMBODIMENTS

The present invention will now be described with reference to the various preferred embodiments thereof. It should be noted that all of the tables referred to in this specification are to be found at the end of the specification and before the claims thereof: the present specification is arranged in such a manner in order to maximize ease of pagination. Further, the preferred embodiments of the present invention are conveniently divided into two groupings of sets thereof, as will be seen in what follows.

THE FIRST GROUPING OF PREFERRED EMBODIMENT SETS

The First Set of Preferred Embodiments

In order to assess what might be the most suitable composition for an aluminum alloy to be utilized as matrix metal for a contemplated composite material of the type described in the preamble to this specification, the reinforcing material of which is to be, in this case, crystalline alumina-silica short fibers, the present inventors manufactured by using the high pressure casting method samples of various composite materials, utilizing as reinforcing material crystalline alumina-silica short fiber material, which in this case had composition about 65% $Al_2O_3$ and remainder substantially $SiO_2$, with the mullite crystalline proportion contained therein being about 60%, and which had average fiber length about 1 mm and average fiber diameter about 3 microns, and utilizing as matrix metal Al-Cu-Mg type aluminum alloys of various compositions. Then the present inventors conducted evaluations of the bending strength of the various resulting composite material sample pieces.

Figure 17:
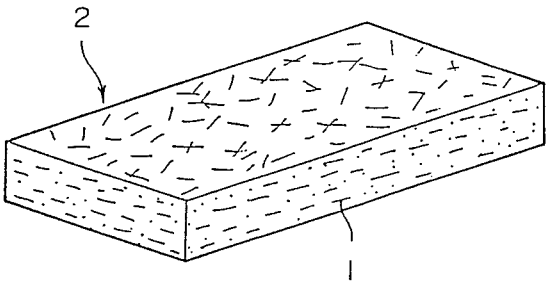
FIG. 17 is a perspective view of a preform made of alumina-silica type short fiber material, with said alumina-silica type short fibers being aligned substantially randomly in two dimensions in the planes parallel to its larger two faces while being stacked in the third dimension perpendicular to said planes and said faces, for incorporation into composite materials according to various preferred embodiments of the present invention.

First, a set of aluminum alloys designated as A1 through A56 were produced, having as base material aluminum and having various quantities of magnesium and copper mixed therewith, as shown in the appended Table 1; this was done by, in each case, combining an appropriate quantity of substantially pure aluminum metal (purity at least 99%), an appropriate quantity of substantially pure magnesium metal (purity at least 99%), and an appropriate quantity of a mother alloy of approximately 50% aluminum and approximately 50% copper. And three sets, each containing an appropriate number (actually, fifty-six), of alumina-silica short fiber material preforms were made by, in each case, subjecting a quantity of the above specified crystalline alumina-silica short fiber material to compression forming without using any binder. Each of these crystalline alumina-silica short fiber material preforms was, as schematically illustrated in perspective view in FIG. 17 wherein an exemplary such preform is designated by the reference numeral 2 and the crystalline alumina-silica short fibers therein are generally designated as 1, about 38×100×16 mm in dimensions, and the individual crystalline alumina-silica short fibers 1 in said preform 2 were oriented as overlapping in a two dimensionally random manner in planes parallel to the 38×100 mm plane while being stacked in the direction perpendicular to this plane. And the fiber volume proportion in a first set of said preforms 2 was approximately 20%, in a second set of said preforms 2 was approximately 10%, and in a third set of said preforms 2 was approximately 5%; thus, in all, there were a hundred and sixty eight such preforms.

Figure 18:
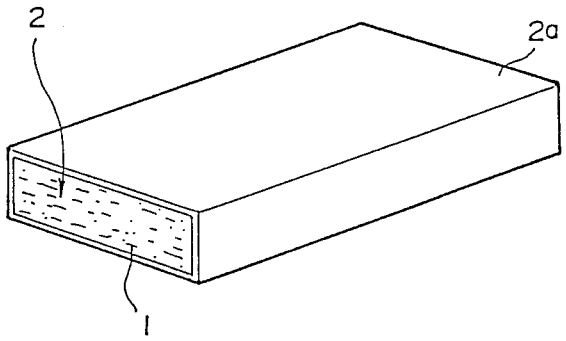
FIG. 18 is a perspective view, showing said preform made of alumina-silica type non continuous fiber material enclosed in a stainless steel case both ends of which are open, for incorporation into said composite materials.
Figure 19:
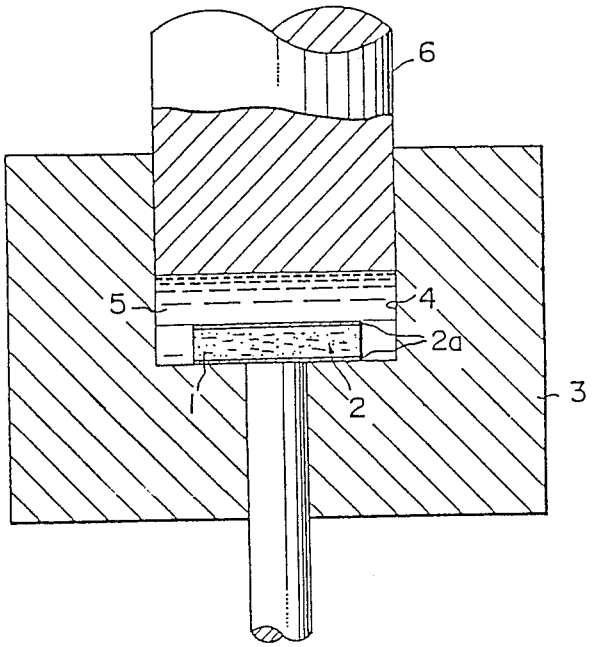
FIG. 19 is a schematic sectional diagram showing a high pressure casting device in the process of performing high pressure casting for manufacturing a composite material with the alumina-silica type short fiber material preform material of FIGS. 18 and 19 (enclosed in its stainless steel case) being incorporated in a matrix of matrix metal.

Next, each of these crystalline alumina-silica short fiber material preforms 2 was subjected to high pressure casting together with an appropriate quantity of one of the aluminum alloys A1 through A56 described above, in the following manner. First, the preform 2 was was inserted into a stainless steel case 2*a*, as shown in perspective view in FIG. 18, which was about 38×100×16 mm in internal dimensions and had both of its ends open. After this, each of these stainless steel cases 2*a* with its preform 2 held inside it was heated up to a temperature of approximately 600° C., and then said preform 2 was placed within a mold cavity 4 of a casting mold 3, which itself had previously been preheated up to a temperature of approximately 250° C. Next, a quantity 5 of the appropriate one of the aluminum alloys A1 to A56 described above, molten and maintained at a temperature of approximately 700° C., was relatively rapidly poured into said mold cavity 4, so as to surround the preform 2 therein, and then as shown in schematic perspective view in FIG. 18 a pressure plunger 6, which itself had previously been preheated up to a temperature of approximately 200° C., and which closely cooperated with the upper portion of said mold cavity 4, was inserted into said upper mold cavity portion, and was pressed downwards by a means not shown in the figure so as to pressurize said molten aluminum alloy quantity 5 and said preform 2 to a pressure of approximately 1000 kg/cm$^2$. Thereby, the molten aluminum alloy was caused to percolate into the interstices of the alumina-silica short fiber material preform 2. This pressurized state was maintained until the quantity 5 of molten aluminum alloy had completely solidified, and then the pressure plunger 6 was removed and the solidified aluminum alloy mass with the stainless steel case 2*a* and the preform 2 included therein was removed from the casting mold 3, and the peripheral portion of said solidified aluminum alloy mass and also the stainless steel case 2*a* were machined away, leaving only a sample piece of composite material which had crystalline alumina-silica short fiber material as reinforcing material and the appropriate one of the aluminum alloys A1 through A56 as matrix metal. The volume proportion of crystalline alumina-silica short fiber material in each of the resulting composite material sample pieces thus produced from the first set of said preforms 2 was approximately 20%, in each of the resulting composite material sample pieces thus produced from the second set of said preforms 2 was approximately 10%, and in each of the resulting composite material sample pieces thus produced from the third set of said preforms 2 was approximately 5%.

Next the following post processing steps were performed on the composite material samples. First, irrespective of the value for the magnesium content: those of said composite material samples which incorporated an aluminum alloy matrix metal which had copper content less than about 2% were subjected to liquidizing processing at a temperature of approximately 530° C. for approximately 8 hours, and then were subjected to artificial aging processing at a temperature of approximately 160° C. for approximately 8 hours; and those of said composite material samples which incorporated an aluminum alloy matrix metal which had copper content of at least about 2% and less than about 3.5% were subjected to liquidizing processing at a temperature of approximately 500° C. for approximately 8 hours, and then were subjected to artificial aging processing at a temperature of approximately 160° C. for approximately 8 hours; while those of said composite material samples which incorporated an aluminum alloy matrix metal which had copper content more than about 3.5% and less than about 6.5% were subjected to liquidizing processing at a temperature of approximately 480° C. for approximately 8 hours, and then were subjected to artificial aging processing at a temperature of approximately 160° C. for approximately 8 hours. Then, in each set of cases, from each of the composite material sample pieces manufactured as described above, to which heat treatment had been applied, there was cut a bending strength test piece of length approximately 50 mm, width approximately 10 mm, and thickness approximately 2 mm, with the planes of random fiber orientation extending parallel to the 50 mm×10 mm faces of said test pieces, and for each of these composite material bending strength test pieces a three point bending strength test was carried out, with a gap between supports of approximately 40 mm. In these bending strength test 5, the bending strength of the composite material bending strength test pieces was measured as the surface stress at breaking point M/Z (M is the bending moment at the breaking point, while Z is the cross section coefficient of the composite material bending strength test piece).

Figure 1:
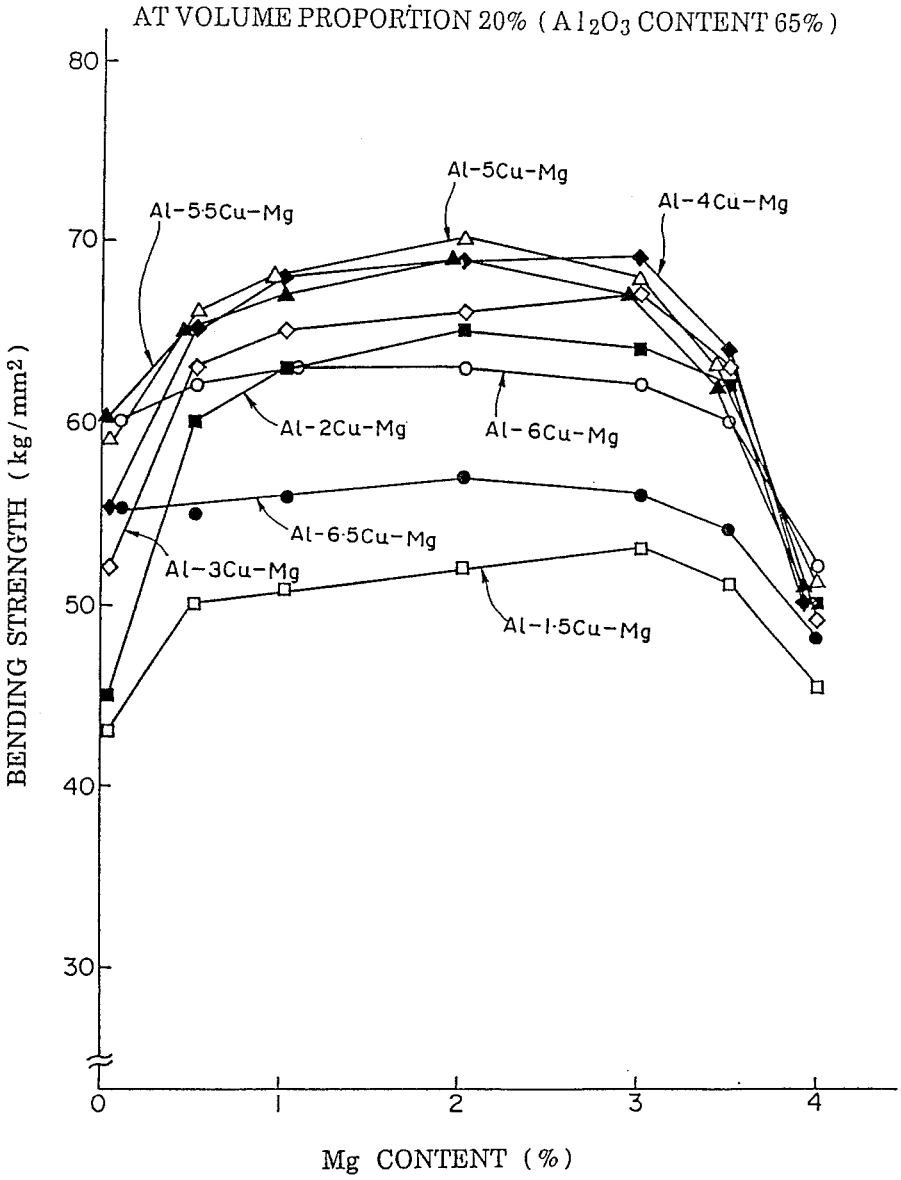
FIG. 1 is a set of graphs in which magnesium content in percent is shown along the horizontal axis and bending strength in $kg/mm^2$ is shown along the vertical axis, derived from data relating to bending strength tests for a first group of the first set of preferred embodiments of the material of the present invention (in which the volume proportion of reinforcing crystalline alumina-silica short fiber material, containing approximately 65% $Al_2O_3$ and of average fiber length approximately 1 mm, was approximately 20%), each said graph showing the relation between magnesium content and bending strength of certain composite material test pieces for a particular fixed percentage content of copper in the matrix metal of the composite material.
Figure 2:
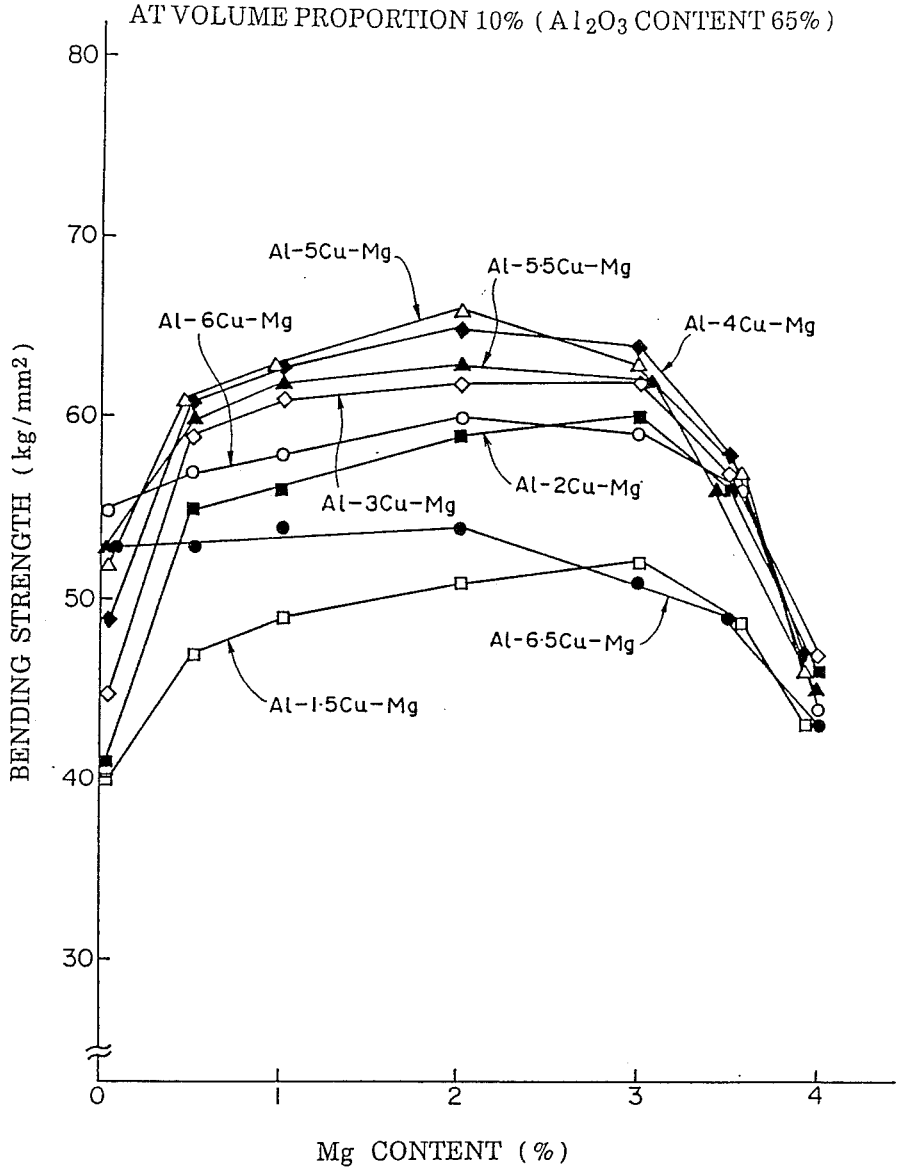
FIG. 2 is a set of graphs, similar to FIG. 1 for the first group of said first set of preferred embodiments, in which magnesium content in percent is shown along the horizontal axis and bending strength in $kg/mm^2$ is shown along the vertical axis, derived from data relating to bending strength tests for a second group of said first set of preferred embodiments of the material of the present invention (in which the volume proportion of reinforcing crystalline alumina-silica short fiber material, again containing approximately 65% $Al_2O_3$, was approximately 10%), each said graph again showing the relation between magnesium content and bending strength of certain composite material test pieces for a particular fixed percentage content of copper in the matrix metal of the composite material.
Figure 3:
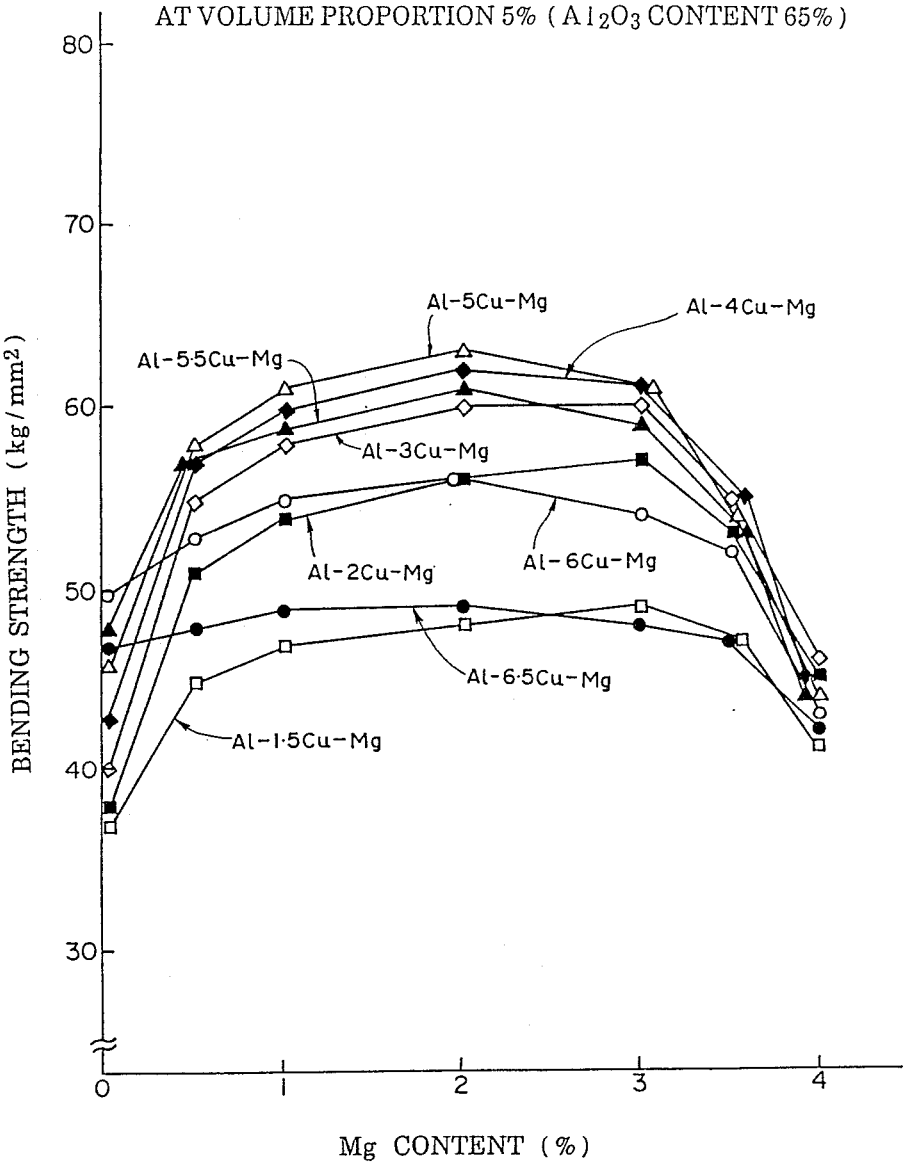
FIG. 3 is a set of graphs, similar to FIG. 1 for the first group of said first set of preferred embodiments and to FIG. 2 for the second group of said first preferred embodiment set, in which magnesium content in percent is shown along the horizontal axis and bending strength in $kg/mm^2$ is shown along the vertical axis, derived from data relating to bending strength tests for a third group of said first set of preferred embodiments of the material of the present (in which the volume proportion of reinforcing crystalline alumina-silica short fiber material, again containing approximately 65% $Al_2O_3$, was now approximately 5%), each said graph similarly showing the relation between magnesium content and bending strength of certain composite material test pieces for a particular fixed percentage content of copper in the matrix metal of the composite material.

The results of these bending strength tests were as shown in the first three columns of the appended Table 2, and as summarized in the line graphs of FIGS. 1 through 3, which relate to the cases of fiber volume proportion being equal to 20%, 10%, and 5% respectively. The first through the third columns of Table 2 show, for the respective cases of 5%, 10%, and 20% volume proportion of the reinforcing crystalline alumina-silica fiber material, the values of the bending strength (in $kg/mm^2$) for each of the test sample pieces A1 through A56. And each of the line graphs of FIG. 1 shows the relation between magnesium content (in percent) and the bending strength (in $kg/mm^2$) shown along the vertical axis of those of said composite material test pieces having as matrix metals aluminum alloys with percentage content of magnesium as shown along the horizontal axis and with percentage content of copper fixed along said line graph, and having as reinforcing material the above specified crystalline alumina-silica fibers ($Al_2O_3$ content approximately 65%) in volume proportion of 20%; each of the line graphs of FIG. 2 shows the relation between magnesium content (in percent) and the bending strength (in $kg/mm^2$) shown along the vertical axis of those of said composite material test pieces having as matrix metals aluminum alloys with percentage content of magnesium as shown along the horizontal axis and with percentage content of copper fixed along said line graph, and having as reinforcing material the above specified crystalline alumina-silica fibers ($Al_2O_3$ content approximately 65%) in volume proportion of 10%; and each of the line graphs of FIG. 3 shows the relation between magnesium content (in percent) and the bending strength (in $kg/mm^2$) shown along the vertical axis of those of said composite material test pieces having as matrix metals aluminum alloys with percentage content of magnesium as shown along the horizontal axis and with percentage content of copper fixed along said line graph, and having as reinforcing material the above specified crystalline alumina-silica fibers ($Al_2O_3$ content approximately 65%) in volume proportion of 5%.

From Table 2 and from FIGS. 1 through 3 it will be understood that for all of these composite materials, when as in these cases the volume proportion of the reinforcing crystalline alumina-silica short fiber material of these bending strength composite material test sample pieces was approximately 20%, approximately 10%, or approximately 5%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 1% to approximately 3%, the bending strength of the composite material test sample pieces attained a substantially maximum value; and, when the magnesium content increased above or decreased below this range, then the bending strength of the composite material test sample pieces decreased gradually; while, when the magnesium content was either in the low range below approximately 0.5% or was in the high range above approximately 3.5%, the bending strength of the composite material test sample pieces reduced relatively suddenly with decrease (excluding the cases where the copper content of the matrix metal was approximately 6% or approximately 6.5%) or increase respectively of the magnesium content; and, when the magnesium content was approximately 4%, the bending strength of the composite material test sample pieces had substantially the same value, as when the magnesium content was approximately 0%.

From the results of these bending strength tests it will be seen that, in order to provide for a good and appropriate bending strength for a composite material having as reinforcing fiber material such crystalline alumina-silica short fibers with $Al_2O_3$ content approximately 65% in volume proportions of approximately 20%, approximately 10%, and approximately 5%, and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6% while the magnesium content of said Al-Cu-Mg type aluminum alloy matrix metal should be in the range of from approximately 0.5% to approximately 3.5%.

THE SECOND SET OF PREFERRED EMBODIMENTS

Next, the present inventors manufactured further samples of various composite materials, again utilizing as reinforcing material the same crystalline alumina-silica short type fiber material, and utilizing as matrix metal substantially the same fifty six types of Al-Cu-Mg type aluminum alloys, but this time employing, for the one set, fiber volume proportions of approximately 40%, and, for another set, fiber volume proportions of approximately 30%. Then the present inventors again conducted evaluations of the bending strength of the various resulting composite material sample pieces.

First, a set of fifty six quantities of aluminum alloy material the same as those utilized in the first set of preferred embodiments were produced in the same manner as before, again having as base material aluminum and having various quantities of magnesium and copper mixed therewith. And an appropriate number (a hundred and twelve) of crystalline alumina-silica short type fiber material preforms were as before made by the method disclosed above with respect to the first set of preferred embodiments, one set of said crystalline alumina-silica short type fiber material preforms now having a fiber volume proportion of approximately 40%, and another set of said crystalline alumina-silica short type fiber material preforms now having a fiber volume proportion of approximately 30%, by contrast to the first set of preferred embodiments described above. These preforms had substantially the same dimensions as the preforms of the first set of preferred embodiments.

Next, substantially as before, each of these crystalline alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had crystalline alumina-silica short type fiber material as reinforcing material and the appropriate one of the aluminum alloys A1 through A56 as matrix metal. The volume proportion of crystalline alumina-silica short type fibers in each of the one set of the resulting composite material sample pieces was thus now approximately 40%, and in each of the other set of the resulting composite material sample pieces was thus now approximately 30%. And post processing steps were performed on the composite material samples, substantially as before. From each of the composite material sample pieces manufactured as described above, to which heat treatment had been applied, there was cut a bending strength test piece of dimensions and parameters substantially as in the case of the first set of preferred embodiments, and for each of these composite material bending strength test pieces a bending strength test was carried out, again substantially as before.

Figure 4:
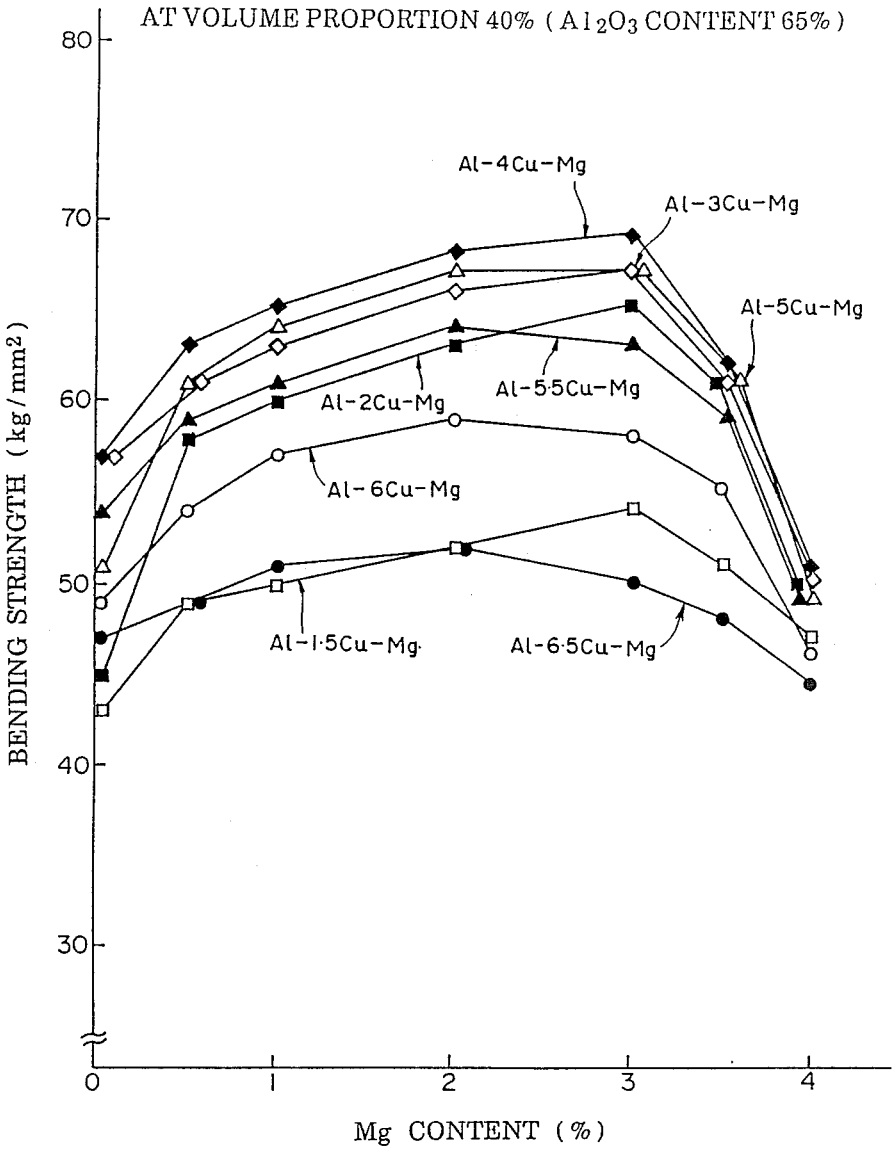
FIG. 4 is a set of graphs, similar to FIGS. 1, 2, and 3 for the first through the third groups of said first set of preferred embodiments respectively, in which again magnesium content in percent is shown along the horizontal axis and bending strength in $kg/mm^2$ is shown along the vertical axis, derived from data relating to bending strength tests for a first group of the second set of preferred embodiments of the material of the present invention (in which the volume proportion of reinforcing crystalline alumina-silica short fiber material, again containing approximately 65% $Al_2O_3$, was now approximately 40%), each said graph similarly showing the relation between magnesium content and bending strength of certain composite material test pieces for a particular fixed percentage content of copper in the matrix metal of the composite material.
Figure 5:
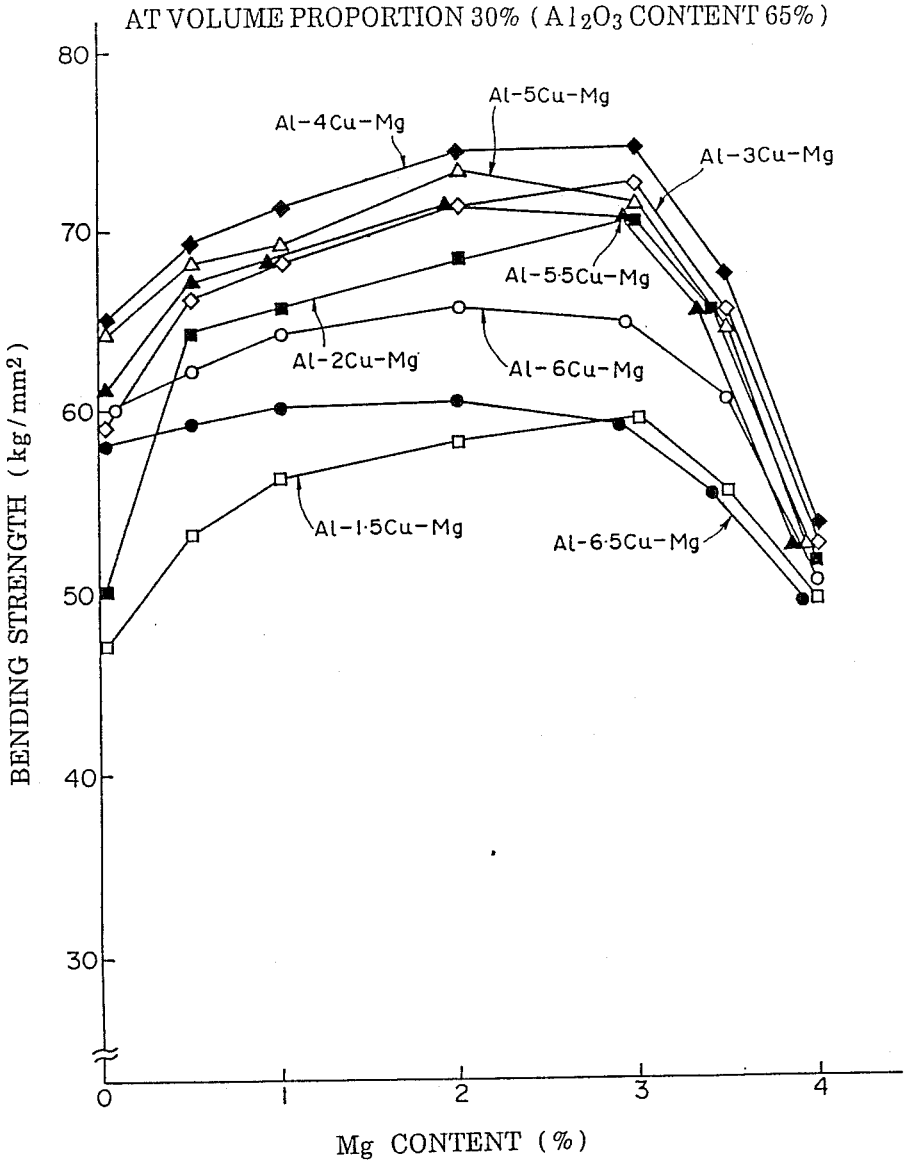
FIG. 5 is a set of graphs, similar to FIGS. 1, 2, and 3 for the three groups of the first set of preferred embodiments and to FIG. 4 for the first group of the second set of preferred embodiments respectively, in which again magnesium content in percent is shown along the horizontal axis and bending strength in $kg/mm^2$ is shown along the vertical axis, derived from data relating to bending strength tests for a second group of said second set of preferred embodiments of the material of the present invention (in which the volume proportion of reinforcing crystalline alumina-silica short fiber material, again containing approximately 65% $Al_2O_3$, was now approximately 30%), each said graph similarly showing the relation betwen magnesium content and bending strength of certain composite material test pieces for a particular fixed percentage content of copper in the matrix metal of the composite material.

The results of these bending strength tests were as shown in the last two columns of Table 2 and as summarized in the graphs of FIGS. 4 and 5, which relate to the cases of fiber volume proportion being equal to 40% and 30% respectively; thus, FIGS. 4 and 5 correspond to FIGS. 1 through 3 relating to the first set of preferred embodiments. In the graphs of FIGS. 4 and 5, there are again shown relations between magnesium content and the bending strength (in $kg/mm^2$) of certain of the composite material test pieces, for percentage contents of copper fixed along the various lines thereof.

From Table 2 and from FIGS. 4 and 5 it will be understood that for all of these composite materials, when as in these cases the volume proportion of the reinforcing crystalline alumina-silica short fiber material of these bending strength composite material test sample pieces was approximately 40% or was approximately 30%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, when the magnesium content was either in the low range below approximately 0.5% or was in the high range above approximately 3.5%, the bending strength of the composite material test sample pieces reduced relatively suddenly with decrease (excluding the cases where the copper content of the matrix metal was approximately 6% or approximately 6.5%) or increase respectively of the magnesium content; and, when the magnesium content was approximately 4%, the bending strength of the composite material test sample pieces had substantially the same value, as when the magnesium content was approximately 0%.

From the results of these bending strength tests it will be seen that, in order to provide for a good and appropriate bending strength for a composite material having as reinforcing fiber material such crystalline alumina-silica short fibers with $Al_2O_3$ content approximately 65% in volume proportion of approximately 40% and approximately 30% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6% and particularly should be in the range of from approximately 2% to approximately 5.5%, while the magnesium content of said Al-Cu-Mg type aluminum alloy matrix metal should be in the range of from approximately 0.5% to approximately 3.5%.

THE THIRD SET OF PREFERRED EMBODIMENTS

For the third set of preferred embodiments of the present invention, a different type of reinforcing fiber was chosen. The present inventors manufactured by using the high pressure casting method samples of various composite materials, utilizing as matrix metal Al-Cu-Mg type aluminum alloys of various compositions, and utilizing as reinforcing material crystalline alumina-silica short fiber material, which in this case had composition about 49% $Al_2O_3$ and remainder substantially $SiO_2$, with the mullite crystalline proportion contained therein again being about 60%, and which again had average fiber length about 1 mm and average fiber diameter about 3 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (again a hundred and twelve) of crystalline alumina-silica short type fiber material preforms were as before made by the method disclosed above with respect to the first and second sets of preferred embodiments, one set of said crystalline alumina-silica short type fiber material preforms now having a fiber volume proportion of approximately 30%, and another set of said crystalline alumina-silica short type fiber material preforms now having a fiber volume proportion of approximately 10%, by contrast to the first and second sets of preferred embodiments described above. These preforms had substantially the same dimensions as the preforms of the first and second sets of preferred embodiments.

Next, substantially as before, each of these crystalline alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had crystalline alumina-silica short type fiber material as reinforcing material and the appropriate one of the aluminum alloys A1 through A56 as matrix metal. The volume proportion of crystalline alumina-silica short type fibers in each of the one set of the resulting composite material sample pieces was thus now approximately 30%, and in each of the other set of the resulting composite material sample pieces was thus now approximately 10%. And post processing steps were performed on the composite material samples, substantially as before. From each of the composite material sample pieces manufactured as described above, to which heat treatment had been applied, there was cut a bending strength test piece of dimensions and parameters substantially as in the case of the first and second sets of preferred embodiments, and for each of these composite material bending strength test pieces a bending strength test was carried out, again substantially as before.

Figure 6:
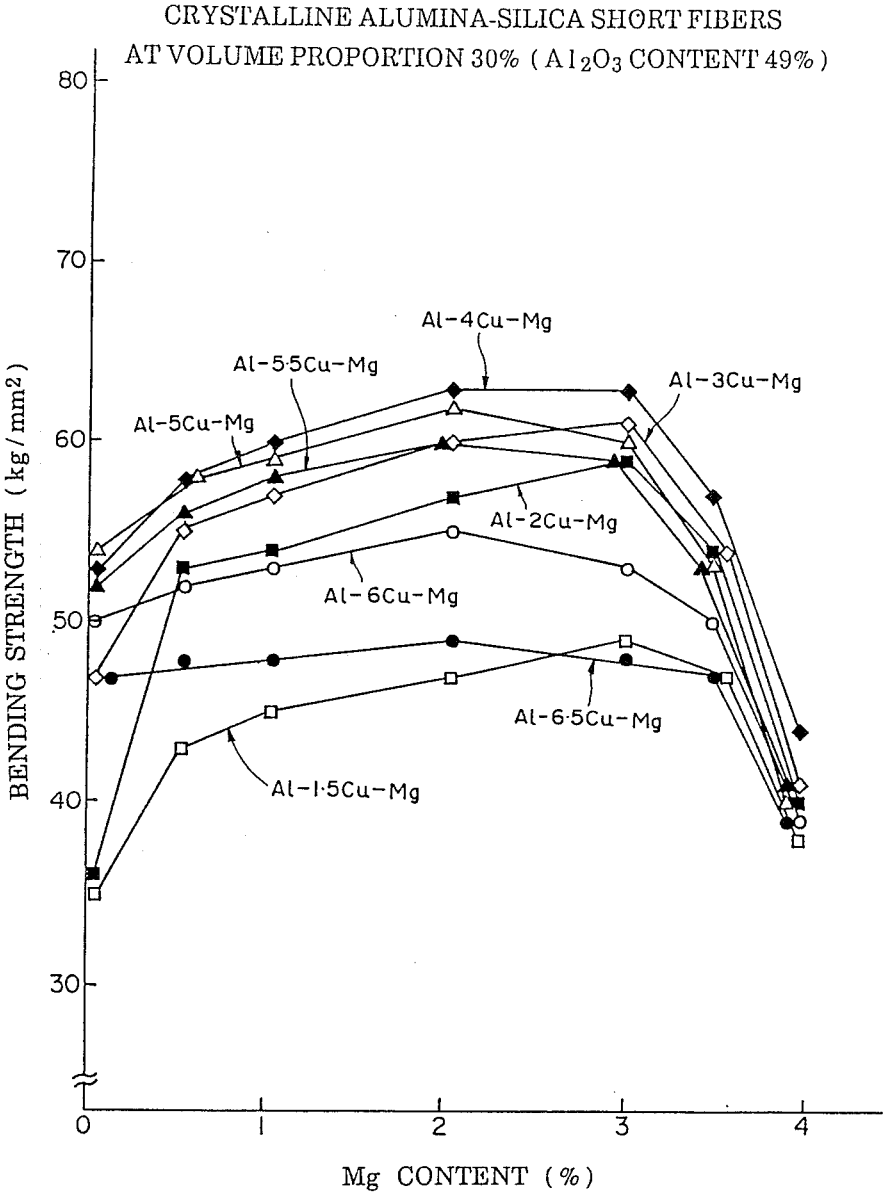
FIG. 6 is a set of graphs, similar to FIGS. 1, 2, and 3 for the first through the third groups of said first set of preferred embodiments respectively and to FIGS. 4 and 5 for the first and second groups of said second preferred embodiment set, in which again magnesium content in percent is shown along the horizontal axis and bending strength in $kg/mm^2$ is shown along the vertical axis, derived from data relating to bending strength tests for a first group of the third set of preferred embodiments of the material of the present invention (in which the volume proportion of reinforcing crystalline alumina-silica short fiber material, now containing approximately 49% $Al_2O_3$, was now approximately 30%), each said graph similarly showing the relation between magnesium content and bending strength of certain composite material test pieces for a particular fixed percentage content of copper in the matrix metal of the composite material.
Figure 7:
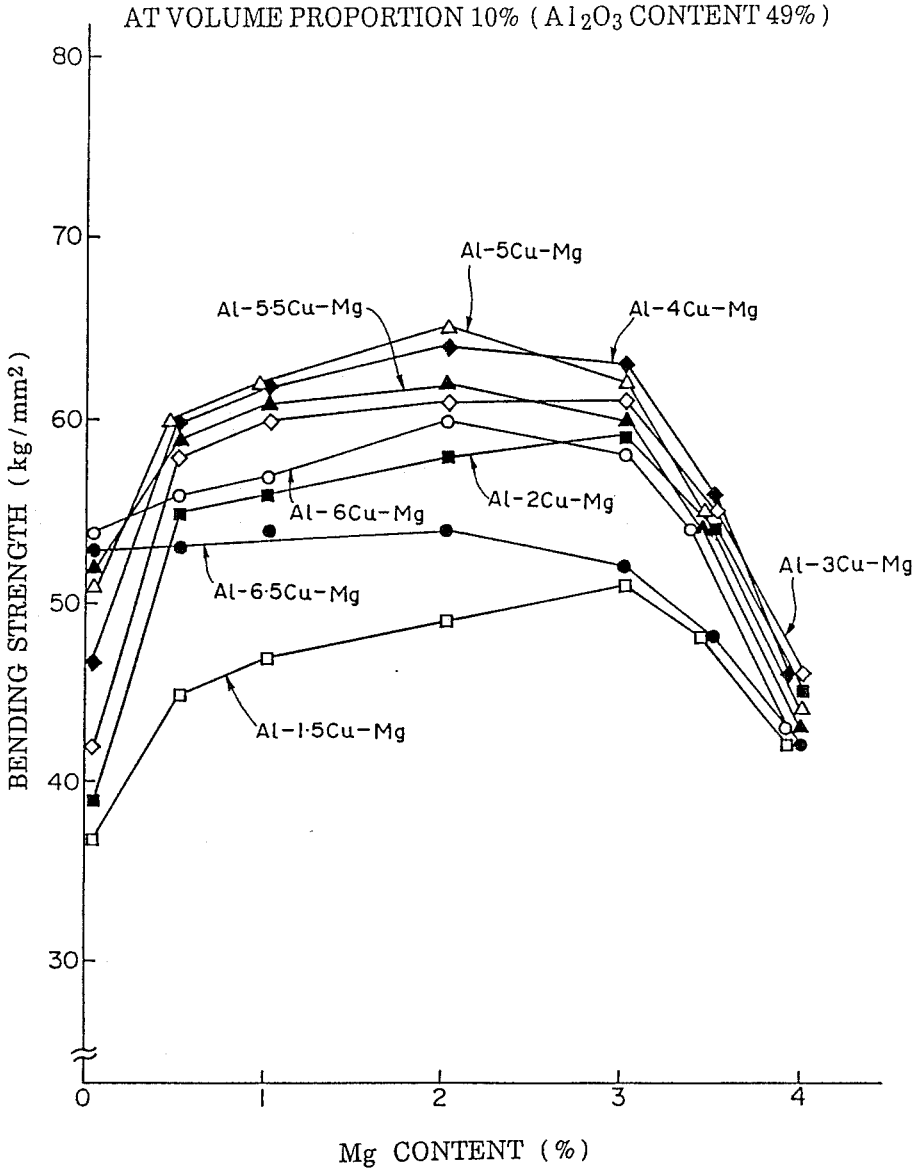
FIG. 7 is a set of graphs, similar to FIGS. 1, 2, and 3 for the three groups of the first set of preferred embodiments, to FIGS. 4 and 5 for the first and second groups of said second preferred embodiment set, and to FIG. 4 for the first group of said third preferred embodiment set respectively, in which again magnesium content in percent is shown along the horizontal axis and bending strength in $kg/mm^2$ is shown along the vertical axis, derived from data relating to bending strength tests for a second group of said third set of preferred embodiments of the material of the present invention (in which the volume proportion of reinforcing crystalline alumina-silica short fiber material, again now containing approximately 49% $Al_2O_3$, was now approximately 10%), each said graph similarly showing the relation between magnesium content and bending strength of certain composite material test pieces for a particular fixed percentage content of copper in the matrix metal of the composite material.

The results of these bending strength tests were as shown in Table 3 and as summarized in the graphs of FIGS. 6 and 7, which relate to the cases of fiber volume proportion being equal to 30% and 10% respectively; thus, FIGS. 6 and 7 correspond to FIGS. 1 through 3 relating to the first set of preferred embodiments and to FIGS. 4 and 5 relating to the second set of preferred embodiments. In the graphs of FIGS. 4 and 5, there are again shown relations between magnesium content and the bending strength (in $kg/mm^2$) of certain of the composite material test pieces, for percentage contents of copper fixed along the various lines thereof.

From Table 3 and from FIGS. 6 and 7 it will be understood that for all of these composite materials, when as in these cases the volume proportion of the reinforcing crystalline alumina-silica short fiber material of these bending strength composite material test sample pieces was approximately 30% or was approximately 10%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, when the magnesium content was either in the low range below approximately 0.5% or was in the high range above approximately 3.5%, the bending strength of the composite material test sample pieces reduced relatively suddenly with decrease (excluding the cases where the copper content of the matrix metal was approximately 6% or approximately 6.5%) or increase respectively of the magnesium content; and, when the magnesium content was approximately 4%, the bending strength of the composite material test sample pieces had substantially the same value as, or at least not a greater value than, when the magnesium content was approximately 0%.

From the results of these bending strength tests it will be seen that, in order to provide for a good and appropriate bending strength for a composite material having as reinforcing fiber material such crystalline alumina-silica short fibers with $Al_2O_3$ content approximately 49% in volume proportions of approximately 30% and approximately 10% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6%, while the magnesium content of said Al-Cu-Mg type aluminum alloy matrix metal should be in the range of from approximately 0.5% to approximately 3.5%.

THE FOURTH SET OF PREFERRED EMBODIMENTS

For the fourth set of preferred embodiments of the present invention, again a different type of reinforcing fiber was chosen. The present inventors manufactured by using the high pressure casting method samples of various composite materials, utilizing as matrix metal Al-Cu-Mg type aluminum alloys of various compositions, and utilizing as reinforcing material crystalline alumina-silica short fiber material, which in this case had composition about 35% $Al_2O_3$ and remainder substantially $SiO_2$, with the mullite crystalline proportion contained therein now being about 40%, and which again had average fiber length about 1 mm and average fiber diameter about 3 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (again a hundred and twelve) of crystalline alumina-silica short type fiber material preforms were as before made by the method disclosed above with respect to the previously described sets of preferred embodiments, one set of said crystalline alumina-silica short type fiber material preforms now having a fiber volume proportion of approximately 30%, and another set of said crystalline alumina-silica short type fiber material preforms now having a fiber volume proportion of approximately 10%, by contrast to the various sets of preferred embodiments described above. These preforms had substantially the same dimensions as the preforms of the previously described sets of preferred embodiments.

Next, substantially as before, each of these crystalline alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had crystalline alumina-silica short type fiber material as reinforcing material and the appropriate one of the aluminum alloys A1 through A56 as matrix metal. The volume proportion of crystalline alumina-silica short type fibers in each of the one set of the resulting composite material sample pieces was thus now approximately 30%, and in each of the other set of the resulting composite material sample pieces was thus now approximately 10%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 8:
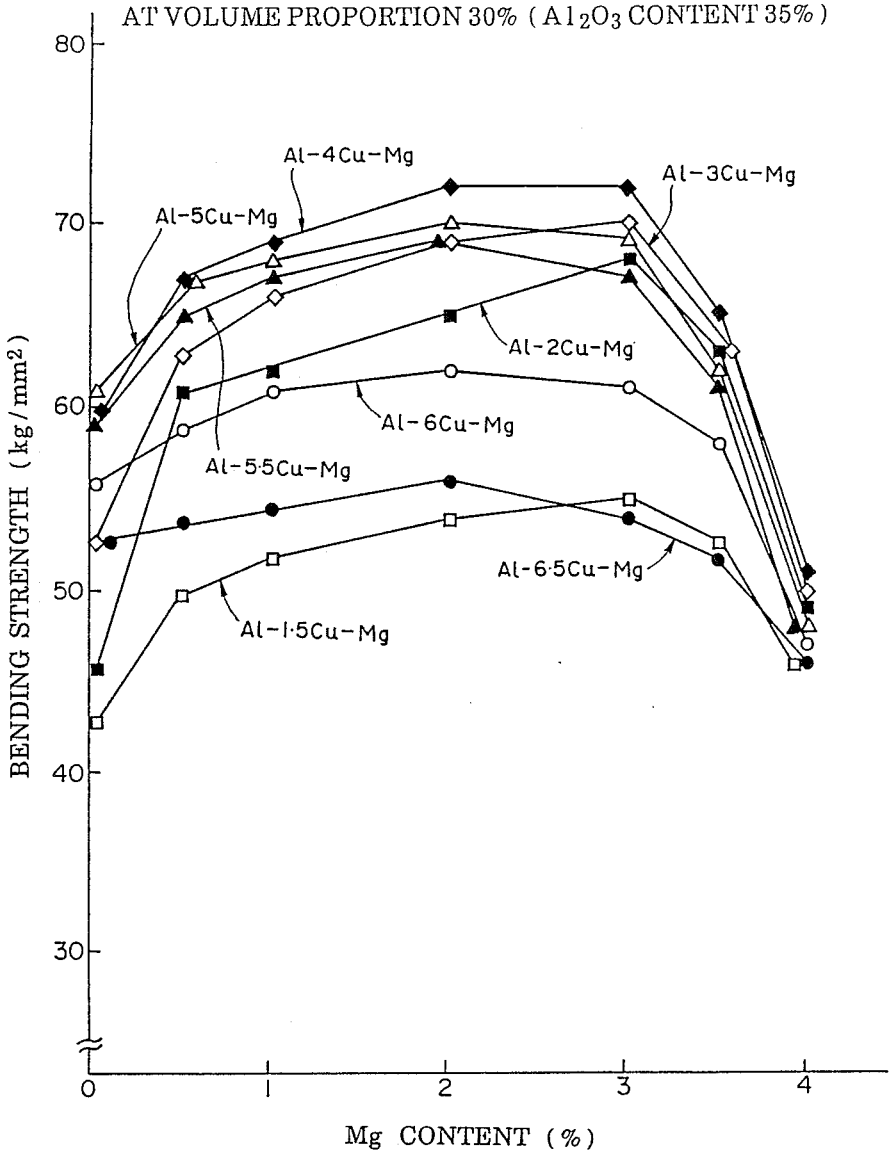
FIG. 8 is a set of graphs, similar to FIGS. 1, 2, and 3 for the first through the third groups of said first set of preferred embodiments respectively, to FIGS. 4 and 5 for the first and second groups of said second preferred embodiment set, and to FIGS. 6 and 7 for the third preferred embodiment set, respectively, in which again magnesium content in percent is shown along the horizontal axis and bending strength in $kg/mm^2$ is shown along the vertical axis, derived from data relating to bending strength tests for a first group of the fourth set of preferred embodiments of the material of the present invention (in which the volume proportion of reinforcing crystalline alumina-silica short fiber material, now containing approximately 35% $Al_2O_3$, was now approximately 30%), each said graph similarly showing the relation between magnesium content and bending strength of certain composite material test pieces for a particular fixed percentage content of copper in the matrix metal of the composite material.
Figure 9:
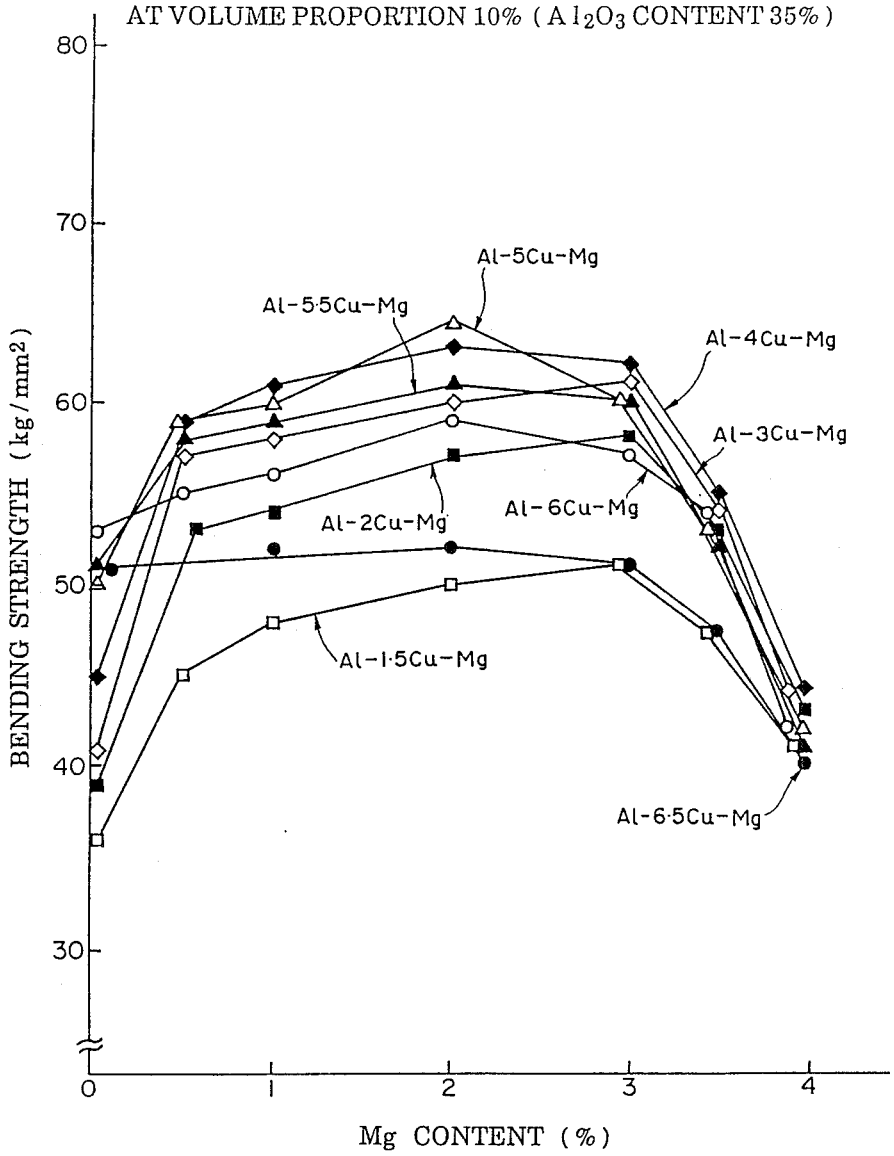
FIG. 9 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, and to FIG. 8 for the first group of this fourth preferred embodiment set respectively, in which again magnesium content in percent is shown along the horizontal axis and bending strength in $kg/mm^2$ is shown along the vertical axis, derived from data relating to bending strength tests for a second group of said fourth set of preferred embodiments of the material of the present invention (in which the volume proportion of reinforcing crystalline alumina-silica short fiber material, again now containing approximately 35% $Al_2O_3$, was now approximately 10%), each said graph similarly showing the relation between magnesium content and bending strength of certain composite material test pieces for a particular fixed percentage content of copper in the matrix metal of the composite material.

The results of these bending strength tests were as shown in Table 4 and as summarized in the graphs of FIGS. 8 and 9, which relate to the cases of fiber volume proportion being equal to 30% and 10% respectively; thus, FIGS. 8 and 9 correspond to FIGS. 1 through 3 relating to the first set of preferred embodiments, to FIGS. 4 and 5 relating to the second set of preferred embodiments, and to FIGS. 6 and 7 relating to the third preferred embodiment set. In the graphs of FIGS. 8 and 9, there are again shown relations between magnesium content and the bending strength (in $kg/mm^2$) of certain of the composite material test pieces, for percentage contents of copper fixed along the various lines thereof.

From Table 4 and from FIGS. 8 and 9 it will be understood that for all of these composite materials, when as in these cases the volume proportion of the reinforcing crystalline alumina-silica short fiber material of these bending strength composite material test sample pices was approximately 30% or was approximately 10%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the boiling strength of the composite material test sanmple pieces decreased gradually; while, when the magnesium content was either in the low range below approximately 0.5% or was in the high range above approximately 3.5%, the bending strength of the composite material test sample pieces reduced relatively suddenly with decrease (excluding the cases where the copper content of the matrix metal was approximately 6% or approximately 6.5%) or increase respectively of the magnesium content; and, when the magnesium content was approximately 4%, the bending strength of the composite material test sample pieces had substantially the same value as, or at least not a greater value than, when the magnesium content was approximately 0%.

From the results of these bending strength tests will be seen that, in order to provide for a good and appropriate bending strength for a composite material having as reinforcing fiber material such crystalline alumina-silica short fibers with $Al_2O_3$ content approximately 35% in volume proportions of approximately 30% and approximately 10% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6%, while the magnesium content of said Al-Cu-Mg type aluminum alloy matrix metal should be in the range of from approximately 0.5% to approximately 3.5%.

THE FIFTH SET OF PREFERRED EMBODIMENTS

For the fifth set of preferred embodiments of the present invention, again a different type of reinforcing fiber was chosen. The present inventors manufactured by using the high pressure casting method samples of various composite materials, utilizing as matrix metal Al-Cu-Mg type aluminum alloys of various compositions, and utilizing as reinforcing material amorphous alumina-silica short fiber material, which in this case had composition about 49% $Al_2O_3$ and remainder substantially $SiO_2$, and which again had average fiber length about 1 mm and average fiber diameter about 3 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (now a hundred and sixty eight) of amorphous alumina-silica short type fiber material preforms were as before made by the method disclosed above with respect to the previously described sets of preferred embodiments, one set of said amorphous alumina-silica short type fiber material preforms now having a fiber volume proportion of approximately 20%, a second set of said amorphous alumina-silica short type fiber material preforms now having a fiber volume proportion of approximately 10%, and a third set of said amorphous alumina-silica short type fiber material preforms now having a fiber volume proportion of approximately 5%, by contrast to the various sets of preferred embodiments described above. These preforms had substantially the same dimensions as the preforms of the previously described sets of preferred embodiments.

Next, substantially as before, each of these amorphous alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had amorphous alumina-silica short type fiber material as reinforcing material and the appropriate one of the aluminum alloys A1 through A56 as matrix metal. The volume proportion of amorphous alumina-silica short type fibers in each of the first set of the resulting composite material sample pieces was thus now approximately 20%, in each of the second set of the resulting composite material sample pieces was thus now approximately 10%, and in each of the third set of the resulting composite material sample pieces was thus now approximately 5%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 10:
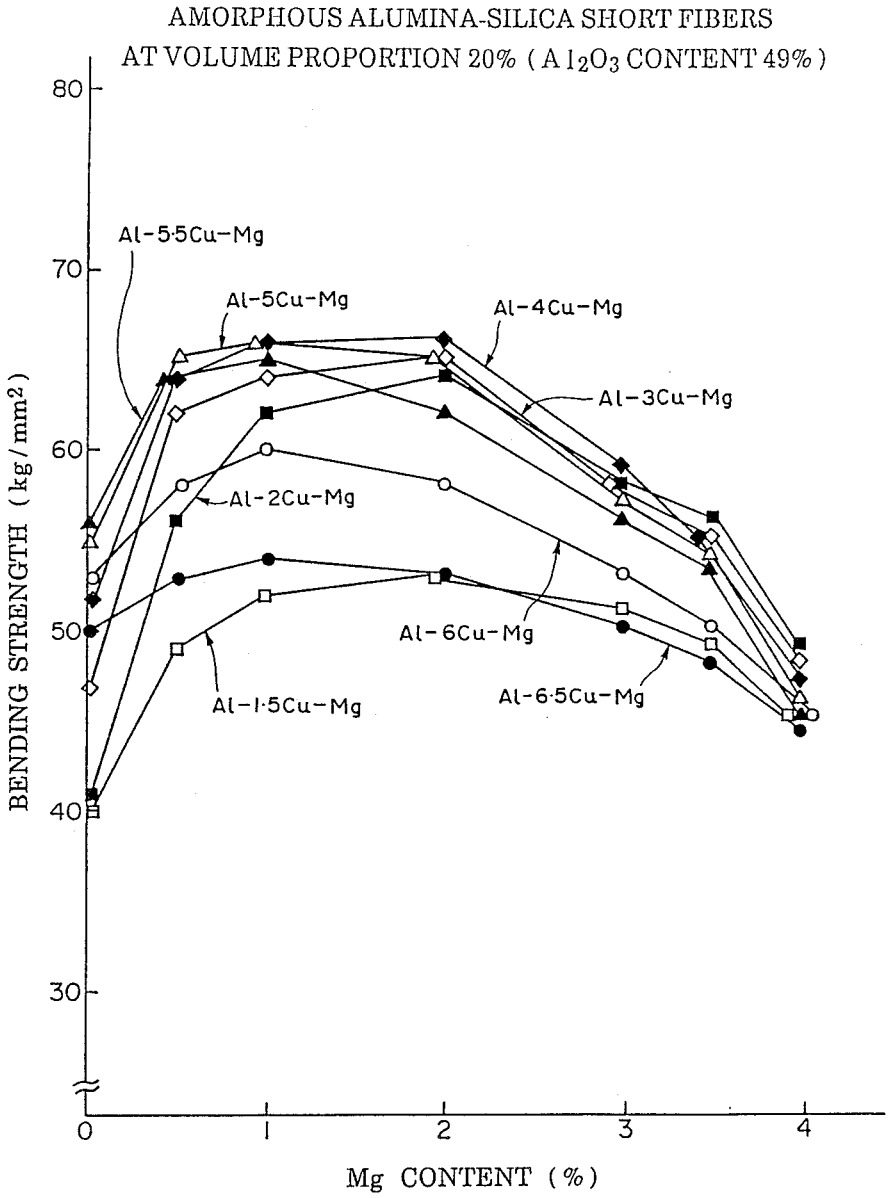
FIG. 10 is a set of graphs, similar to FIGS. 1, 2, and 3 for the first through the third groups of the first set of preferred embodiments respectively, to FIGS. 4 and 5 for the first and second groups of the second preferred embodiment set, to FIGS. 6 and 7 for the third preferred embodiment set, and to FIGS. 8 and 9 for the fourth preferred embodiment set, respectively, in which again magnesium content in percent is shown along the horizontal axis and bending strength in $kg/mm^2$ is shown along the vertical axis, derived from data relating to bending strength tests for a test group of the fifth set of preferred embodiments of the material of the present invention (in which the volume proportion of reinforcing, now amorphous, alumina-silica short fiber material, containing approximately 49% $Al_2O_3$, was approximately 20%), each said graph similarly showing the relation between magnesium content and bending strength of certain composite material test pieces for a particular fixed percentage content of copper in the matrix metal of the composite material.
Figure 11:
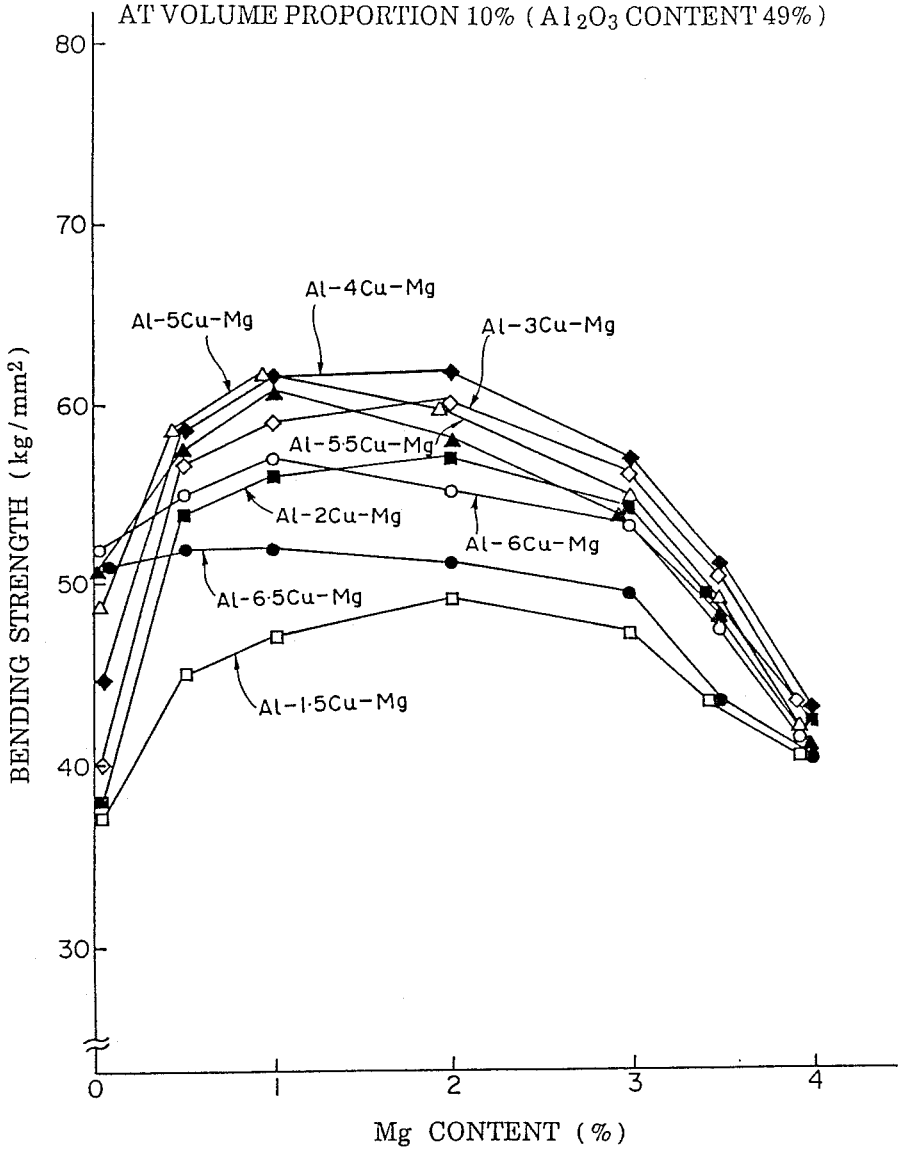
FIG. 11 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, and to FIG. 10 for the first group of this fifth preferred embodiment set respectively, in which again magnesium content in percent is shown along the horizontal axis and bending strength in $kg/mm^2$ is shown along the vertical axis, derived from data relating to bending strength tests for a second group of said fifth set of preferred embodiments of the material of the present invention (in which the volume proportion of reinforcing, now amorphous, alumina-silica short fiber material, containing approximately 49% $Al_2O_3$, was now approximately 10%), each said graph similarly showing the relation between magnesium content and bending strength of certain composite material test pieces for a particular fixed percentage content of copper in the matrix metal of the composite material.
Figure 12:
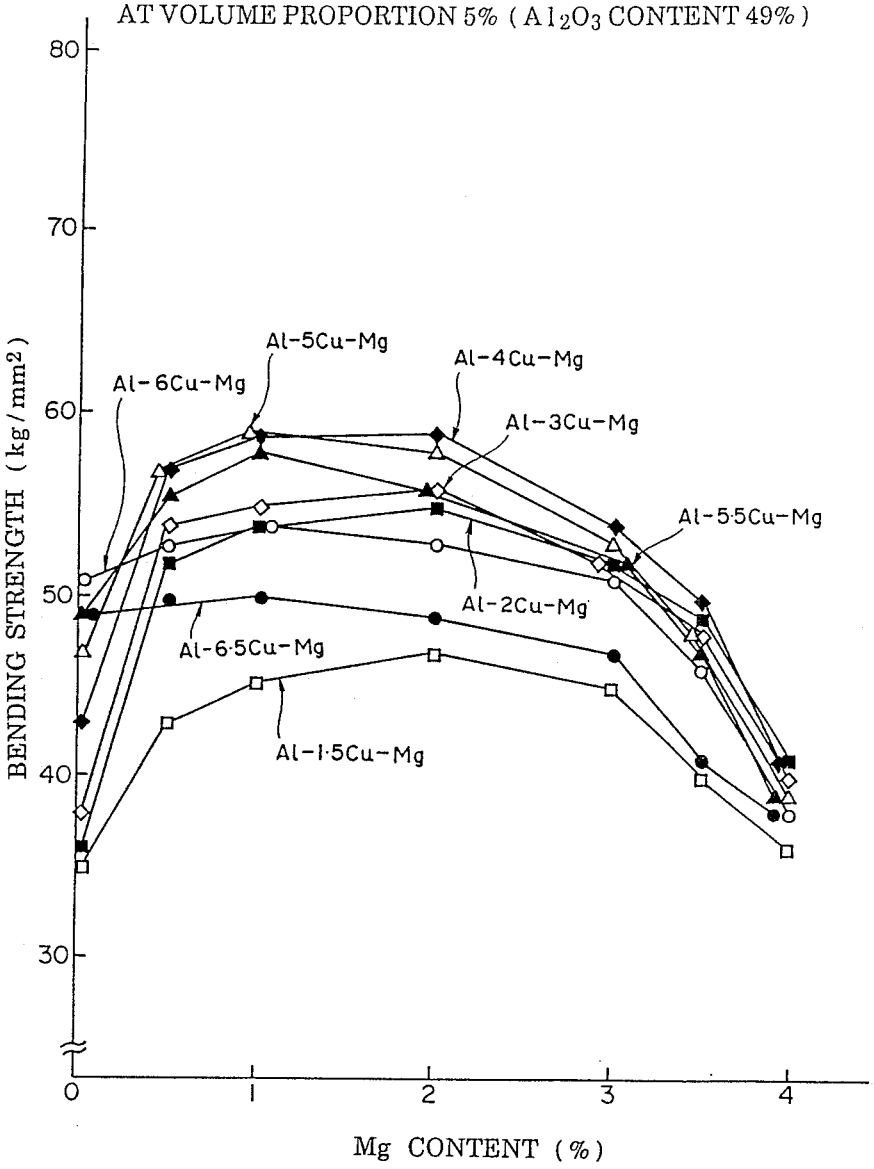
FIG. 12 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, and to FIGS. 10 and 11 for the first and second groups of this fifth preferred embodiment set, respectively, in which again magnesium content in percent is shown along the horizontal axis and bending strength in $kg/mm^2$ is shown along the vertical axis, derived from data relating to bending strength tests for a third group of said fifth set of preferred embodiments of the material of the present invention (in which the volume proportion of reinforcing, now amorphous, alumina-silica short fiber material, containing approximately 49% $Al_2O_3$, was now approximately 5%), each said graph similarly showing the relation between magnesium content and bending strength of certain composite material test pieces for a particular fixed percentage content of copper in the matrix metal of the composite material.

The results of these bending strength tests were as shown in Table 5 and as summarized in the graphs of FIGS. 10 through 12, which relate to the cases of fiber volume proportion being equal to 20%, 10%, and 5% respectively; thus, FIGS. 10 through 12 correspond to FIGS. 1 through 3 relating to the first set of preferred embodiments, to FIGS. 4 and 5 relating to the second set of preferred embodiments, to FIGS. 6 and 7 relating to the third preferred embodiment set, and to FIGS. 8 and 9 relating to the fourth preferred embodiment set. In the graphs of FIGS. 10 through 12, there are again shown relations between magnesium content and the bending strength (in $kg/mm^2$) of certain of the composite material test pieces, for percentage contents of copper fixed along the various lines thereof.

From Table 5 and from FIGS. 10 through 12 it will be understood that for all of these composite materials, when as in these cases the volume proportion of the reinforcing amorphous alumina-silica short fiber material of these bending strength composite material test sample pieces was approximately 20%, was approximately 10%, or was approximately 5%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 1% to approximately 2%, the bending strength of the composite material test sample pieces attained a substantially maximum value; and, when the magnesium content increased above or decreased below this range, then the bending strength of the composite material test sample pieces decreased gradually; while, when the magnesium content was either in the low range below approximately 0.5% or was in the high range above approximately 3.5%, the bending strength of the composite material test sample pieces reduced relatively suddenly with decrease (excluding the cases where the copper content of the matrix metal was approximately 6% or approximately 6.5%) or increase respectively of the magnesium content; and, when the magnesium content was approximately 4%, the bending strength of the composite material test sample pieces had substantially the same value as, or at least not a greater value than, when the magnesium content was approximately 0%.

From the results of these bending strength tests it will be seen that,in order to provide for a good and appropriate bending strength for a composite material having as reinforcing fiber material such amorphous alumina-silica short fibers with $Al_2O_3$ content approximately 49% in volume proportions of approximately 20%, approximately 10%, and approximately 5% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6%, while the magnesium content of said Al-Cu-Mg type aluminum alloy matrix metal should be in the range of from approximately 0.5% to approximately 3.5%, and particularly should be in the range of from approximately 0.5% to approximately 3%.

THE SIXTH SET OF PREFERRED EMBODIMENTS

For the sixth set of preferred embodiments of the present invention, the same type of reinforcing fiber as in the fifth preferred embodiment set, but utilizing different fiber volume proportions, was chosen. The present inventors manufactured by using the high pressure casting method samples of various composite materials, utilizing as matrix metal Al-Cu-Mg type aluminum alloys of various compositions, and utilizing as reinforcing material amorphous alumina-silica short fiber material, which again in this case had compostion about 49% $Al_2O_3$ and remainder substantially $SiO_2$, and which again had average fiber length about 1 mm and average fiber diameter about 3 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (now a hundred and twelve) of amorphous alumina-silica short type fiber material preforms were as before made by the method disclosed above with respect to the previously described sets of preferred embodiments, one set of said amorphous alumina-silica short type fiber material preforms now having a fiber volume proportion of approximately 40%, and another set of said amorphous alumina-silica short type fiber material preforms now having a fiber volume proportion of approximately 30%, by contrast to the various sets of preferred embodiments described above. These preforms had substantially the same dimensions as the preforms of the previously described sets of preferred embodiments.

Next, substantially as before, each of these amorphous alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had amorphous alumina-silica short type fiber material as reinforcing material and the appropriate one of the aluminum alloys A1 through A56 as matrix metal. The volume proportion of amorphous alumina-silica short type fibers in each of the first set of the resulting composite material sample pieces was thus now approximately 40%, and in each of the second set of the resulting composite material sample pieces was thus now approximately 30%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 13:
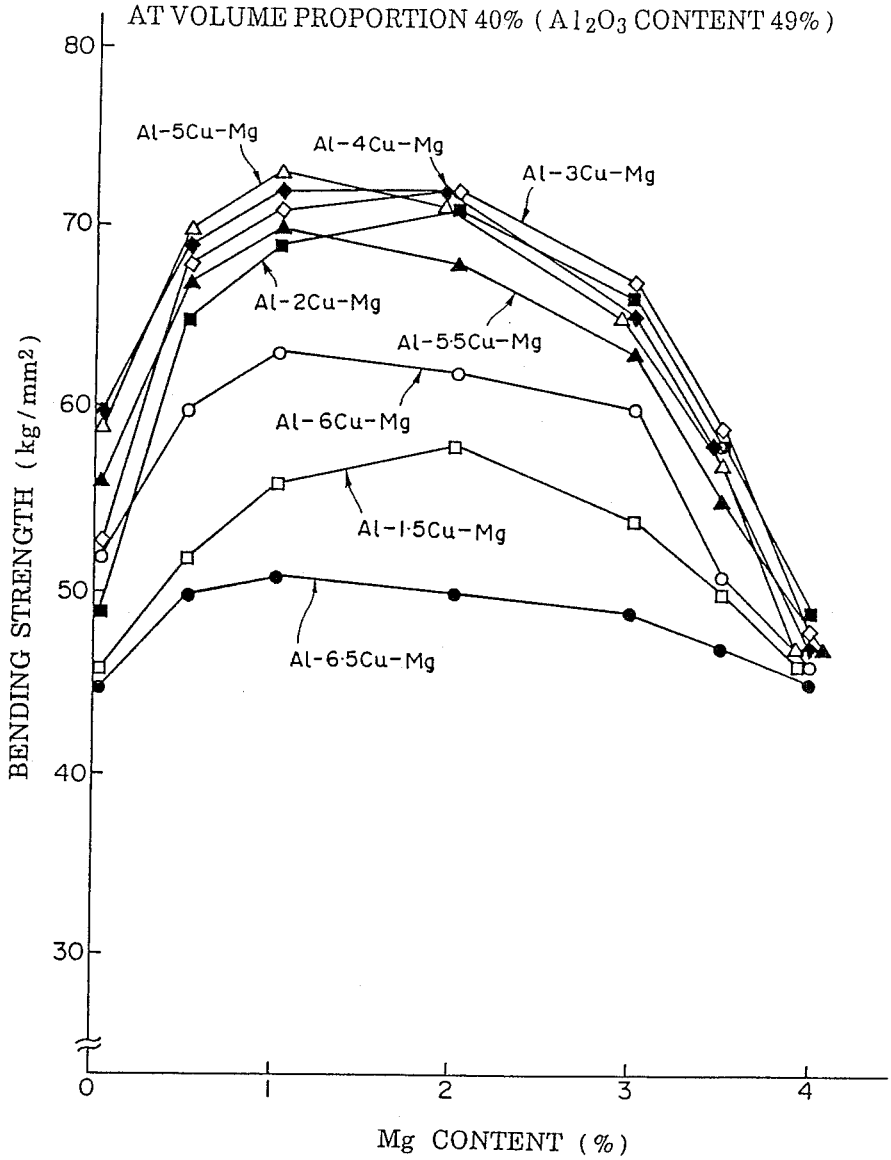
FIG. 13 is a set of graphs, similar to FIGS. 1, 2, and 3 for the first through the third groups of the first set of preferred embodiments respectively, to FIGS. 4 and 5 for the first and second groups of the second preferred embodiment set, to FIGS. 6 and 7 for the third preferred embodiment set, to FIGS. 8 and 9 for the fourth preferred embodiment set, and to FIGS. 10 through 12 for the fifth preferred embodiment set, respectively, in which again magnesium content in percent is shown along the horizontal axis and bending strength in kg/mm$^2$ is shown along the vertical axis, derived from data relating to bending strengh tests for a first group of the sixth set of preferred embodiments of the material of the present invention (in which the volume proportion of reinforcing amorphous alumina-silica short fiber material, again containing approximately 49% $Al_2O_3$, was now approximately 40%), each said graph similarly showing the relation between magnesium content and bending strength of certain composite material test pieces for a particular fixed percentage content of copper in the matrix metal of the composite material.
Figure 14:
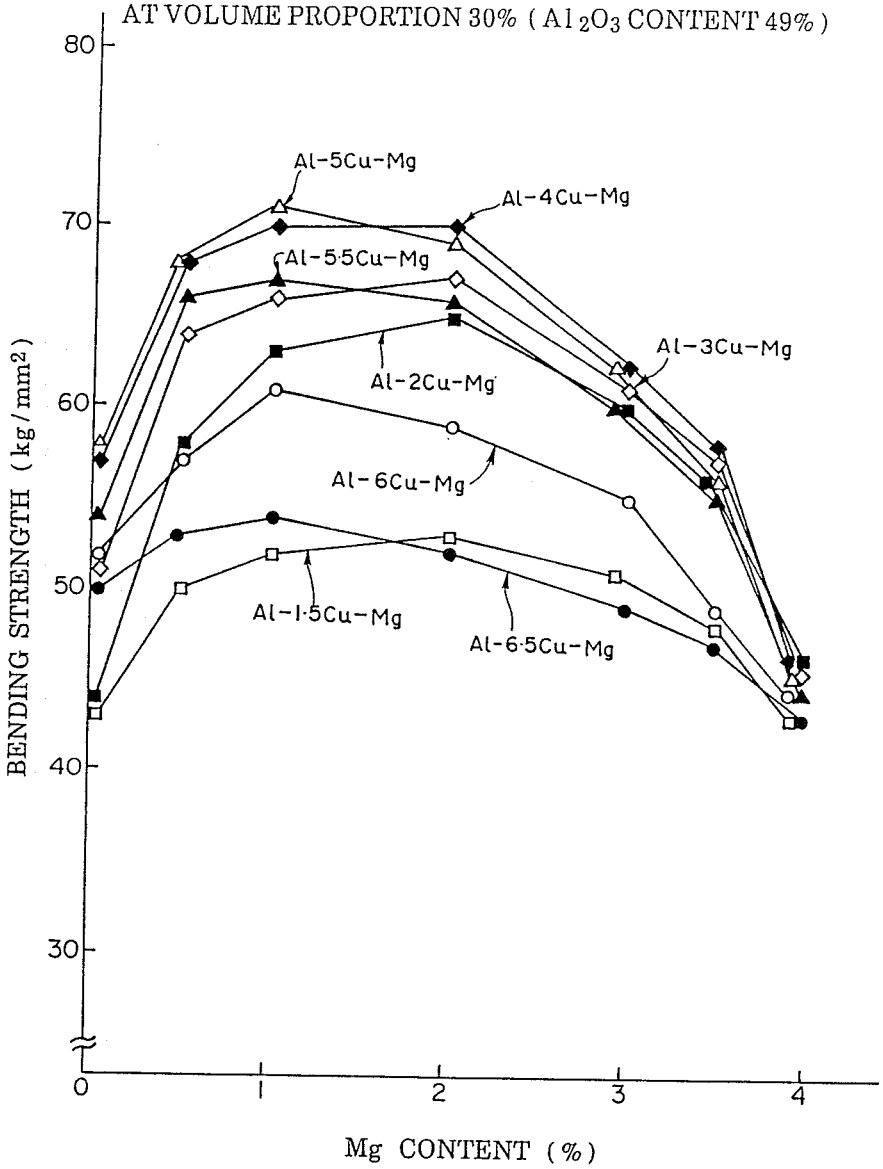
FIG. 14 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, and to FIG. 13 for the first group of this sixth preferred embodiment set, respectively, in which again magnesium content in percent is shown along the horizontal axis and bending strength in kg/mm$^2$ is shown along the vertical axis, derived from data relating to bending strength tests for a second group of said sixth set of preferred embodiments of the material of the present invention (in which the volume proportion of reinforcing amorphous alumina-silica short fiber material, again containing approximately 49% $Al_2O_3$, was now approximately 30%), each said graph similarly showing the relation between magnesium content and bending strength of certain composite material test pieces for a particular fixed percentage content of copper in the matrix metal of the composite material.

The results of these bending strength tests were as shown in Table 6 and as summarized in the graphs of FIGS. 13 and 14, which relate to the cases of fiber volume proportion being equal to 40% and 30% respectively; thus, FIGS. 13 and 14 correspond to FIGS. 1 through 3 relating to the first set of preferred embodiments, to FIGS. 4 and 5 relating to the second set of preferred embodiments, to FIGS. 6 and 7 relating to the third preferred embodiment set, to FIGS. 8 and 9 relating to the fourth preferred embodiment set, and to FIGS. 10 through 12 relating to the fifth preferred embodiment set. In the graphs of FIGS. 13 and 14, there are again shown relations between magnesium content and the bending strength (in $kg/mm^2$) of certain of the composite material test pieces, for percentage contents of copper fixed along the various lines thereof.

From Table 6 and from FIGS. 13 and 14 it will be understood that for all of these composite materials, when as in these cases the volume proportion of the reinforcing amorphous alumina-silica short fiber material of these bending strength composite material test sample pieces was approximately 40% or was approximately 30%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximattely 0% or at the higher value of approximately 4%, the bending strength of the composite material test sample pieces had a relatively low value. Further, it will be seen that, when the magnesium content was in the range of from approximately 1% to approximately 2%, the bending strength of the composite material test sample pieces attained a substantially maximum value; and, when the magnesium content increased above or decreased below this range, then the bending strength of the composite material test sample pieces decreased gradually; while, when the magnesium content was either in the low range below approximately 0.5% or was in the high range above approximately 3.5%, the bending strength of the composite material test sample pieces reduced relatively suddenly with decrease or increase respectively of the magnesium content; and, when the magnesium content was approximately 4%, the bending strength of the composite material test sample pieces had substantially the same value as, or at least not a greater value than, when the magnesium content was approximately 0%.

From the results of these bending strength tests it will be seen that, in order to provide for a good and appropriate bending strength for a composite material having as reinforcing fiber material such amorphous alumina-silica short fibers with $Al_2O_3$ content approximately 49% in volume proportions of approximately 40% and approximately 30% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6% and particularly should be in the range of from approximately 2% to approximately 5.5%, while the magnesium content of said Al-Cu-Mg type aluminum alloy matrix metal should be in the range of from approximately 0.5% to approximately 3.5% and particularly should be in the range of from approximately 0.5% to approximately 3%.

THE SEVENTH SET OF PREFERRED EMBODIMENTS

Variation of fiber volume proportion

Since from the above described first through sixth sets of preferred embodiments the fact has been amply established and demonstrated, both in the case that the reinforcing alumina-silica short fibers are crystalline and in the case that said reinforcing alumina-silica short fibers are amorphous, that it is preferable for the copper content of the Al-Cu-Mg type aluminum alloy matrix metal to be in the range of from approximately 2% to approximately 6%, and that it is preferable for the magnesium content of said Al-Cu-Mg type aluminum alloy matrix metal to be in the range of from approximately 0.5% to approximately 3.5%, it next was deemed germane to provide a set of tests to establish what fiber volume proportion of the reinforcing alumina-silica type short fibers is most appropriate. This was done, in the seventh set of preferred embodiments now to be described, by varying said fiber volume proportion of the reinforcing alumina-silica type short fiber material while using an Al-Cu-Mg type aluminum alloy matrix metal which had the proportions of copper and magnesium which had as described above been established as being quite good, i.e. which had copper content of approximately 4% and also magnesium content of approximately 1% and remainder substantially aluminum. In other words, an appropriate number (in fact six in each case) of performs made of the crystalline type alumina-silica short fiber material used in the third set of preferred embodiments detailed above, and of the amorphous type alumina-silica short fiber material used in the fifth set of preferred embodiments detailed above, hereinafter denoted respectively as B1 through B6 and C1 through C6, were made by subjecting quantities of the relevant short fiber material to compression forming without using any binder in the same manner as in the above described six sets of preferred embodiments, the six ones in each said set of said alumina-silica type short fiber material performs having fiber volume proportions of approximately 5%, 10%, 20%, 30%, 40%, and 50%. These preforms had substantially the same dimensions and the same type of two dimensional random fiber orientation as the preforms of the six above described sets of preferred embodiments. And, substantially as before, each of these alumina-silica type short fiber material preforms was subjected to high pressure casting together with an appropriate quantity of the aluminum alloy matrix metal described above, utilizing operational parameters substantially as before. In each case, the solidified aluminum alloy mass with the preform included therein was then removed from the casting mold, and as before the peripheral portion of said solidified aluminum alloy mass was machined away along with the stainless steel case which was utilized, leaving only a sample piece of composite material which had alumina-silica type short fiber material as reinforcing material in the appropriate fiber volume proportion and the described aluminum alloy as matrix metal. And post processing and artificial aging processing steps were performed on the composite material samples, similarly to what was done before. From each of the composite material sample pieces manufactured as described above, to which heat treatment had been applied, there was then cut a bending strength test piece, each of dimensions substantially as in the case of the above described sets of preferred embodiments, and for each of these composite material bending strength test pieces a bending strength test was carried out, again substantially as before. Also, for reference purposes, a similar test sample was cut from a piece of a cast aluminum alloy material which included no reinforcing fiber material at all, said aluminum alloy material having copper content of about 4%, magnesium content of about 1%, and balance substantially aluminum, and having been subjected to post processing and artificial aging processing steps, similarly to what was done before. And for this comparison sample, referred to as A0, a bending strength test was carried out, again substantially as before. The results of these bending strength tests were as shown in the two graphs of FIG. 15, respectively for the crystalline type alumina-silica short reinforcing fiber material samples B1 through B6 and the amorphous alumina-silica type reinforcing fiber material samples C1 through C6; the zero point of each said graph corresponds to the test sample A0 with no reinforcing alumina-silica fiber material at all. Each of these graphs shows the relation between the volume proportion of the alumina-silica type short reinforcing fibers and the bending strength (in $kg/mm^2$) of the composite material test pieces, for the appropriate type of reinforcing fibers.

Figure 15:
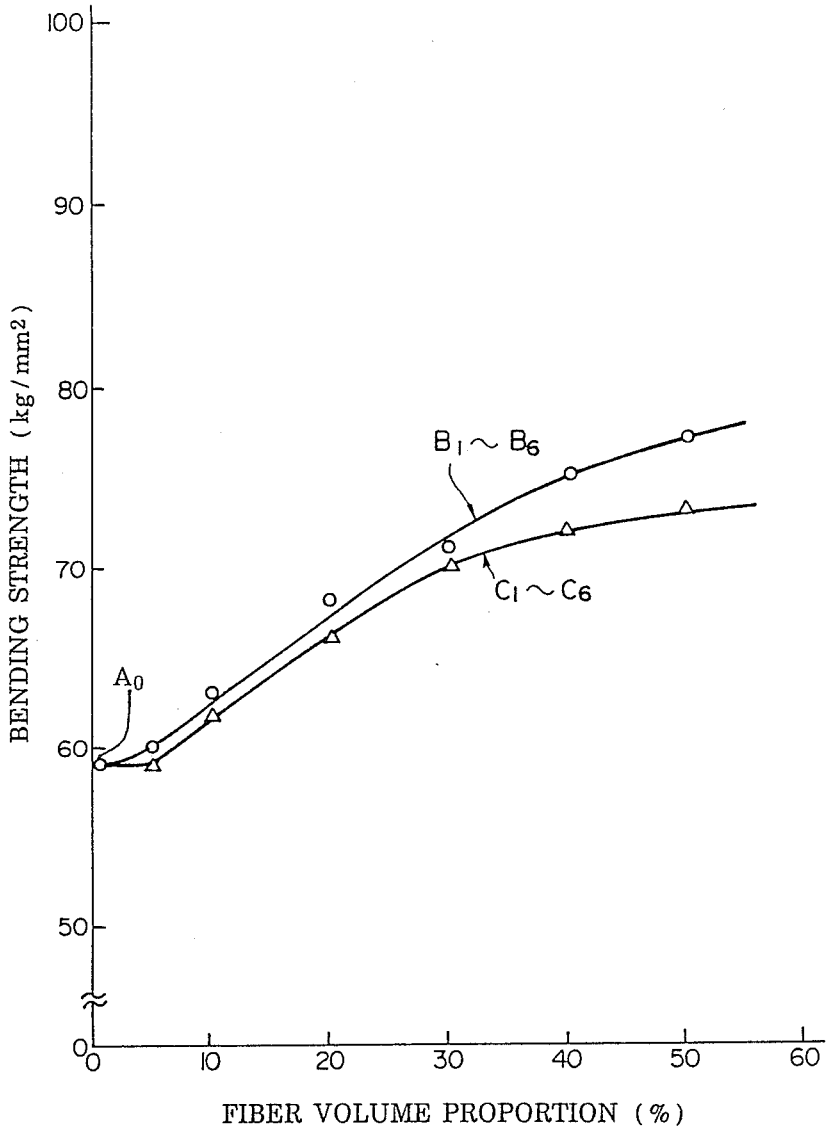
FIG. 15 is a set of two graphs relating to two sets of tests in which the fiber volume proportions of reinforcing alumina-silica short fiber materials of two different types were varied, in which said reinforcing fiber proportion in percent is shown along the horizontal axis and bending strength in kg/mm$^2$ is shown along the vertical axis, derived from data relating to bending strength tests for certain ones of a seventh set of preferred embodiments of the material of the present invention, said graphs showing the relation between volume proportion of the reinforcing alumina-silica short fiber material and bending strength of certain test pieces of the composite material.

From FIG. 15, it will be understood that, substantially irrespective of the type of reinforcing alumina-silica short fiber material utilized: when the volume proportion of the alumina-silica type short reinforcing fibers was in the range of up to and including approximately 5% the bending strength of the composite material hardly increased along with an increase in the fiber volume proportion, and its value was close to the bending strength of the aluminum alloy matrix metal by itself with no reinforcing fiber material admixture therewith; when the volume proportion of the alumina-silica type short reinforcing fibers was in the range of 5% to 30% the bending strength of the composite material increased substantially linearly with increase in the fiber volume proportion; and, when the volume proportion of the alumina-silica type short reinforcing fibers increased above 40%, and particularly when said volume proportion of said alumina-silica type short reinforcing fibers increased above 50%, the bending strength of the composite material did not increase very much even with further increase in the fiber volume proportion. From these results described above, it is seen that in a composite material having alumina-silica type short fiber reinforcing material and having as matrix metal an Al-Cu-Mg type aluminum alloy, said Al-Cu-Mg type aluminum alloy matrix metal having a copper content in the range of from approximately 1.5% to approximately 6%, a magnesium content in the range of from approximately 0.5% to approximately 2%, and remainder substantially aluminum, irrespective of the actual type of the reinforcing alumina-silica fibers utilized, it is preferable that the fiber volume proportion of said alumina-silica type short fiber reinforcing material should be in the range of from approximately 5% to approximately 50%, and more preferably should be in the range of from approximately 5% to approximately 40%.

THE EIGHTH SET OF PREFERRED EMBODIMENTS

Variation of mullite crystalline proportion

Figure 16:
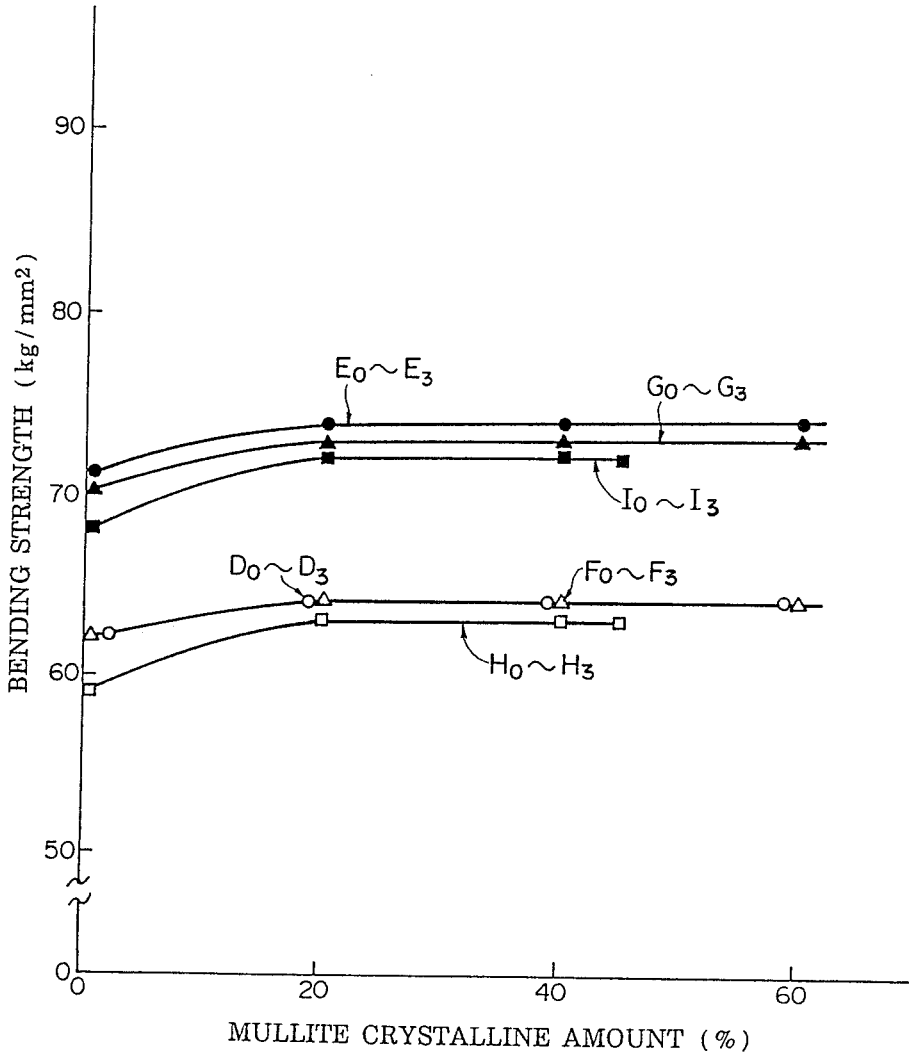
FIG. 16 is a graph relating to the eighth set of preferred embodiments, in which mullite crystalline content in percent is shown along the horizontal axis and bending strength in kg/mm$^2$ is shown along the vertical axis, derived from data relating to bending strength tests for various composite materials having crystalline alumina-silica short fiber material with varying amounts of the mullite crystalline form therein as reinforcing material and an alloy containing approximately 4% of copper, approximately 2% of magnesium, and remainder substantially aluminum as matrix metal, and showing the relation between the mullite crystalline percentage of the reinforcing short fiber material of the composite material test pieces and their bending strengths.

In the particular case that crystalline alumina-silica short fiber material is used as the alumina-silica type short fiber material for reinforcement, in order to assess what value of the mullite crystalline amount of the crystalline alumina-silica short fiber material yields a high value for the bending strength of the composite material, a number of samples of crystalline alumina-silica type short fiber material were formed in a per se known way, a first set of four thereof having proportions of $Al_2O_3$ being approximately 65% and balance $SiO_2$ and including samples with mullite crystalline amounts of 0%, 20%, 40%, and 60%, a second set of four thereof having proportions of $Al_2O_3$ being approximately 49% and balance $SiO_2$ and likewise including samples with mullite crystalline amounts of 0%, 20%, 40%, and 60%, and a third set of four thereof having proportions of $Al_2O_3$ being approximately 35% and balance $SiO_2$ and including samples with mullite crystalline amounts of 0%, 20%, 40%, and, in this case, only 45%. Then, from each of these twelve crystalline alumina-silica type short fiber material samples, two preforms, one with a fiber volume proportion of approximately 10% and one with a fiber volume proportion of approximately 30%, were formed in the same manner and under the same conditions as in the seven sets of preferred embodiments detailed above. Herein, the 10% fiber volume proportion preforms formed from the four crystalline alumina-silica type short fiber material samples included in the first set thereof having approximately 65% proportion of $Al_2O_3$ and mullite crystalline amounts of 0%, 20%, 40%, and 60% will be designated as D0 through D3; the 30% fiber volume proportion preforms formed from said four crystalline alumina-silica type short fiber material samples included in said first set thereof having approximately 65% proportion of $Al_2O_3$ and mullite crystalline amounts of 0%, 20%, 40%, and 60% will be designated as E0 through E3; the 10% fiber volume proportion preforms formed from the four crystalline alumina-silica type short fiber material samples included in the second set thereof having approximately 49% proportion of $Al_2O_3$ and mullite crystalline amounts of 0%, 20%, 40%, and 60% will be designated as F0 through F3; the 30% fiber volume proportion preforms formed from said four crystalline alumina-silica type short fiber material samples included in said second set thereof having approximately 49% proportion of $Al_2O_3$ and mullite crystalline amounts of 0%, 20%, 40%, and 60% will be designated as G0 through G3; the 10% fiber volume proportion preforms formed from the four crystalline alumina-silica type short fiber material samples included in the third set thereof having approximately 35% proportion of $Al_2O_3$ and mullite crystalline amounts of 0%, 20%, 40%, and 45% will be designated as H0 through H3; and the 30% fiber volume proportion preforms formed from said four crystalline alumina-silica type short fiber material samples included in said third set thereof having approximately 35% proportion of $Al_2O_3$ and mullite crystalline amounts of 0%, 20%, 40%, and 45% will be designated as I0 through I3. Then, using as matrix metal each such preform as a reinforcing fiber mass and an aluminum alloy of which the copper content was approximately 4%, the magnesium content was approximately 2%, and the remainder was substantially aluminum, various composite material sample pieces were manufactured in the same manner and under the same conditions as in the seven sets of preferred embodiments detailed above, the various resulting composite material sample pieces were subjected to liquidizing processing and artificial aging processing in the same manner and under the same conditions as in the various sets of preferred embodiments detailed above, from each composite material sample piece a bending test piece was cut in the same manner and under the same conditions as in the various sets of preferred embodiments detailed above, and for each bending test piece a bending test was carried out, as before. The results of these bending tests are shown in FIG. 16. It should be noted that in FIG. 16 the mullite crystalline amount (in percent) of the crystalline alumina-silica short fiber material which was the reinforcing fiber material is shown along the horizontal axis, while the bending strength of the composite material test pieces is shown along the vertical axis.

From FIG. 16 it will be seen that, in the case that such an aluminum alloy as detailed above is utilized as the matrix metal, even when the mullite crystalline amount included in the reinforcing fibers is relatively low, the bending strength of the resulting composite material has a relatively high value, and, whatever be the variation in the mullite crystalline amount included in the reinforcing fibers, the variation in the bending strength of the resulting composite material is relatively low. Therefore it will be seen that, in the case that crystalline alumina-silica short fiber material is used as the alumina-silica short fiber material for reinforcing the material of the present invention, it is acceptable for the value of the mullite crystalline amount therein to be more or less any value.

THE SECOND GROUPING OF PREFERRED EMBODIMENT SETS

For the second grouping of sets of preferred embodiments of the present invention, reinforcing fibers similar to those utilized in the preferred embodiment sets of the first grouping described above, but including substantially higher proportions of $Al_2O_3$, were chosen.

THE NINTH SET OF PREFERRED EMBODIMENTS

For the ninth set of preferred embodiments of the present invention, the present inventors manufactured by using the high pressure casting method samples of various composite materials, utilizing as matrix metal Al-Cu-Mg type aluminum alloys of various compositions, and utilizing as reinforcing material crystalline alumina-silica short fiber material, which now in this case had composition about 72% $Al_2O_3$ and remainder substantially $SiO_2$, and had a content of the mullite crystalline form of approximately 60%, and which again had average fiber length about 1 mm and average fiber diameter about 3 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (now a hundred and fifty six) of crystalline alumina-silica short type fiber material preforms were as before made by the method disclosed above with respect to the previously described sets of preferred embodiments, one set of said crystalline alumina-silica short type fiber material preforms now having a fiber volume proportion of approximately 20%, another set of said crystalline alumina-silica short type fiber material preforms having a fiber volume proportion of approximately 10%, and another set of said crystalline alumina-silica short type fiber material preforms having a fiber volume proportion of approximately 5%. These preforms had substantially the same dimensions as the preforms of the previously described sets of preferred embodiments.

Next, substantially as before, each of these crystalline alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had crystalline alumina-silica short type fiber material as reinforcing material and the appropriate one of the aluminum alloys A1 through A56 as matrix metal. The volume proportion of crystalline alumina-silica type fibers in each of the first set of the resulting composite material sample pieces was thus now approximately 20%, in each of the second set of the resulting composite material sample pieces was thus now approximately 10%, and in each of the third set of the resulting composite material sample pieces was thus now approximately 5%. And post processing steps were preformed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 20:
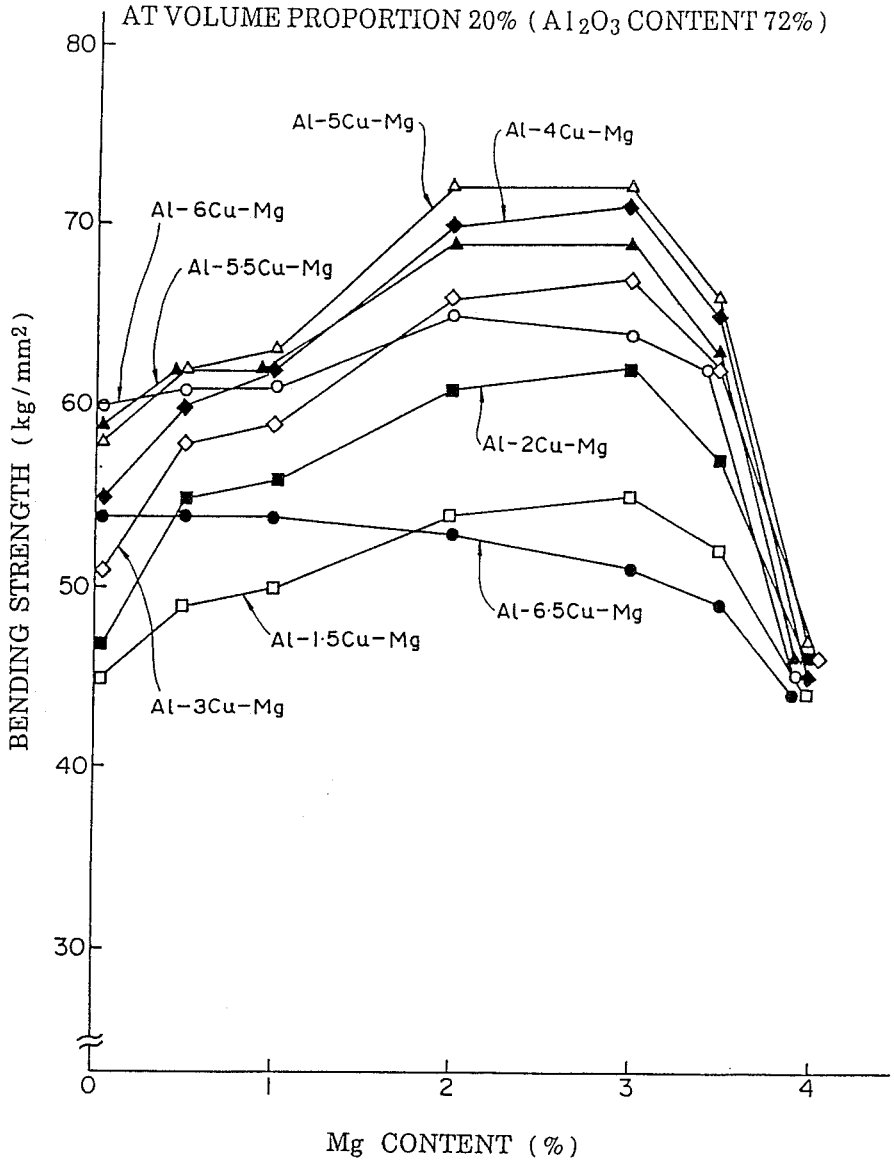
FIG. 20 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, and to FIGS. 13 and 14 for the sixth preferred embodiment set, in which again magnesium content in percent is shown along the horizontal axis and bending strength in kg/mm$^2$ is shown along the vertical axis, derived from data relating to bending strength tests for a first group of the ninth set of preferred embodiments of the material of the present invention (in which the volume proportion of reinforcing crystalline alumina-silica short fiber material, now containing approximately 72% $Al_2O_3$, was now approximately 20%), each said graph similarly showing the relation between magnesium content and bending strength of certain composite material test pieces for a particular fixed percentage content of copper in the matrix metal of the composite material.
Figure 21:
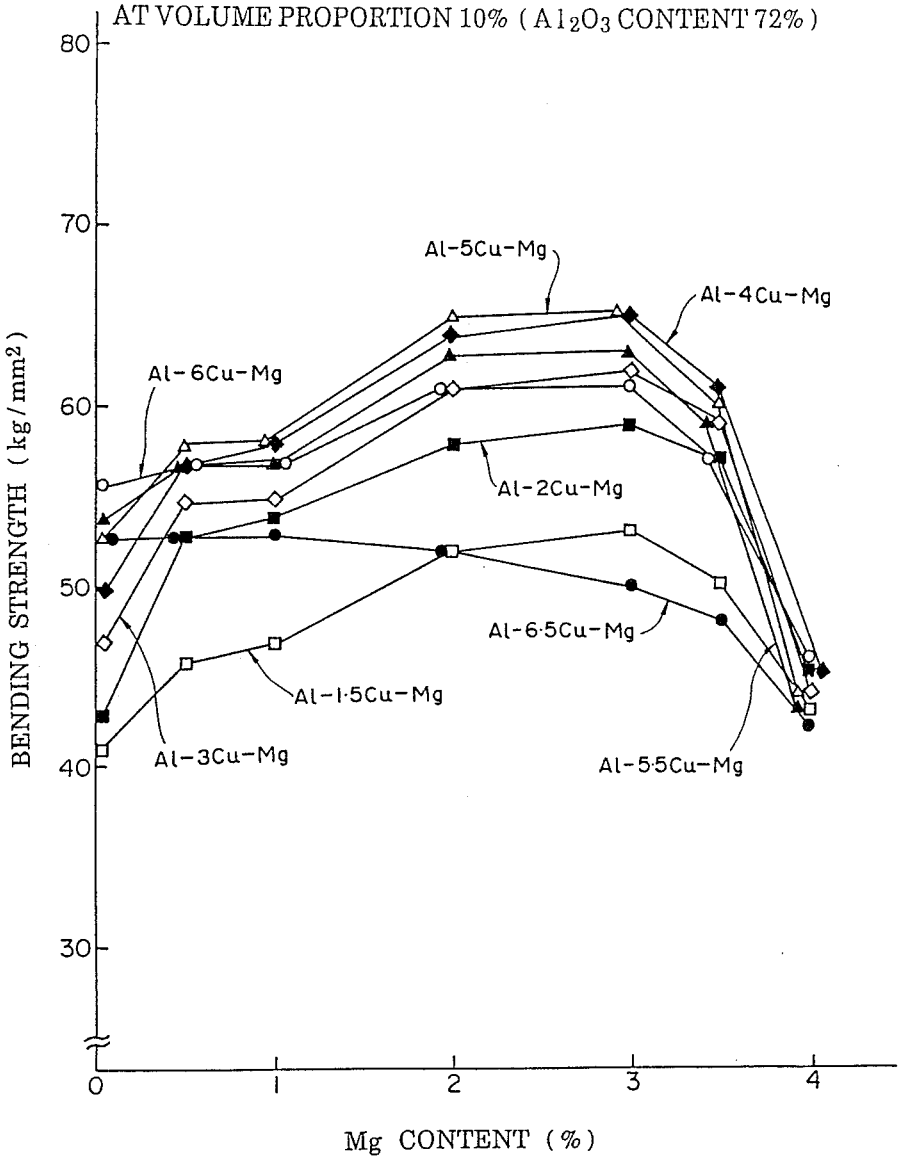
FIG. 21 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, and to FIG. 20 for the first group of this ninth preferred embodiment set, in which again magnesium content in percent is shown along the horizontal axis and bending strength in kg/mm$^2$ is shown along the vertical axis, derived from data relating to bending strength tests for a second group of said ninth set of preferred embodiments of the material of the present invention (in which the volume proportion of reinforcing crystalline alumina-silica short fiber material, again now containing approximately 72% $Al_2O_3$, was now approximately 10%), each said graph similarly showing the relation between magnesium content and bending strength of certain composite material test pieces for a particular fixed percentage content of copper in the matrix metal of the composite material.
Figure 22:
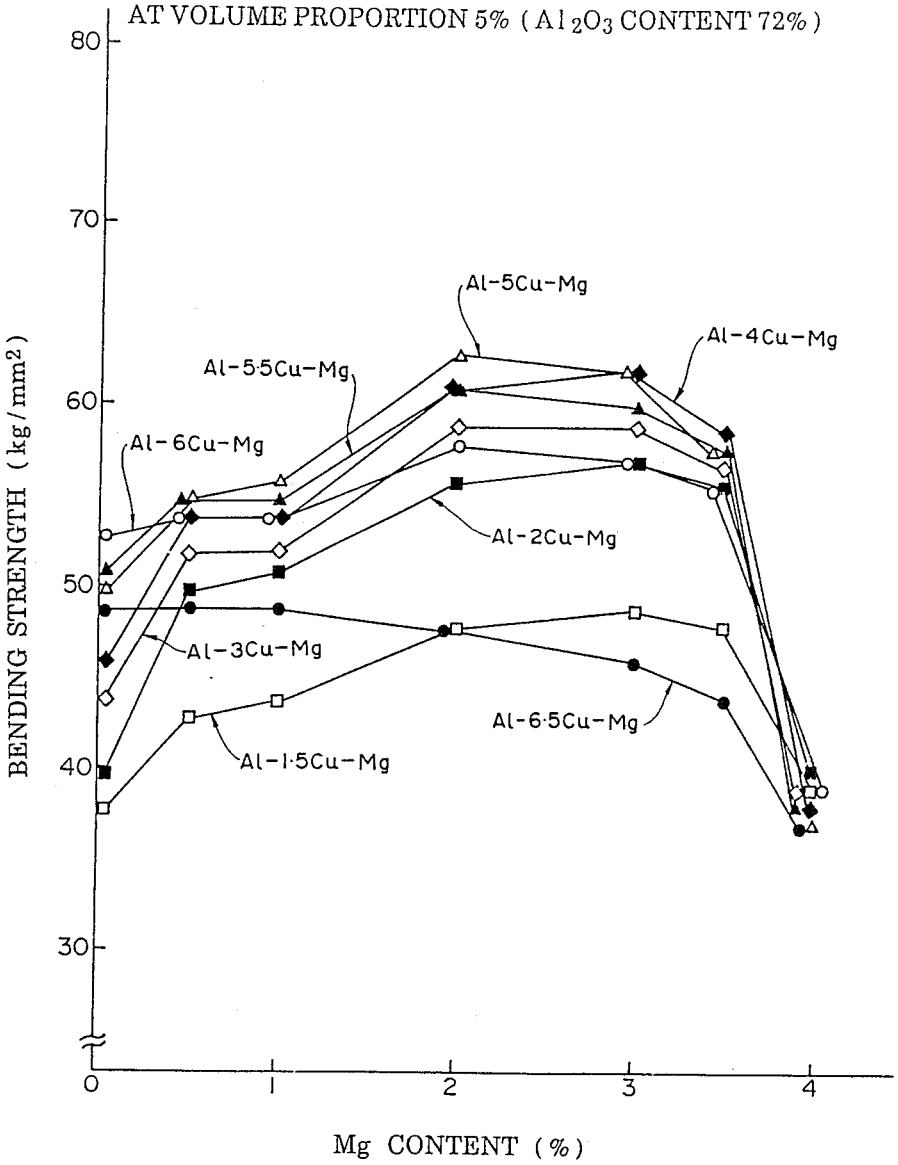
FIG. 22 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, and to FIGS. 20 and 21 for the first and the second group of this ninth preferred embodiment set, in which again magnesium content in percent is shown along the horizontal axis and bending strength in $kg/mm^2$ is shown along the vertical axis, derived from data relating to bending strength tests for a third group of said ninth set of preferred embodiments of the material of the present invention (in which the volume proportion of reinforcing crystalline alumina-silica short fiber material, again now containing approximately 72% $Al_2O_3$, was now approximately 5%), each said graph similarly showing the relation between magnesium content and bending strength of certain composite material test pieces for a particular fixed percentage content of copper in the matrix metal of the composite material.

The results of these bending strength tests were as shown in the first three column of Table 6 and as summarized in the graphs of FIGS. 20 through 22, which relate to the cases of fiber volume proportion being equal to 20%, 10%, and 5% respectively; thus, FIGS. 20 through 22 correspond to FIGS. 1 through 3 relating to the first set of preferred embodiments, to FIGS. 4 and 5 relating to the second set of preferred embodiments, to FIGS. 6 and 7 relating to the third preferred embodiment set, to FIGS. 8 and 9 relating to the fourth preferred embodiment set, to FIGS. 10 through 12 relating to the fifth preferred embodiment set, and to FIGS. 13 and 14 relating to te sixth preferred embodiment set. In the graphs of FIGS. 20 through 22, there are again shown relations between magnesium content and the bending strength (in $kg/mm^2$) of certain of the composite material test pieces, for percentage contents of copper fixed along the various lines thereof.

From Table 6 and from FIGS. 20 through 22 it will be understood that for all of these composite materials, when as in these cases the volume proportion of the reinforcing crystalline alumina-silica short fiber material of these bending strength composite material test sample pieces was approximately 20%, was approximately 10%, or was approximately 5%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, when the magnesium content was in the high range above approximately 3.5%, the bending strength of the composite material test sample pieces reduced relatively suddenly with increase of the magnesium content; and, when the magnesium content was approximately 4%, the bending strength of the composite material test sample pieces had substantially the same value as when the magnesium content was approximately 0%.

From the results of these bending strength tests it will be seen that, in order to provide for a good and appropriate bending strength for a composite material having as reinforcing fiber material such crystalline alumina-silica short fibers with $Al_2O_3$ content approximately 72% in volume proportions of approximately 20%, approximately 10%, and approximately 5% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6%, while the magnesium content of said Al-Cu-Mg type aluminum alloy matrix metal should be in the range of from approximately 0.5% to approximately 3.5% and particularly should be in the range of from approximately 1.5% to approximately 3.5%.

THE TENTH SET OF PREFERRED EMBODIMENTS

For the tenth set of preferred embodiments of the present invention, the present inventors manufactured by using the high pressure casting method samples of various composite materials, utilizing as matrix metal Al-Cu-Mg type aluminum alloys of various compositions, and utilizing as reinforcing material crystalline alumina-silica short fiber material, which again in this case had composition about 72% $Al_2O_3$ and remainder substantially $SiO_2$, and had a content of the mullite crystalline form of approximately 60%, and which again had average fiber length about 1 mm and average fiber diameter about 3 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (now a hundred and eight) of crystalline alumina-silica short type fiber material preforms were as before made by the method disclosed above with respect to the previously described sets of preferred embodiments, one set of said crystalline alumina-silica short type fiber material preforms now having a fiber volume proportion of approximately 40%, and another set of said crystalline alumina-silica short type fiber material preforms having a fiber volume proportion of approximately 30%. These preforms again had substantially the same dimensions as the preforms of the previously described sets of preferred embodiments.

Next, substantially as before, each of these crystalline alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had crystalline alumina-silica short type fiber material as reinforcing material and the appropriate one of the aluminum alloys A1 through A56 as matrix metal. The volume proportion of crystalline alumina-silica short type fibers in each of the first set of the resulting composite material sample pieces was thus now approximately 40%, and in each of the second set of the resulting composite material sample pieces was thus now approximately 30%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 23:
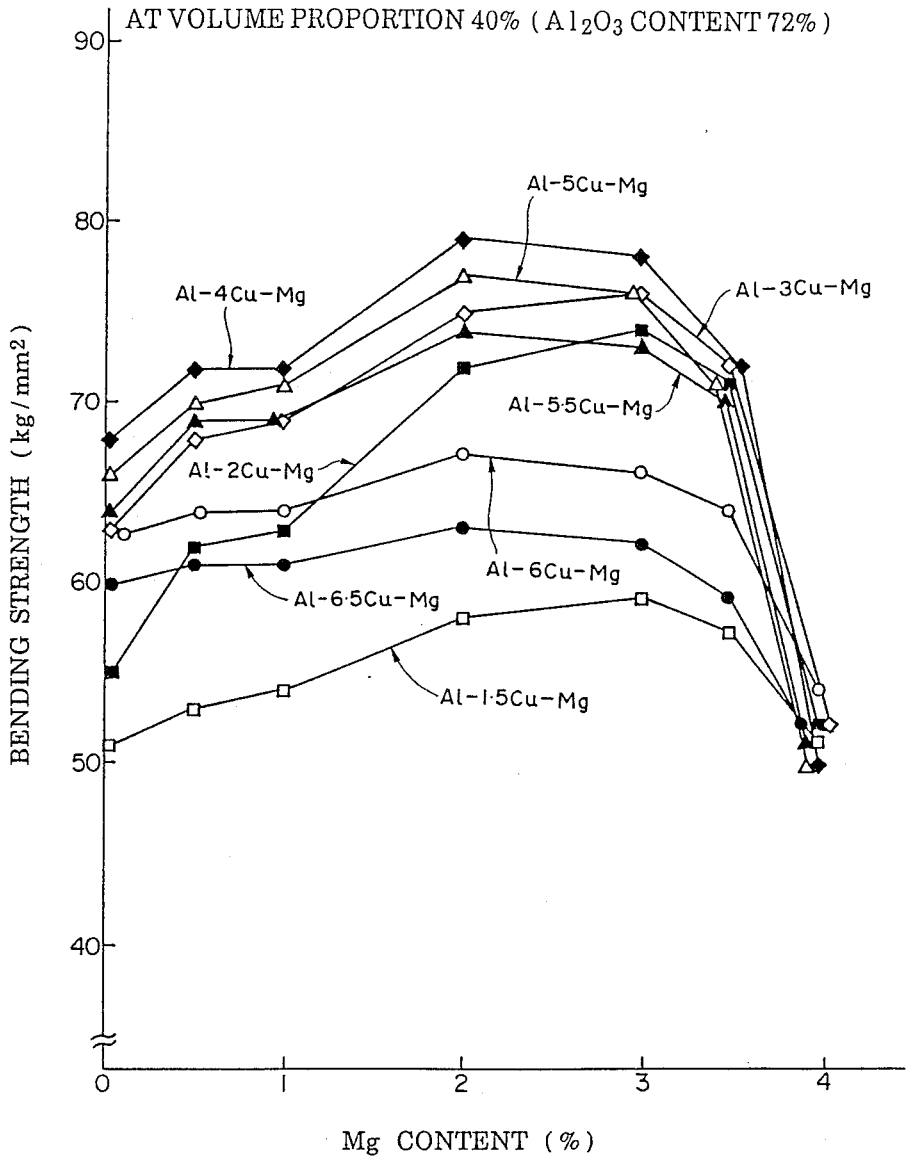
FIG. 23 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, and to FIGS. 20 through 22 for the ninth preferred embodiment set, in which again magnesium content in percent is shown along the horizontal axis and bending strength in $kg/mm^2$ is shown along the vertical axis, derived from data relating to bending strength tests for a first group of a tenth set of preferred embodiments of the material of the present invention (in which the volume proportion of reinforcing crystalline alumina-silica short fiber material, again now containing approximately 72% $Al_2O_3$, was now approximately 40%), each said graph similarly showing the relation between magnesium content and bending strength of certain composite material test pieces for a particular fixed percentage content of copper in the matrix metal of the composite material.
Figure 24:
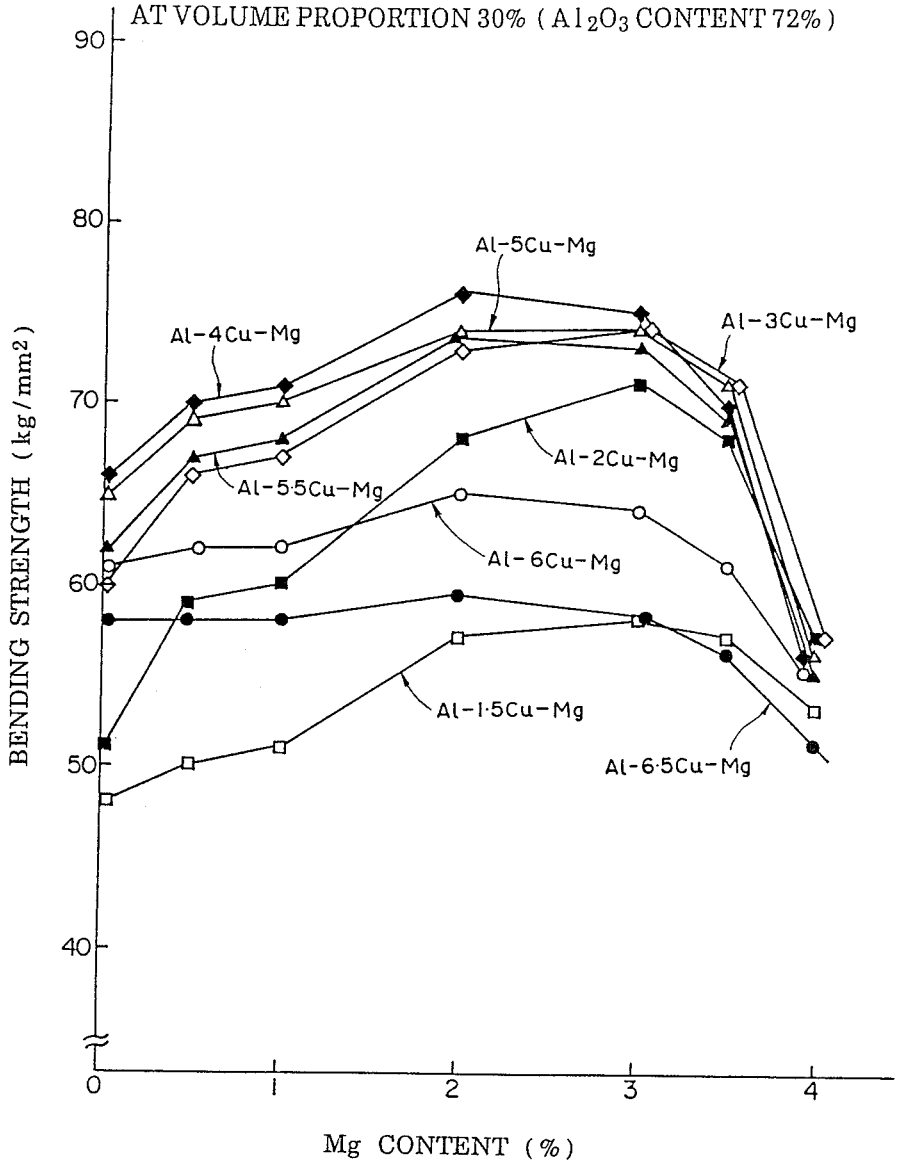
FIG. 24 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, to FIGS. 20 through 22 for the ninth preferred embodiment set, and to FIG. 23 for the first group of this tenth preferred embodiment set, in which again magnesium content in percent is shown along the horizontal axis and bending strength in $kg/mm^2$ is shown along the vertical axis, derived from data relating to bending strength tests for a second group of said tenth set of preferred embodiments of the material of the present invention (in which the volume proportion of reinforcing crystalline alumina-silica short fiber material, again now containing approximately 72% $Al_2O_3$, was now approximately 30%), each said graph similarly showing the relation between magnesium content and bending strength of certain composite material test pieces for a particular fixed percentage content of copper in the matrix metal of the composite material.

The results of these bending strength tests were as shown in the last two columns of Table 6 and as summarized in the graphs of FIGS. 23 and 24, which relate to the cases of fiber volume proportion being equal to 40% and 30% respectively; thus, FIGS. 23 and 24 correspond to FIGS. 1 through 3 relating to the first set of preferred embodiments, to FIGS. 4 and 5 relating to the second set of preferred embodiments, to FIGS. 6 and 7 relating to the third preferred embodiment set, to FIGS. 8 and 9 relating to the fourth preferred embodiment set, to FIGS. 10 through 12 relating to the fifth preferred embodiment set, to FIGS. 13 and 14 relating to the sixth preferred embodiment set, and to FIGS. 20 through 22 relating to the ninth preferred embodiment set. In the graphs of FIGS. 23 and 24, there are again shown relations between magnesium content and the bending strength (in kg/mm$^2$) of certain of the composite material test pieces, for percentage contents of copper fixed along the various lines thereof.

From Table 6 and from FIGS. 23 and 24 it will be understood that for all of these composite materials, when as in these cases the volume proportion of the reinforcing crystalline alumina-silica short fiber material of these bending strength composite material test sample pieces was approximately 40% or was approximately 30%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, when the magnesium content was in the high range above approximately 3.5%, the bending strength of the composite material test sample pieces reduced relatively suddenly with increase of the magnesium content; and, when the magnesium content was approximately 4%, the bending strength of the composite material test sample pieces had substantially the same value as when the magnesium content was approximately 0%.

From the results of these bending strength tests it will be seen that, in order to provide for a good and appropriate bending strength for a composite material having as reinforcing fiber material such crystalline alumina-silica short fibers with $Al_2O_3$ content approximately 72% in volume proportions of approximately 40% and approximately 30% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6% and particularly should be in the range of from approximately 2% to approximately 5.5%, while the magnesium content of said Al-Cu-Mg type aluminum alloy matrix metal should be in the range of from approximately 0.5% to approximately 3.5% and particularly should be in the range of from approximately 1.5% to approximately 3.5%.

THE ELEVENTH SET OF PREFERRED EMBODIMENTS

For the eleventh set of preferred embodiments of the present invention, the present inventors manufactured by using the high pressure casting method samples of various composite materials, utilizing as matrix metal Al-Cu-Mg type aluminum alloys of various compositions, and utilizing as reinforcing material, now, amorphous alumina-silica short fiber material, which again in this case had composition about 72% $Al_2O_3$ and remainder substantially $SiO_2$, and which now had average fiber length about 2 mm while still having average fiber diameter about 3 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (now fifty six) of amorphous alumina-silica short type fiber material preforms were as before made by the method disclosed above with respect to the peviously described sets of preferred embodiments, said set of said amorphous alumina-silica short type fiber material preforms now having a fiber volume proportion of approximately 10%. These preforms again had substantially the same dimensions as the preforms of the previously described sets of preferred embodiments.

Next, substantially as before, each of these amorphous alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had amorphous alumina-silica short type fiber material as reinforcing material and the appropriate one of the aluminum alloys A1 through A56 as matrix metal. The volume proportion of amorphous alumina-silica short type fibers in each of this set of the resulting composite material sample pieces was thus now approximately 10%. And post processing steps were preformed on the composite material samples, substantially as before. From each of the composite material sample pieces manufactured as described above, to which heat treatment had been applied, there were cut a bending strength test piece of dimensions and parameters substantailly as in the case of the previously described sets of preferred embodiments, and for each of these composite material bending strength test pieces a bending strength test was carried out, again substantially as before.

Figure 25:
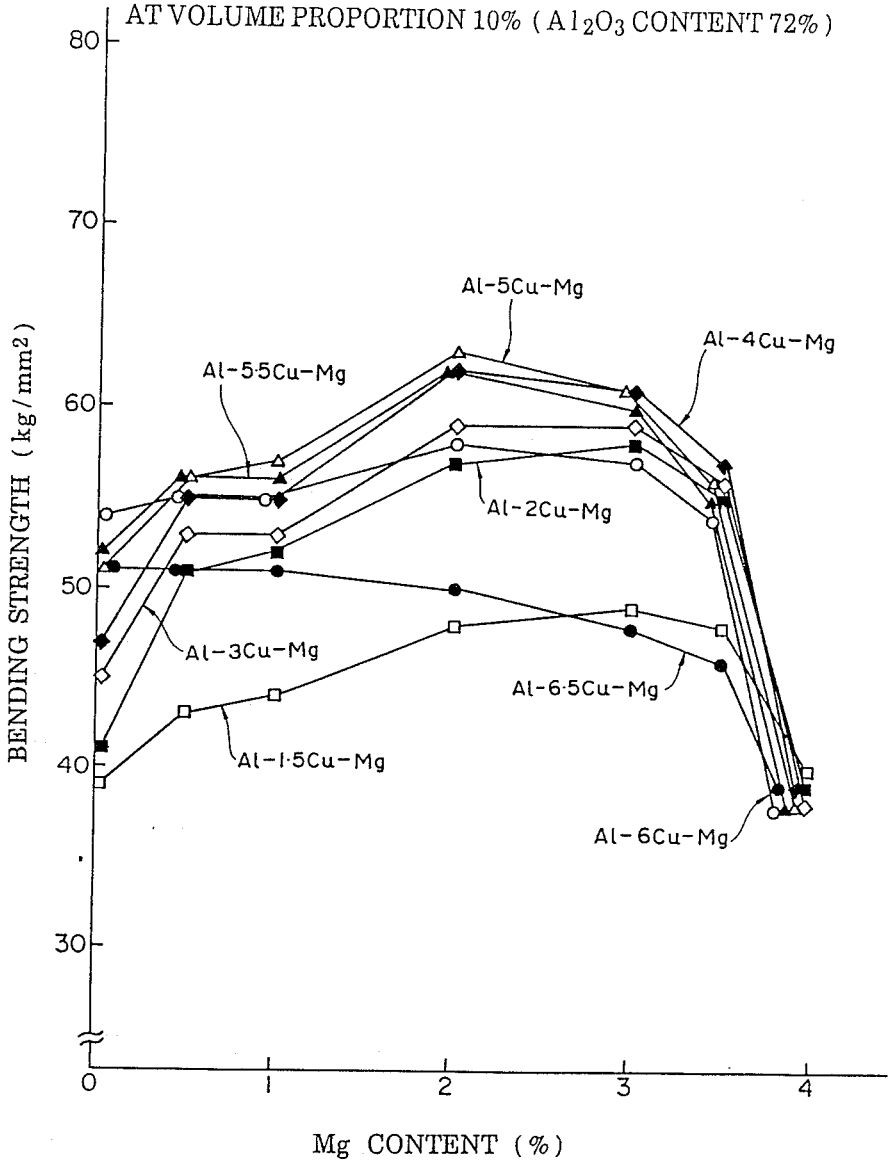
FIG. 25 is a set of graphs, similar to FIGS. 1, 2, and 3 for the three groups of the first set of preferred embodients, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, to FIGS. 20 through 22 for the ninth preferred embodiment set, and to FIGS. 23 and 24 for the tenth preferred embodiment set, in which again magnesium content in percent is shown along the horizontal axis and bending strength in $kg/mm^2$ is shown along the vertical axis, derived from data relating to bending strength tests for an eleventh set of preferred embodiments of the material of the present invention (in which the volume proportion of reinforcing, now amorphous, alumina-silica short fiber material, again now containing approximately 72% $Al_2O_3$ and now of average fiber length approximately 2 mm, was now approximately 10%), each said graph similarly showing the relation between magnesium content and bending strength of certain composite material test pieces for a particular fixed percentage content of copper in the matrix metal of the composite material.

The results of these bending strength tests were as shown in the first column of Table 7 and as summarized in the graphs of FIG. 25; thus, FIG. 25 corresponds to FIGS. 1 through 3 relating to the first set of preferred embodiments, to FIGS. 4 through 5 relating to the second set of preferred embodiments, to FIGS. 6 and 7 relating to the third preferred embodiment set, to FIGS. 8 and 9 relating to the fourth preferred embodiment set, to FIGS. 10 through 12 relating to the fifth preferred embodiment set, to FIGS. 13 and 14 relating to the sixth preferred embodiment set, to FIGS. 20 through 22 relating to the ninth preferred embodiment set, and to FIGS. 23 and 24 relating to the tenth preferred embodiment set. In the graphs of FIG. 25, there are again shown relations between magnesium content and the bending strength (in kg/mm$^2$) of certain of the composite material test pieces, for percentage contents of copper fixed along the various lines thereof.

From Table 7 and from FIG. 25 it will be understood that for all of these composite materials, when as in these cases the volume proportion of the reinforcing amorphous alumina-silica short fiber material of these bending strength composite material test sample pieces was approximately 10%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, particularly, when the magnesium content was in the high range above approximately 3.5%, the bending strength of the composite material test sample pieces reduced relatively suddenly with increase of the magnesium content; and, when the magnesium content was approximately 4%, the bending strength of the composite material test sample pieces had a substantially lower value than when the magnesium content was approximately 0%.

From the results of these bending strength tests it will be seen that, in order to provide for a good and appropriate bending strength for a composite material having as reinforcing fiber material such amorphous alumina-silica short fibers with $Al_2O_3$ content approximately 72% in volume proportion of approximately 10% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6%, while the magnesium content of said Al-Cu-Mg type aluminum alloy matrix metal should be in the range of from approximately 0.5% to approximately 3.5% and particularly should be in the range of from approximately 1.5% to approximately 3.5%.

THE TWELFTH SET OF PREFERRED EMBODIMENTS

For the twelfth set of preferred embodiments of the present invention, the present inventors manufactured by using the high pressure casting method samples of various composite materials, utilizing as matrix metal Al-Cu-Mg type aluminum alloys of various compositions, and again utilizing as reinforcing material amorphous alumina-silica short fiber material, which again in this case had composition about 72% $Al_2O_3$ and remainder substantially $SiO_2$, and which now had average fiber length about 0.8 mm while still having average fiber diameter about 3 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (again fifty six) of amorphous alumina-silica short type fiber material preforms were as before made by the method disclosed above with respect to the previously described sets of preferred embodiments, said set of said amorphous alumina-silica short type fiber material preforms now having a fiber volume proportion of approximately 30%. These preforms again had substantially the same dimensions as the preforms of the previously described sets of preferred embodiments.

Next, substantially as before, each of these amorphous alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had amorphous alumina-silica short type fiber material as reinforcing material and the appropriate one of the aluminum alloys A1 through A56 as matrix metal. The volume proportion of amorphous alumina-silica short type fibers in each of this set of the resulting composite material sample pieces was thus now approximately 30%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 26:
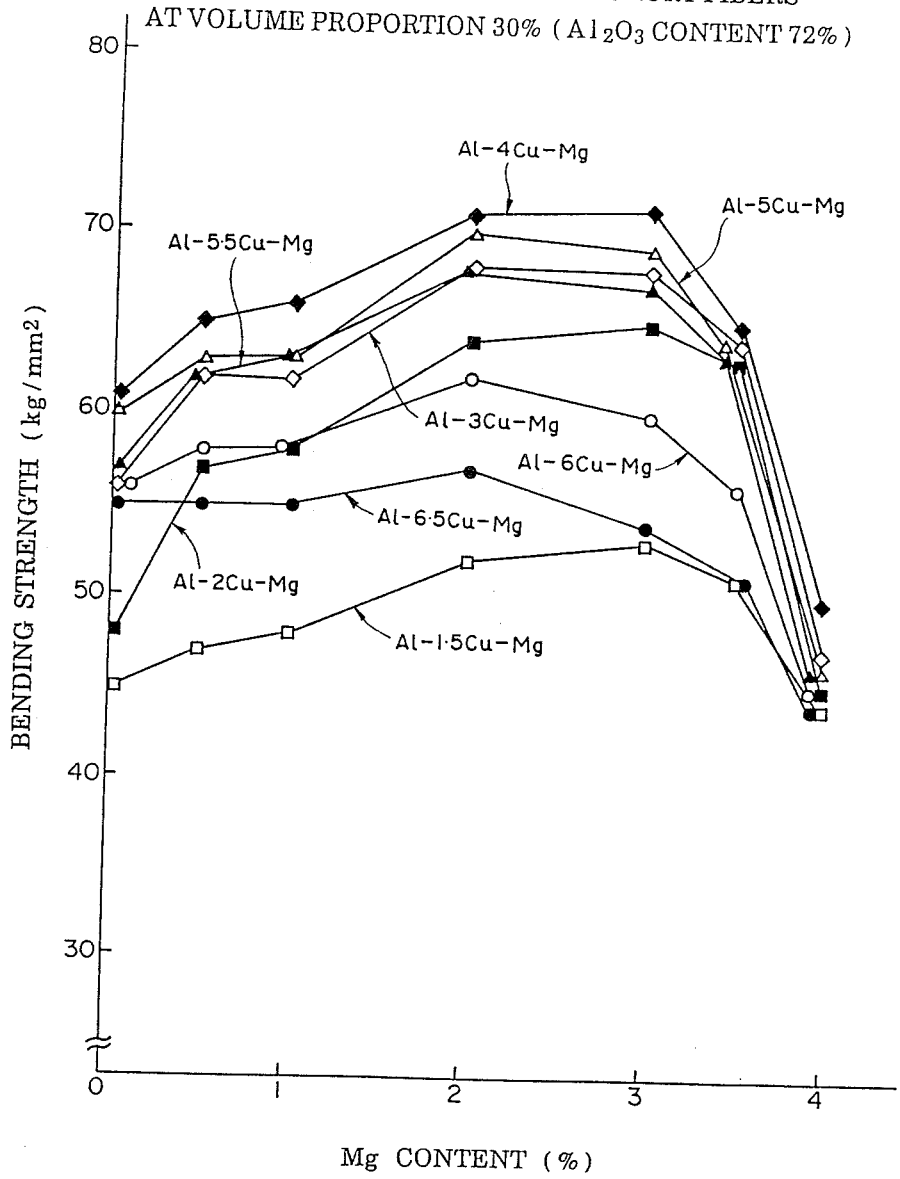
FIG. 26 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, to FIGS. 20 through 22 for the ninth preferred embodiment set, to FIGS. 23 and 24 for the tenth preferred embodiment set, and to FIG. 25 for the eleventh preferred embodiment set, in which again magnesium content in percent is shown along the horizontal axis and bending strength in $kg/mm^2$ is shown along the vertical axis, derived from data relating to bending strength tests for a twelfth set of preferred embodiments of the material of the present invention (in which the volume proportion of reinforcing amorphous alumina-silica short fiber material, again now containing approximately 72% $Al_2O_3$ and now of average fiber length approximately 0.8 mm, was now approximately 30%), each said graph similarly showing the relation between magnesium content and being strength of certain composite material test pieces for a particular fixed percentage content of copper in the matrix metal of the composite material.

The results of these bending strength tests were as shown in the last column of Table 7 and as summarized in the graphs of FIG. 26; thus, FIG. 26 corresponds to FIGS. 1 through 3 relating to the first set of preferred embodiments, to FIGS. 4 and 5 relating to the second set of preferred embodiments, to FIGS. 6 and 7 relating to the third preferred embodiment set, to FIGS. 8 and 9 relating to the fourth preferred embodiment set, to FIGS. 10 through 12 relating to the fifth preferred embodiment set, to FIGS. 13 and 14 relating to the sixth preferred embodiment set, to FIGS. 20 through 22 relating to the ninth preferred embodiment set, to FIGS. 23 and 24 relating to the tenth preferred embodiment set, and to FIG. 25 relating to the eleventh preferred embodiment set. In the graphs of FIG. 26, there are again shown relations between magnesium content and the bending strength (in $kg/mm^2$) of certain of the composite material test pieces, for percentage contents of copper fixed along the various lines thereof. From Table 7 and from FIG. 26 it will be understood that for all of these composite materials, when as in these cases the volume proportion of the reinforcing amorphous alumina-silica short fiber material of these bending strength composite material test sample pieces was approximately 30%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, particularly, when the magnesium content was in the high range above approximately 3.5%, the bending strength of the composite material test sample pieces reduced relatively suddenly with increase of the magnesium content; and, when the magnesium content was approximately 4%, the bending strength of the composite material test sample pieces had a substantially lower value than when the magnesium content was approximately 0%.

From the results of these bending strength tests it will be seen that, in order to provide for a good and appropriate bending strength for a composite material having as reinforcing fiber material such amorphous alumina-silica short fibers with $Al_2O_3$ content approximately 72% in volume proportion of approximately 30% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6% and particularly should be in the range of from approximately 2% to approximately 5.5%, while the magnesium content of said Al-Cu-Mg type aluminum alloy matrix metal should be in the range of from approximately 0.5% to approximately 3.5% and particularly should be in the range of from approximately 1.5% to approximately 3.5%.

THE THIRTEENTH SET OF PREFERRED EMBODIMENTS

For the thirteenth set of preferred embodiments of the present invention, the present inventors manufactured by using the high pressure casting method samples of various composite materials, utilizing as matrix metal Al-Cu-Mg type aluminum alloys of various compositions, and now again utilizing as reinforcing material crystalline alumina-silica short fiber material, which now in this case had composition about 77% $Al_2O_3$ and remainder substantially $SiO_2$, with mullite crystalline proportion approximately 60%, and which now had average fiber length about 1.5 mm and also now had average fiber diameter about 3.2 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (again fifty six) of crystalline alumina-silica short type fiber material preforms were as before made by the method disclosed above with respect to the previously described sets of preferred embodiments, said set of said crystalline alumina-silica short type fiber material preforms now having a fiber volume proportion of approximately 10%. These preforms again had substantially the same dimensions as the preforms of the previously described sets of preferred embodiments.

Next, substantially as before, each of these crystalline alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had crystalline alumina-silica short type fiber material as reinforcing material and the appropriate one of the aluminum alloys A1 through A56 as matrix metal. The volume proportion of crystalline alumina-silica short type fibers in each of this set of the resulting composite material sample pieces was thus now approximately 10%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 27:
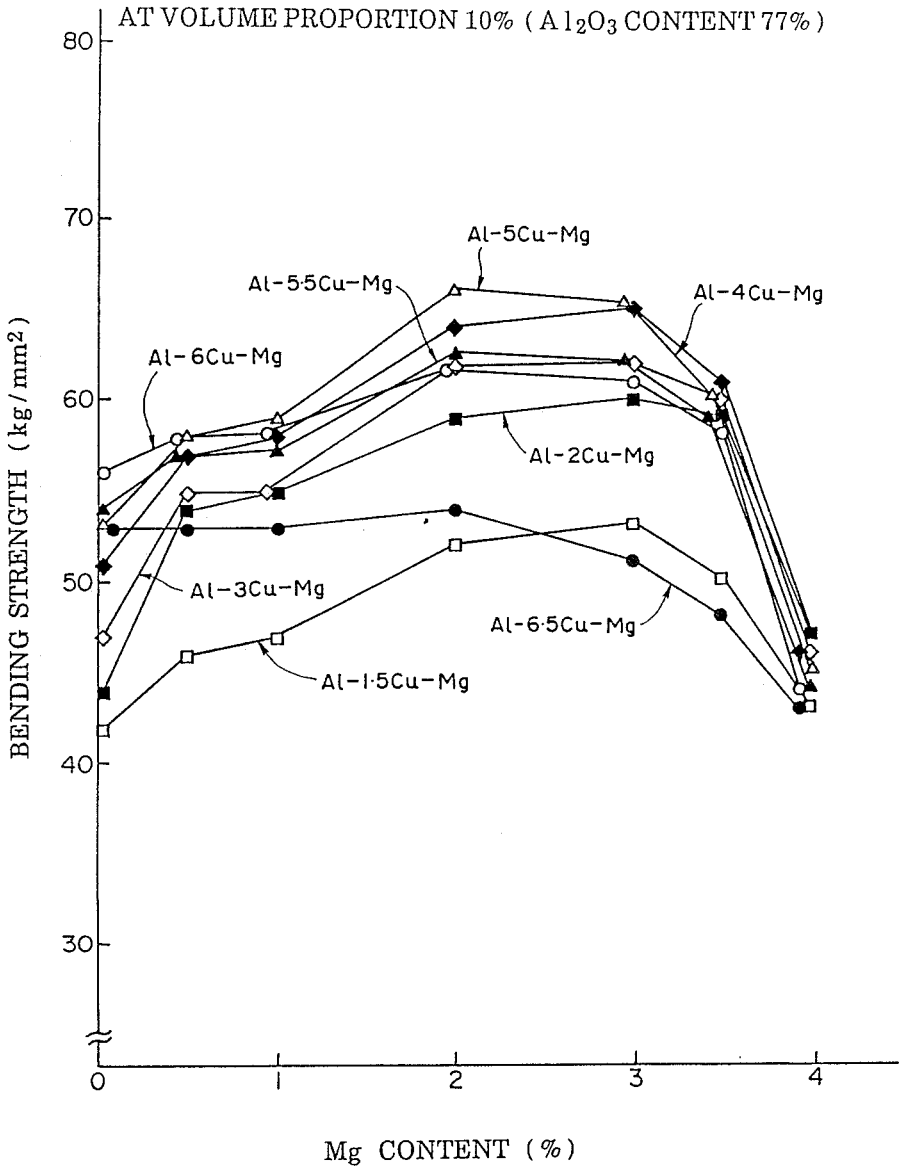
FIG. 27 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, to FIGS. 20 through 22 for the ninth preferred embodiment set, to FIGS. 23 and 24 for the tenth preferred embodiment set, and to FIGS. 25 and 26 for the eleventh and twelfth preferred embodiment sets respectively, in which again magnesium content in percent is shown along the horizontal axis and bending strength in $kg/mm^2$ is shown along the vertical axis, derived from data relating to bending strength tests for a thirteenth set of preferred embodiments of the material of the present invention (in which the volume proportion of reinforcing, now crystalline, alumina-silica short fiber material, now containing approximately 77% $Al_2O_3$ and now of average fiber length approximately 1.5 mm, was now approximately 10%), each said graph similarly showing the relation between magnesium content and bending strength of certain composite material test pieces for a particular fixed percentage content of copper in the matrix metal of the composite material.

The results of these bending strength tests were as shown in column I of Table 8 and as summarized in the graphs of FIG. 27; thus, FIG. 27 corresponds to FIGS. 1 through 3 relating to the first set of preferred embodiments, to FIGS. 4 and 5 relating to the second set of preferred embodiments, to FIGS. 6 and 7 relating to the third preferred embodiment set, to FIGS. 8 and 9 relating to the fourth preferred embodiment set, to FIGS. 10 through 12 relating to the fifth preferred embodiment set, to FIGS. 13 and 14 relating to the sixth preferred embodiment set, to FIGS. 20 through 22, relating to the ninth preferred embodiment set, to FIGS. 23 and 24 relating to the tenth preferred embodiment set, and to FIGS. 25 and 26 relating to the eleventh and the twelfth preferred embodiment sets respectively. In the graphs of FIG. 27, there are again shown relations between magnesium content and the bending strength (in $kg/mm^2$) of certain of the composite material test pieces, for percentage contents of copper fixed along the various lines thereof.

From Table 8 and from FIG. 27 it will be understood that for all of these composite materials, when as in these cases the volume proportion of the reinforcing crystalline alumina-silica short fiber material of these bending strength composite material test sample pieces was approximately 10%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, particularly, when the magnesium content was in the high range above approximately 3.5%, the bending strength of the composite material test sample pieces reduced relatively suddenly with increase of the magnesium content; and, when the magnesium content was approximately 4%, the bending strength of the composite material test sample pieces had a substantially the same or lower value than when the magnesium content was approximately 0%.

From the results of these bending strength tests it will be seen that, in order to provide for a good and appropriate bending strength for a composite material having as reinforcing fiber material such crystalline alumina-silica short fibers with $Al_2O_3$ content approximately 77% with mullite crystalline proportion approximately 60% in volume proportion of approximately 10% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6%, while the magnesium content of said Al-Cu-Mg type aluminum alloy matrix metal should be in the range of from approximately 0.5% to approximately 3.5% and particularly should be in the range of from approximately 1.5% to approximately 3.5%.

THE FOURTEENTH SET OF PREFERRED EMBODIMENTS

For the fourteenth set of preferred embodiments of the present invention, the present inventors manufactured by using the high pressure casting method samples of various composite materials, utilizing as matrix metal Al-Cu-Mg type aluminum alloys of various compositions, and now again utilizing as reinforcing material amorphous alumina-silica short fiber material, which again in this case had composition about 77% $Al_2O_3$ and remainder substantially $SiO_2$, and which now had average fiber length about 0.6 mm and again had average fiber diameter about 3.2 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (again fifty six) of amorphous alumina-silica short type fiber material preforms were as before made by the method disclosed above with respect to the previously described sets of preferred embodiments, said set of said amorphous alumina-silica short type fiber material preforms now having a fiber volume proportion of approximately 30%. These preforms again had substantially the same dimensions as the preforms of the previously described sets of preferred embodiments.

Next, substantially as before, each of these amorphous alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had amorphous alumina-silica short type fiber material as reinforcing material and the appropriate one of the aluminum alloys A1 through A56 as matrix metal. The volume proportion of amorphous alumina-silica short type fibers in each of this set of the resulting composite material sample pieces was thus now approximately 30%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 28:
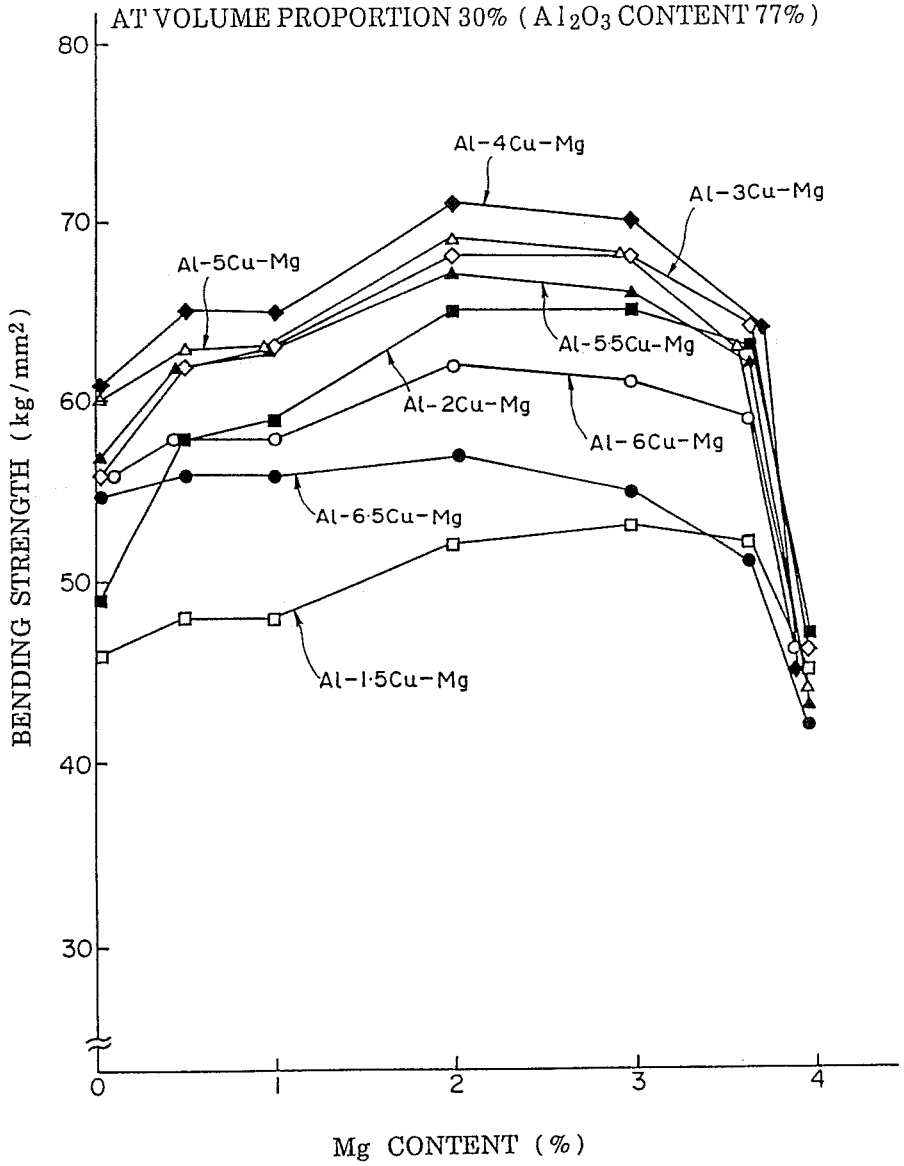
FIG. 28 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, to FIGS. 20 through 22 for the ninth preferred embodiment set, to FIGS. 23 and 24 for the tenth preferred embodiment set, and to FIGS. 25 through 27 for the eleventh through the thirteenth preferred embodiment sets respectively, in which again magnesium content in percent is shown along the horizontal axis and bending strength in kg/mm$^2$ is shown along the vertical axis, derived from data relating to bending strength tests for a fourteenth set of preferred embodiments of the material of the present invention (in which the volume proportion of reinforcing, now amorphous, alumina-silica short fiber material, again containing approximately 77% $Al_2O_3$ and now of average fiber length approximately 0.6 mm, was now approximately 30%), each said graph similarly showing the relation between magnesium content and bending strength of certain composite material test pieces for a particular fixed percentage content of copper in the matrix metal of the composite material.

The results of these bending strength tests were as shown in column II of Table 8 and as summarized in the graphs of FIG. 28; thus, FIG. 28 corresponds to FIGS. 1 through 3 relating to the first set of preferred embodiments, to FIGS. 4 and 5 relating to the second set of preferred embodiments, to FIGS. 6 and 7 relating to the third preferred embodiment set, to FIGS. 8 and 9 relating to the fourth preferred embodiment set, to FIGS. 10 through 12 relating to the fifth preferred embodiment set, to FIGS. 13 and 14 relating to the sixth preferred embodiment set, to FIGS. 20 through 22 relating to the ninth preferred embodiment set, to FIGS. 23 and 24 relating to the tenth preferred embodiment set, and to FIGS. 25 through 27 relating to the eleventh through the thirteenth preferred embodiment sets respectively. In the graphs of FIG. 28, there are again shown relations between magnesium content and the bending strength (in $kg/mm^2$) of certain of the composite material test pieces, for percentage contents of copper fixed along the various lines thereof.

From Table 8 and from FIG. 28 it will be understood that for all of these composite materials, when as in these cases the volume proportion of the reinforcing amorphous alumina-silica short fiber material of these bending strength composite material test sample pieces was approximately 30%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, particularly, when the magnesium content was in the high range above approximately 3.5%, the bending strength of the composite material test sample pieces reduced relatively suddenly with increase of the magnesium content; and, when the magnesium content was approximately 4%, the bending strength of the composite material test sample pieces had a substantially lower value than when the magnesium content was approximately 0%.

From the results of these bending strength tests it will be seen that, in order to provide for a good and appropriate bending strength for a composite material having as reinforcing fiber material such amorphous alumina-silica short fibers with $Al_2O_3$ content approximately 77% in volume proportion of approximately 30% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6% and particularly should be in the range of from approximately 2% to approximately 5.5%, while the magnesium content of said Al-Cu-Mg type aluminum alloy matrix metal should be in the range of from approximately 0.5% to approximately 3.5% and particularly should be in the range of from approximately 1.5% to approximately 3.5%.

THE FIFTEENTH SET OF PREFERRED EMBODIMENTS

For the fifteenth set of preferred embodiments of the present invention, the present inventors manufactured by using the high pressure casting method samples of various composite materials, utilizing as matrix metal Al-Cu-Mg type aluminum alloys of various compositions, and now utilizing as reinforcing material crystalline alumina-silica short fiber material, which again in this case had composition about 67% $Al_2O_3$ and remainder substantially $SiO_2$, and had mullite crystalline proportion of approximately 60%, and which now had average fiber length about 0.3 mm and average fiber diameter about 2.6 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (again fifty six) of crystalline alumina-silica short type fiber material preforms were as before made by the method disclosed above with respect to the previously described sets of preferred embodiments, said set of said crystalline alumina-silica short type fiber material preforms again having a fiber volume proportion of approximately 30%. These preforms again had substantially the same dimensions as the preforms of the previously described sets of preferred embodiments.

Next, substantially as before, each of these crystalline alumina-silica short fiber type material preforms was subjected to high pressure casting together with an appropriate quantity of the aluminum alloy A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had crystalline alumina-silica short type fiber material as reinforcing material and the appropriate one of the aluminum alloys A1 through A56 as matrix metal. The volume proportion of crystalline alumina-silica short type fibers in each of this set of the resulting composite material sample pieces was thus again approximately 30%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 29:
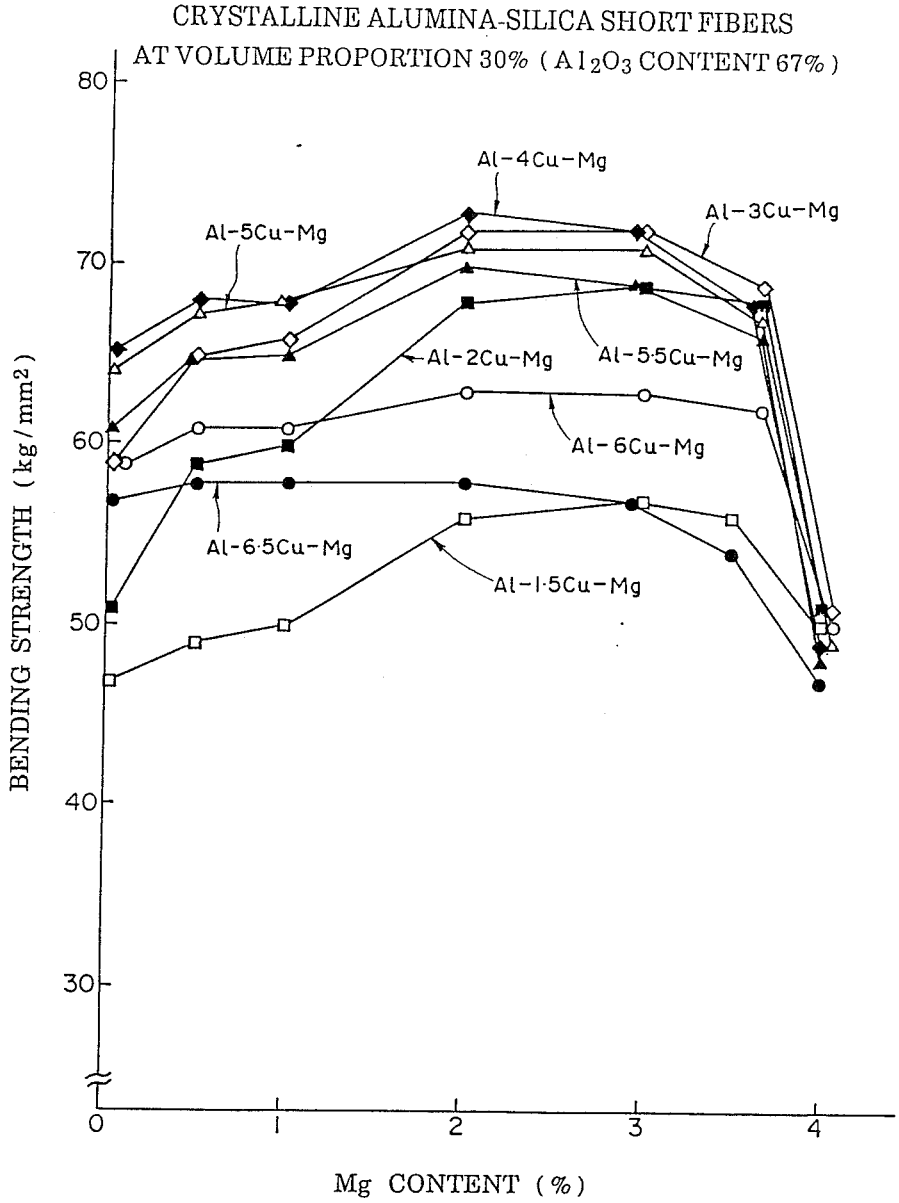
FIG. 29 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, to FIGS. 20 through 22 for the ninth preferred embodiment set, to FIGS. 23 and 24 for the tenth preferred embodiment set, and to FIGS. 25 through 28 for the eleventh through the fourteenth preferred embodiment sets respectively, in which again magnesium content in percent is shown along the horizontal axis and bending strength in kg/mm$^2$ is shown along the vertical axis, derived from data relating to bending strength tests for a fifteenth set of preferred embodiments of the material of the present invention (in which the volume proportion of reinforcing, now crystalline, alumina-silica short fiber material, now containing approximately 67% $Al_2O_3$ and now of average fiber length approximately 0.3 mm, was again approximately 30%), each said graph similarly showing the relation between magnesium content and bending strength of certain composite material test pieces for a particular fixed percentage content of copper in the matrix metal of the composite material.

The results of these bending strength tests were as shown in column III of Table 8 and as summarized in the graphs of FIG. 29; thus, FIG. 29 corresponds to FIGS. 1 through 3 relating to the first set of preferred embodiments, to FIGS. 4 and 5 relating to the second set of preferred embodiments, to FIGS. 6 and 7 relating to the third preferred embodiment set, to FIGS. 8 and 9 relating to the fourth preferred embodiment set, to FIGS. 10 through 12 relating to the fifth preferred embodiment set, to FIGS. 13 and 14 relating to the sixth preferred embodiment set, to FIGS. 20 through 22 relating to the ninth preferred embodiment set, to FIGS. 23 and 24 relating to the tenth preferred embodiment set, and to FIGS. 25 through 28 relating to the eleventh through the fourteenth preferred embodiment sets respectively. In the graphs of FIG. 29, there are again shown relations between magnesium content and the bending strength (in $kg/mm^2$) of certain of the composite material test pieces, for percentage contents of copper fixed along the various lines thereof.

From Table 8 and from FIG. 29 it will be understood that for all of these composite materials, when as in these cases the volume proportion of the reinforcing crystalline alumina-silica short fiber material of these bending strength composite material test sample pieces was approximately 30%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 2% to approximately 3%, the bending strength of the composite material test sample pieces attained a substantially maximum value; and, when the magnesium content increased above or decreased below this range, then the bending strength of the composite material test sample pieces decreased gradually; while, particularly, when the magnesium content was in the high range above approximately 3.5%, the bending strength of the composite material test sample pieces reduced relatively suddenly with increase of the magnesium content; and, when the magnesium content was approximately 4%, the bending strength of the composite material test sample pieces had a substantially lower value than when the magnesium content was approximately 0%.

From the results of these bending strength tests it will be seen that, in order to provide for a good and appropriate bending strength for a composite material having as reinforcing fiber material such crystalline alumina-silica short fibers with $Al_2O_3$ content approximately 67% and with mullite crystalline proportion approximately 60% in volume proportion of approximately 30% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6% and particularly should be in the range of from approximately 2% to approximately 5.5%, while the magnesium content of said Al-Cu-Mg type aluminum alloy matrix metal should be in the range of from approximately 0.5% to approximately 3.5% and particularly should be in the range of from approximately 1.5% to approximately 3.5%.

THE SIXTEENTH SET OF PREFERRED EMBODIMENTS

For the sixteenth set of preferred embodiments of the present invention, the present inventors manufactured by using the high pressure casting method samples of various composite materials, utilizing as matrix metal Al-Cu-Mg type aluminum alloys of various compositions, and now utilizing as reinforcing material amorphous alumina-silica short fiber material, which again in this case had composition about 67% $Al_2O_3$ and remainder substantially $SiO_2$, and which now had average fiber length about 1.2 mm and average fiber diameter about 2.6 microns. Then the present inventors conducted evaluations of the bending strength of the various resulting composite material sample pieces.

First, a set of fifty six quantities of aluminum alloy material the same as those utilized in the previously described sets of preferred embodiments were produced in the same manner as before, again having as base material aluminum and having various quantities of magnesium and copper mixed therewith. And an appropriate number (again fifty six) of amorphous alumina-silica short type fiber material preforms were as before made by the method disclosed above with respect to the previously described sets of preferred embodiments, said set of said amorphous alumina-silica short type fiber material preforms again having a fiber volume proportion of approximately 10%. These preforms again had substantially the same dimensions as the preforms of the previously described sets of preferred embodiments.

Next, substantially as before, each of these amorphous alumina-silica short fiber type material preforms was subjected to high pressure casting together with an appropriate quantity of one of the aluminum alloys A1 through A56 described above, utilizing operational parameters substantially as before. The solidified aluminum alloy mass with the preform included therein was then removed from the casting mold, and the peripheral portion of said solidified aluminum alloy mass and the stainless steel case were machined away, leaving only a sample piece of composite material which had amorphous alumina-silica short type fiber material as reinforcing material and the appropriate one of the aluminum alloys A1 through A56 as matrix metal. The volume proportion of amorphous alumina-silica short type fibers in each of this set of the resulting composite material sample pieces was thus again approximately 10%. And post processing steps were performed on the composite material samples, substantially as before. From each of the composite material sample pieces manufactured as described above, to which heat treatment had been applied, there was cut a bending strength test piece of dimensions and parameters substantially as in the case of the previously described sets of preferred embodiments, and for each of these composite material bending strength test pieces a bending strength test was carried out, again substantially as before.

Figure 30:
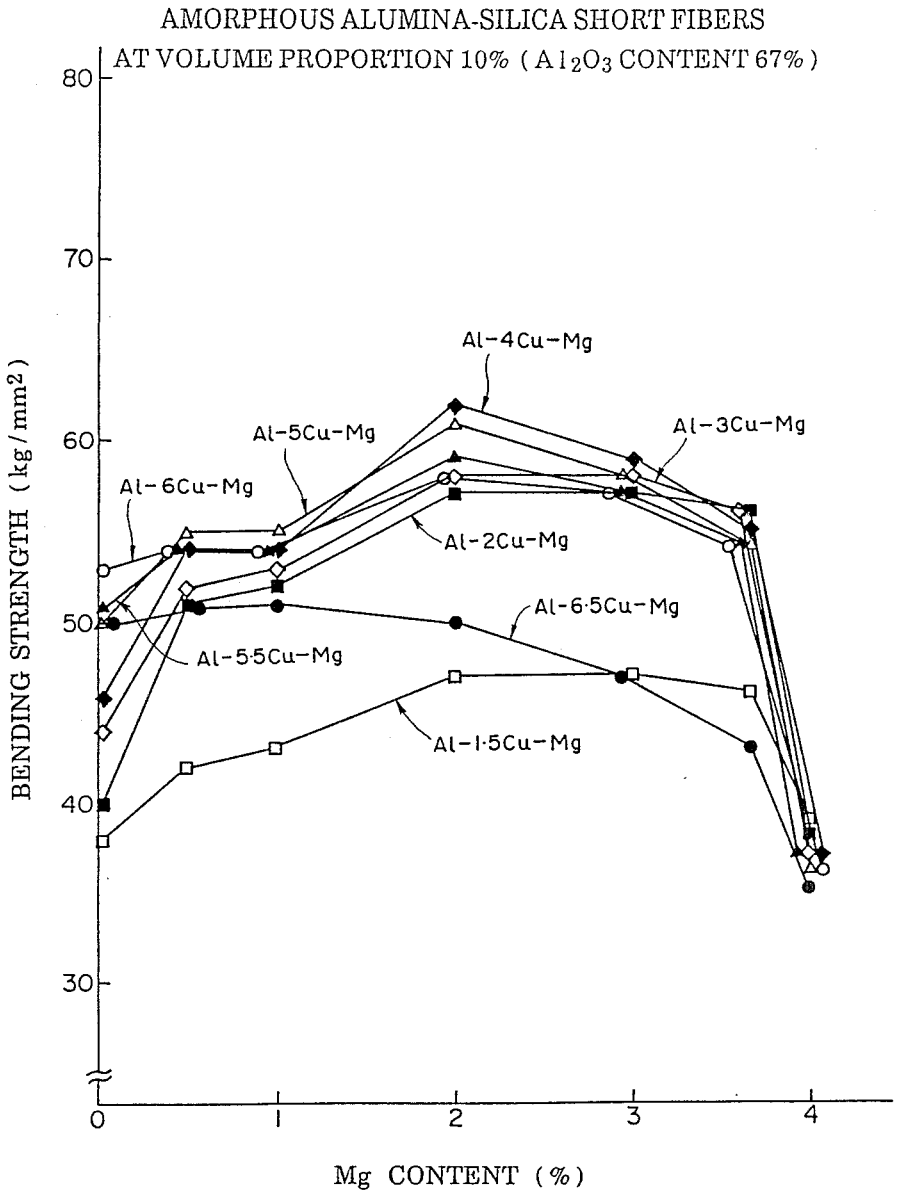
FIG. 30 is a set of graphs, similar to FIGS. 1, 2, and 3 for the three groups of the first set of preferred embodiments, to FIGS. 4 and 5 for the first and second groups of said second preferred embodiment set, to FIGS. 6 and 7 for the third preferred embodiment set, to FIGS. 8 and 9 for the fourth preferred embodiment set, to FIGS. 10 through 12 for the fifth preferred embodiment set, to FIGS. 13 and 14 for the sixth preferred embodiment set, to FIGS. 20 through 22 for the ninth preferred embodiment set, to FIGS. 23 and 24 for the tenth preferred embodiment set, and to FIGS. 25 through 29 for the eleventh through the fifteenth preferred embodiment sets respectively, in which again magnesium content in percent is shown along the horizontal axis and bending strength in kg/mm$^2$ is shown along the vertical axis, derived from data relating to bending strength tests for a sixteenth set of preferred embodiments of the material of the present invention (in which the volume proportion of reinforcing, now amorphous, alumina-silica short fiber material, again containing approximately 67% $Al_2O_3$ and now of average fiber length approximately 1.2 mm, was now approximately 10%), each said graph similarly showing the relation between magnesium content and bending strength of certain composite material test pieces for a particular fixed percentage content of copper in the matrix metal of the composite material.

The results of these bending strength tests were as shown in column IV of Table 8 and as summarized in the graphs of FIG. 30; thus, FIG. 30 corresponds to FIGS. 1 through 3 relating to the first set of preferred embodiments, to FIGS. 4 and 5 relating to the second set of preferred embodiments, to FIGS. 6 and 7 relating to the third preferred embodiment set, to FIGS. 8 and 9 relating to the fourth preferred embodiment set, to FIGS. 10 through 12 relating to the fifth preferred embodiment set, to FIGS. 13 and 14 relating to the sixth preferred embodiment set, to FIGS. 20 through 22 relating to the ninth preferred embodiment set, to FIGS. 23 and 24 relating to the tenth preferred embodiment set, and to FIGS. 25 through 29 relating to the eleventh through the fifteenth preferred embodiment sets respectively. In the graphs of FIG. 30, there are again shown relations between magnesium content and the bending strength (in $kg/mm^2$) of certain of the composite material test pieces, for percentage contents of copper fixed along the various lines thereof.

From Table 8 and from FIG. 30 it will be understood that for all of these composite materials, when as in these cases the volume proportion of the reinforcing amorphous alumina-silica short fiber material of these bending strength composite material test sample pieces was approximately 10%, substantially irrespective of the magnesium content of the aluminum alloy matrix metal, when the copper content was either at the low extreme of approximately 1.5% or was at the high extreme of approximately 6.5%, the bending strength of the composite material test sample pieces had a relatively low value; and, substantially irrespective of the copper content of the aluminum alloy matrix metal, when the magnesium content was either at the lower value of approximately 0% or at the higher value of approximately 4%, the bending strength of the composite material test sample pieces had a relatively low value. Further, it will be seen that, when the magnesium content was in the range of from approximately 1% to approximately 2%, the bending strength of the composite material test sample pieces attained a substantially maximum value; and, when the magnesium content increased above or decreased below this range, then the bending strength of the composite material test sample pieces decreased gradually; while, particularly, when the magnesium content was in the high range above approximately 3.5%, the bending strength of the composite material test sample pieces reduced relatively suddenly with increase of the magnesium content; and, when the magnesium content was approximately 4%, the bending strength of the composite material test sample pieces had a substantially lower value than when the magnesium content was approximately 0%.

From the results of these bending strength tests it will be seen that, in order to provide for a good and appropriate bending strength for a composite material having as reinforcing fiber material such amorphous alumina-silica short fibers with $Al_2O_3$ content approximately 67% in volume proportion of approximately 10% and having as matrix metal an Al-Cu-Mg type aluminum alloy, with remainder substantially $Al_2O_3$, it is preferable that the copper content of said Al-Cu-Mg type aluminum alloy matrix metal should be in the range of from approximately 2% to approximately 6%, while the magnesium content of said Al-Cu-Mg type aluminum alloy matrix metal should be in the range of from approximately 0.5% to approximately 3.5% and particularly should be in the range of from approximately 1.5% to approximately 3.5%.

THE SEVENTEENTH SET OF PREFERRED EMBODIMENTS

Variation of fiber volume proportion

Since from the above described ninth through sixteenth sets of preferred embodiments the fact has been amply established and demonstrated, in this case of relatively high $Al_2O_3$ proportion, both in the case that the reinforcing alumina-silica short fibers are crystalline and in the case that said reinforcing alumina-silica short fibers are amorphous, that it is preferable for the copper content of the Al-Cu-Mg type aluminum alloy matrix metal to be in the range of from approximately 2% to approximately 6%, and that it is preferable for the magnesium content of said Al-Cu-Mg type aluminum alloy matrix metal to be in the range of from approximately 0.5% to approximately 3.5%, it next was deemed germane to provide a set of tests to establish what fiber volume proportion of the reinforcing alumina-silica type short fibers is most appropriate. This was done, in the seventeenth set of preferred embodiments now to be described, by varying said fiber volume proportion of the reinforcing alumina-silica type short fiber material while using an Al-Cu-Mg type aluminum alloy matrix metal which had proportions of copper and magnesium which had as described above been established as being quite good, i.e. which had copper content of approximately 4% and also magnesium content of approximately 2% and remainder substantially aluminum. In other words, an appropriate number (in fact six in each case) of preforms made of the crystalline type alumina-silica short fiber material used in the ninth set of preferred embodiments detailed above, and of the amorphous type alumina-silica short fiber material used in the thirteenth set of preferred embodiments detailed above, hereinafter denoted respectively as B1 through B6 and C1 through C6, were made by subjecting quantities of the relevant short fiber material to compression forming without using any binder in the same manner as in the above described sets of preferred embodiments, the six ones in each said set of said alumina-silica type short fiber material preforms having fiber volume proportions of approximately 5%, 10%, 20%, 30%, 40%, and 50%. These preforms had substantially the same dimensions and the same type of two dimensional random fiber orientation as the preforms of the above described sets of preferred embodiments. And, substantially as before, each of thes alumina-silica type short fiber material preforms was subjected to high pressure casting together with an appropriate quantity of the aluminum alloy matrix metal described above, utilizing operational parameters substantially as before. In each case, the solidified aluminum alloy mass with the preform included therein was then removed from the casting mold, and as before the peripheral portion of said solidified aluminum alloy mass was machined away along with the stainless steel case which was utilized, leaving only a sample piece of composite material which had one of the described alumina-silica type short fiber material as reinforcing material in the appropriate fiber volume proportion and the described aluminum alloy as matrix metal. And post processing and artificial aging processing steps were performed on the composite material samples, similarly to what was done before. From each of the composite material sample pieces manufactured as described above, to which heat treatment had been applied, there was then cut a bending strength test piece, each of dimensions substantially as in the case of the above described sets of preferred embodiments, and for each of these composite material bending strength test pieces a bending strength test was carried out, again substantially as before. Also, for reference purposes, a similar test sample was cut from a piece of a cast aluminum alloy material which included no reinforcing fiber material at all, said aluminum alloy material having copper content of about 4%, magnesium content of about 2%, and balance substantially aluminum, and having been subjected to post processing and artificial aging processing steps, similarly to what was done before. And for this comparison sample, referred to as A0, a bending strength test was carried out, again substantially as before. The results of these bending strength tests were as shown in the two graphs of FIG. 31, respectively for the crystalline type alumina-silica short reinforcing fiber material samples B1 through B6 and the amorphous alumina-silica type reinforcing fiber material samples C1 through C6; the zero point of each said graph corresponds to the test sample A0 with no reinforcing alumina-silica fiber material at all. Each of these graphs shows the relation between the volume proportion of the alumina-silica type short reinforcing fibers and the bending strength (in $kg/mm^2$) of the composite material test pieces, for the appropriate type of reinforcing fibers.

Figure 31:
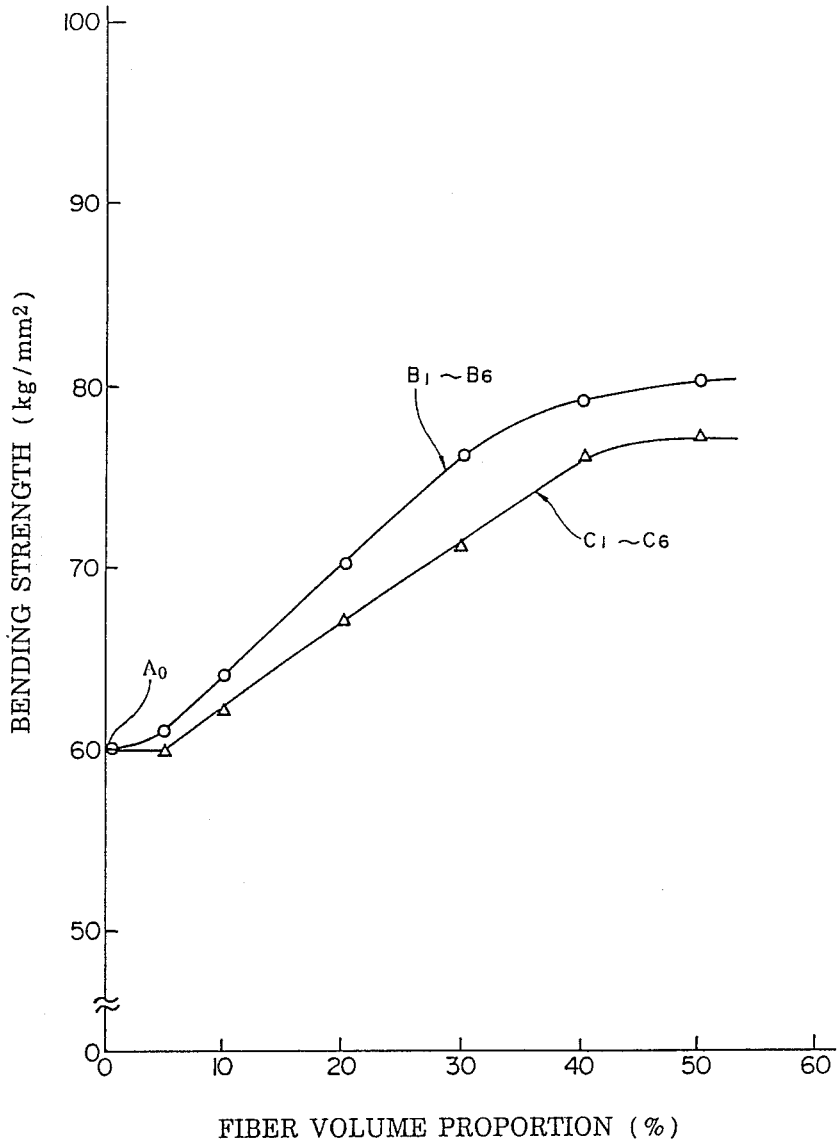
FIG. 31 is similar to FIG. 15, being a set of two graphs relating to two sets of tests in which the fiber volume proportions of reinforcing alumina-silica short fiber materials of two different types were varied, in which said reinforcing fiber proportion in percent is shown along the horizontal axis and bending strength in kg/mm$^2$ is shown along the vertical axis, derived from data relating to bending strength tests for certain ones of a seventeenth set of preferred embodiments of the material of the present invention, said graphs showing the relation between volume proportion of the reinforcing alumina-silica short fiber material and bending strength of certain test pieces of the composite material.

From FIG. 31, it will be understood that, substantially irrespective of the type of reinforcing alumina-silica short fiber material utilized: when the volume proportion of the alumina-silica type short reinforcing fibers was in the range of up to and including approximately 5% the bending strength of the composite material hardly increased along with an increase in the fiber volume proportion, and its value was close to the bending strength of the aluminum alloy matrix metal by itself with no reinforcing fiber material admixtured therewith; when the volume proportion of the alumina-silica type short reinforcing fibers was in the range of 5% to 30% or was in the range of 5% to 40%, the bending strength of the composite material increased substantially linearly with increase in the fiber volume proportion; and, when the volume proportion of the alumina-silica type short reinforcing fibers increased above 40%, and particularly when said volume proportion of said alumina-silica type short reinforcing fibers increased above 50%, the bending strength of the composite material did not increase very much even with further increase in the fiber volume proportion. From these results described above, it is seen that in a composite material having alumina-silica type short fiber reinforcing material and having as matrix metal an Al-Cu-Mg type aluminum alloy, said Al-Cu-Mg type aluminum alloy matrix metal having a copper content in the range of from approximately 1.5% to approximately 6%, a magnesium content in the range of from approximately 0.5% to approximately 2%, and remainder substantially aluminum, irrespective of the actual type of the reinforcing alumina-silica fibers utilized, it is preferable that the fiber volume proportion of said alumina-silica type short fiber reinforcing material should be in the range of from approximately 5% to approximately 50%, and more preferably should be in the range of from approximately 5% to approximately 40%.

THE EIGHTEENTH SET OF PREFERRED EMBODIMENTS

Variation of mullite crystalline proportion

Figure 32:
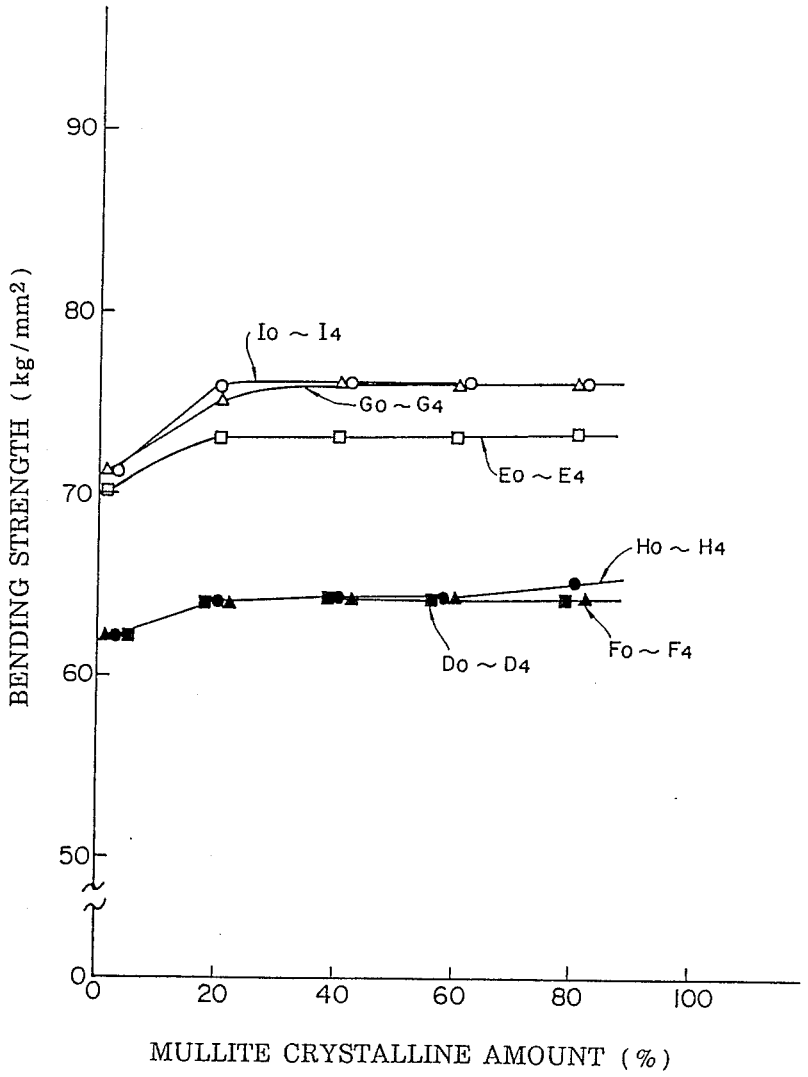
FIG. 32 is similar to FIG. 16, being a graph relating to the eighteenth set of preferred embodiments, in which mullite crystalline content in percent is shown along the horizontal axis and bending strength in kg/mm is shown along the vertical axis, derived from data relating to bending strength tests for various composite materials having crystalline alumina-silica short fiber material with varying amounts of the mullite crystalline form therein as reinforcing material and an alloy containing approximately 4% of copper, approximately 2% of magnesium, and remainder substantially aluminum as matrix metal, and showing the relation between the mullite crystalline percentage of the reinforcing short fiber material of the composite material test pieces and their bending strengths.

In the particular case that crystalline alumina-silica short fiber material is used as the alumina-silica type short fiber material for reinforcement, in order to assess what value of the mullite crystalline amount of the crystalline alumina-silica short fiber material yields a high value for the bending strength of the composite material, a number of samples of crystalline alumina-silica type short fiber material were formed in a per se known way: a first set of five thereof having proportion of $Al_2O_3$ of approximately 67% and balance $SiO_2$ and having average fiber length of approximately 0.8 mm and average fiber diameter of approximately 2.6 microns and including samples with mullite crystalline amount of 0%, 20%, 40%, 60%, and 80%; a second set of five thereof having the same proportion of $Al_2O_3$ of approximately 67% and balance $SiO_2$ but having average fiber length of approximately 0.3 mm with the same average fiber diameter of approximately 2.6 microns and likewise including samples with mullite crystalline amount of 0%, 20%, 40%, 60%, and 80%; a third set of five thereof having proportion of $Al_2O_3$ approximately 72% and balance $SiO_2$ and having average fiber length of approximately 1.0 mm with average fiber diameter of approximately 3.0 microns and likewise including samples with mullite crystalline amount of 0%, 20%, 40%, 60%, and 80%; a fourth set of five thereof having the same proportion of $Al_2O_3$ of approximately 72% and balance $SiO_2$ and having a like average fiber length of approximately 1.0 mm with a like average fiber diameter of approximately 3.0 microns and likewise including samples with mullite crystalline amounts of 0%, 20%, 40%, 60%, and 80%; a fifth set of five thereof having proportion of $Al_2O_3$ of approximately 77% and balance $SiO_2$ and having average fiber length of approximately 1.5 mm and average fiber diameter of approximately 3.2 microns and including samples with mullite crystalline amounts of 0%, 20%, 40%, 60%, and 80%; and a sixth set of five thereof having the same proportion of $Al_2O_3$ of approximately 77% and balance $SiO_2$ but having average fiber length of approximately 0.5 mm with the same average fiber diameter of approximately 3.2 microns and likewise including samples with mullite crystalline amounts of 0%, 20%, 40%, 60%, and 80%. Then, from each of these thirty crystalline alumina-silica type short fiber material samples, a preform was formed in the same manner and under the same conditions as in the seven sets of preferred embodiments detailed above. The fifteen such preforms formed from the first, the third, and the fifth sets of five preforms each were formed with a fiber volume proportion of approximately 10%, and will be referred to as D0 through D4, F0 through F4, and H0 through H4 respectively; and the fifteen such preforms formed from the second, the fourth, and the sixth sets of five preforms each were formed with a fiber volume proportion of approximately 30%, and will be referred to as E0 through E4, G0 through G4, and I0 through I4 respectively. Then, using as matrix metal each such preform as a reinforcing fiber mass and an aluminum alloy of which the copper content was approximately 4%, the magnesium content was approximately 2%, and the remainder was substantially aluminum, various composite material sample pieces were manufactured in the same manner and under the same conditions as in the seven sets of preferred embodiments detailed above, the various resulting composite material sample pieces were subjected to liquidizing processing and artificial aging processing in the same manner and under the same conditions as in the various sets of preferred embodiments detailed above, from each composite material sample piece a bending test piece was cut in the same manner and under the same conditions as in the various sets of preferred embodiments detailed above, and for each bending test piece a bending test was carried out, as before. The results of these bending tests are shown in FIG. 32. It should be noted that in FIG. 32 the mullite crystalline amount (in percent) of the crystalline alumina-silica short fiber material which was the reinforcing fiber material for the composite material test pieces is shown along the horizontal axis, while the bending strength of said composite material test pieces is shown along the vertical axis.

From FIG. 32 it will be seen that, in the case that such an aluminum alloy as detailed above is utilized as the matrix metal, even when the mullite crystalline amount included in the reinforcing fibers is relatively low, the bending strength of the resulting composite material has a relatively high value, and, whatever be the variation in the mullite crystalline amount included in the reinforcing fibers, the variation in the bending strength of the resulting composite material is relatively low. Therefore it will again be seen that, in the case that crystalline alumina-silica short fiber material is used as the alumina-silica short fiber material for reinforcing the material of the present invention, it is acceptable for the value of the mullite crystalline amount therein to be more or less any value.

CONCLUSION

Although the present invention has been shown and described in terms of the preferred embodiments thereof, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the scope of the accompanying claims, which follow after the Tables.

TABLE 1

| ALLOY NO. | COPPER CONTENT (WT %) | MAGNESIUM CONTENT (WT %) |
|---|---|---|
| A1 | 1.54 | 0.04 |

TABLE 1-continued

| ALLOY NO. | COPPER CONTENT (WT %) | MAGNESIUM CONTENT (WT %) |
|---|---|---|
| A2 | 1.53 | 0.51 |
| A3 | 1.51 | 1.02 |
| A4 | 1.50 | 2.00 |
| A5 | 1.48 | 2.98 |
| A6 | 1.47 | 3.46 |
| A7 | 1.47 | 3.99 |
| A8 | 2.02 | 0.03 |
| A9 | 2.02 | 0.52 |
| A10 | 1.99 | 0.96 |
| A11 | 1.98 | 1.98 |
| A12 | 1.96 | 3.01 |
| A13 | 1.95 | 3.47 |
| A14 | 1.95 | 4.04 |
| A15 | 3.03 | 0.03 |
| A16 | 3.02 | 0.48 |
| A17 | 3.01 | 0.97 |
| A18 | 2.99 | 1.98 |
| A19 | 2.98 | 3.01 |
| A20 | 2.98 | 3.52 |
| A21 | 2.96 | 4.03 |
| A22 | 4.04 | 0.01 |
| A23 | 4.03 | 0.51 |
| A24 | 4.01 | 0.98 |
| A25 | 3.98 | 1.97 |
| A26 | 3.97 | 3.00 |
| A27 | 3.97 | 3.51 |
| A28 | 3.95 | 3.99 |
| A29 | 5.04 | 0.04 |
| A30 | 5.03 | 0.52 |
| A31 | 5.02 | 0.96 |
| A32 | 5.01 | 2.01 |
| A33 | 4.96 | 3.03 |
| A34 | 4.95 | 3.49 |
| A35 | 4.95 | 3.97 |
| A36 | 5.54 | 0.02 |
| A37 | 5.54 | 0.53 |
| A38 | 5.52 | 1.01 |
| A39 | 5.51 | 2.02 |
| A40 | 5.49 | 2.97 |
| A41 | 5.47 | 3.03 |
| A42 | 5.45 | 4.01 |
| A43 | 6.03 | 0.02 |
| A44 | 6.03 | 0.47 |
| A45 | 6.03 | 0.99 |
| A46 | 6.01 | 2.00 |
| A47 | 6.00 | 2.98 |
| A48 | 5.96 | 3.51 |
| A49 | 5.96 | 4.01 |
| A50 | 6.52 | 0.03 |
| A51 | 6.51 | 0.51 |
| A52 | 6.49 | 0.99 |
| A53 | 6.47 | 2.03 |
| A54 | 6.47 | 3.04 |
| A55 | 6.47 | 3.52 |
| A56 | 6.45 | 3.96 |

TABLE 2

| ALLOY NO. | ALUMINA-SILICA FIBER VOLUME PROPORTION | | | | |
|---|---|---|---|---|---|
| | 5% | 10% | 20% | 30% | 40% |
| A1 | 37 | 40 | 43 | 47 | 53 |
| A2 | 45 | 47 | 50 | 53 | 59 |
| A3 | 47 | 49 | 51 | 56 | 60 |
| A4 | 48 | 51 | 52 | 58 | 63 |
| A5 | 49 | 52 | 53 | 59 | 64 |
| A6 | 47 | 49 | 51 | 55 | 61 |
| A7 | 41 | 43 | 45 | 49 | 57 |
| A8 | 38 | 41 | 45 | 50 | 55 |
| A9 | 51 | 55 | 60 | 64 | 68 |
| A10 | 54 | 56 | 63 | 65 | 70 |
| A11 | 56 | 59 | 65 | 68 | 73 |
| A12 | 57 | 60 | 64 | 70 | 75 |
| A13 | 53 | 56 | 62 | 65 | 71 |
| A14 | 45 | 46 | 50 | 51 | 60 |
| A15 | 40 | 45 | 52 | 59 | 67 |
| A16 | 55 | 59 | 63 | 66 | 71 |

TABLE 2-continued

| ALLOY NO. | ALUMINA-SILICA FIBER VOLUME PROPORTION | | | | |
|---|---|---|---|---|---|
| | 5% | 10% | 20% | 30% | 40% |
| A17 | 58 | 61 | 65 | 68 | 73 |
| A18 | 60 | 62 | 66 | 71 | 76 |
| A19 | 60 | 62 | 67 | 72 | 77 |
| A20 | 55 | 57 | 63 | 65 | 71 |
| A21 | 46 | 47 | 49 | 52 | 60 |
| A22 | 43 | 49 | 55 | 65 | 67 |
| A23 | 57 | 61 | 65 | 69 | 73 |
| A24 | 60 | 63 | 68 | 71 | 75 |
| A25 | 62 | 65 | 69 | 74 | 78 |
| A26 | 61 | 64 | 69 | 74 | 78 |
| A27 | 55 | 58 | 64 | 67 | 72 |
| A28 | 45 | 47 | 50 | 53 | 61 |
| A29 | 46 | 52 | 59 | 64 | 61 |
| A30 | 58 | 61 | 66 | 68 | 71 |
| A31 | 61 | 63 | 68 | 69 | 72 |
| A32 | 63 | 66 | 70 | 73 | 77 |
| A33 | 61 | 63 | 68 | 71 | 77 |
| A34 | 54 | 57 | 63 | 64 | 71 |
| A35 | 44 | 46 | 52 | 52 | 59 |
| A36 | 48 | 53 | 60 | 61 | 64 |
| A37 | 57 | 60 | 65 | 67 | 69 |
| A38 | 59 | 62 | 67 | 68 | 71 |
| A39 | 61 | 63 | 69 | 71 | 74 |
| A40 | 59 | 62 | 67 | 70 | 73 |
| A41 | 53 | 56 | 62 | 65 | 69 |
| A42 | 44 | 45 | 51 | 52 | 59 |
| A43 | 50 | 55 | 60 | 60 | 59 |
| A44 | 53 | 57 | 62 | 62 | 64 |
| A45 | 55 | 58 | 63 | 64 | 67 |
| A46 | 56 | 60 | 63 | 65 | 69 |
| A47 | 54 | 59 | 62 | 64 | 68 |
| A48 | 52 | 56 | 60 | 60 | 65 |
| A49 | 43 | 44 | 52 | 50 | 56 |
| A50 | 47 | 53 | 55 | 58 | 57 |
| A51 | 48 | 53 | 55 | 59 | 59 |
| A52 | 49 | 54 | 56 | 60 | 61 |
| A53 | 49 | 54 | 57 | 60 | 62 |
| A54 | 48 | 51 | 56 | 59 | 60 |
| A55 | 47 | 49 | 54 | 55 | 58 |
| A56 | 42 | 43 | 48 | 49 | 54 |

TABLE 3

| ALLOY NO. | ALUMINA-SILICA FIBER VOLUME PROPORTION | |
|---|---|---|
| | 30% | 10% |
| A1 | 45 | 37 |
| A2 | 53 | 45 |
| A3 | 55 | 47 |
| A4 | 57 | 49 |
| A5 | 59 | 51 |
| A6 | 57 | 48 |
| A7 | 48 | 42 |
| A8 | 46 | 39 |
| A9 | 63 | 55 |
| A10 | 64 | 56 |
| A11 | 67 | 58 |
| A12 | 69 | 59 |
| A13 | 64 | 54 |
| A14 | 50 | 45 |
| A15 | 57 | 42 |
| A16 | 65 | 58 |
| A17 | 67 | 60 |
| A18 | 70 | 61 |
| A19 | 71 | 61 |
| A20 | 64 | 55 |
| A21 | 51 | 46 |
| A22 | 63 | 47 |
| A23 | 68 | 60 |
| A24 | 70 | 62 |
| A25 | 73 | 64 |
| A26 | 73 | 63 |
| A27 | 67 | 56 |
| A28 | 54 | 56 |
| A29 | 64 | 51 |
| A30 | 68 | 60 |
| A31 | 69 | 62 |

TABLE 3-continued

| ALLOY NO. | ALUMINA-SILICA FIBER VOLUME PROPORTION 30% | 10% |
|---|---|---|
| A32 | 72 | 65 |
| A33 | 70 | 62 |
| A34 | 63 | 65 |
| A35 | 50 | 44 |
| A36 | 62 | 52 |
| A37 | 66 | 59 |
| A38 | 68 | 61 |
| A39 | 70 | 62 |
| A40 | 69 | 60 |
| A41 | 63 | 54 |
| A42 | 51 | 43 |
| A43 | 60 | 54 |
| A44 | 62 | 56 |
| A45 | 63 | 57 |
| A46 | 65 | 60 |
| A47 | 63 | 58 |
| A48 | 60 | 54 |
| A49 | 49 | 43 |
| A50 | 57 | 53 |
| A51 | 58 | 53 |
| A52 | 58 | 54 |
| A53 | 59 | 54 |
| A54 | 58 | 52 |
| A55 | 57 | 48 |
| A56 | 49 | 42 |

TABLE 4

| ALLOY NO. | ALUMINA-SILICA FIBER VOLUME PROPORTION 30% | 10% |
|---|---|---|
| A1 | 43 | 36 |
| A2 | 50 | 45 |
| A3 | 52 | 48 |
| A4 | 54 | 50 |
| A5 | 55 | 51 |
| A6 | 53 | 47 |
| A7 | 46 | 41 |
| A8 | 46 | 39 |
| A9 | 61 | 53 |
| A10 | 62 | 54 |
| A11 | 65 | 57 |
| A12 | 68 | 58 |
| A13 | 63 | 53 |
| A14 | 49 | 43 |
| A15 | 53 | 41 |
| A16 | 63 | 57 |
| A17 | 66 | 58 |
| A18 | 69 | 60 |
| A19 | 71 | 61 |
| A20 | 63 | 54 |
| A21 | 51 | 44 |
| A22 | 60 | 45 |
| A23 | 67 | 59 |
| A24 | 69 | 61 |
| A25 | 72 | 63 |
| A26 | 72 | 62 |
| A27 | 65 | 55 |
| A28 | 51 | 44 |
| A29 | 61 | 50 |
| A30 | 67 | 59 |
| A31 | 68 | 60 |
| A32 | 70 | 64 |
| A33 | 69 | 60 |
| A34 | 62 | 53 |
| A35 | 48 | 42 |
| A36 | 59 | 51 |
| A37 | 65 | 58 |
| A38 | 67 | 59 |
| A39 | 69 | 61 |
| A40 | 67 | 60 |
| A41 | 61 | 52 |
| A42 | 48 | 41 |
| A43 | 56 | 53 |
| A44 | 59 | 55 |
| A45 | 61 | 56 |
| A46 | 62 | 59 |

TABLE 4-continued

| ALLOY NO. | ALUMINA-SILICA FIBER VOLUME PROPORTION 30% | 10% |
|---|---|---|
| A47 | 61 | 57 |
| A48 | 58 | 54 |
| A49 | 47 | 42 |
| A50 | 53 | 51 |
| A51 | 54 | 51 |
| A52 | 55 | 52 |
| A53 | 56 | 52 |
| A54 | 54 | 51 |
| A55 | 52 | 47 |
| A56 | 43 | 40 |

TABLE 5

| ALLOY NO. | ALUMINA-SILICA FIBER VOLUME PROPORTION 5% | 10% | 20% | 30% | 40% |
|---|---|---|---|---|---|
| A1 | 35 | 37 | 40 | 43 | 46 |
| A2 | 43 | 45 | 49 | 50 | 52 |
| A3 | 45 | 47 | 52 | 52 | 56 |
| A4 | 47 | 49 | 53 | 53 | 58 |
| A5 | 45 | 47 | 51 | 51 | 54 |
| A6 | 40 | 43 | 49 | 48 | 50 |
| A7 | 36 | 40 | 45 | 43 | 46 |
| A8 | 36 | 48 | 41 | 44 | 49 |
| A9 | 52 | 54 | 56 | 58 | 65 |
| A10 | 54 | 56 | 62 | 63 | 69 |
| A11 | 55 | 57 | 64 | 65 | 71 |
| A12 | 52 | 54 | 58 | 60 | 66 |
| A13 | 49 | 49 | 56 | 56 | 58 |
| A14 | 41 | 42 | 49 | 46 | 49 |
| A15 | 38 | 40 | 47 | 51 | 53 |
| A16 | 54 | 57 | 62 | 64 | 68 |
| A17 | 55 | 59 | 64 | 66 | 71 |
| A18 | 56 | 60 | 65 | 67 | 72 |
| A19 | 52 | 56 | 58 | 61 | 67 |
| A20 | 48 | 50 | 55 | 57 | 59 |
| A21 | 40 | 43 | 48 | 45 | 48 |
| A22 | 43 | 45 | 52 | 57 | 60 |
| A23 | 57 | 59 | 64 | 68 | 69 |
| A24 | 59 | 62 | 66 | 70 | 72 |
| A25 | 59 | 62 | 66 | 70 | 72 |
| A26 | 54 | 57 | 59 | 62 | 65 |
| A27 | 50 | 53 | 55 | 58 | 58 |
| A28 | 41 | 43 | 47 | 46 | 47 |
| A29 | 47 | 49 | 55 | 58 | 59 |
| A30 | 57 | 59 | 65 | 68 | 70 |
| A31 | 59 | 62 | 66 | 71 | 73 |
| A32 | 58 | 60 | 65 | 69 | 71 |
| A33 | 53 | 55 | 57 | 62 | 65 |
| A34 | 48 | 49 | 50 | 56 | 58 |
| A35 | 39 | 42 | 46 | 45 | 47 |
| A36 | 49 | 51 | 56 | 54 | 56 |
| A37 | 56 | 58 | 64 | 66 | 67 |
| A38 | 58 | 61 | 65 | 67 | 70 |
| A39 | 56 | 58 | 62 | 66 | 68 |
| A40 | 52 | 54 | 56 | 60 | 63 |
| A41 | 47 | 46 | 53 | 55 | 55 |
| A42 | 39 | 41 | 45 | 44 | 47 |
| A43 | 51 | 52 | 53 | 52 | 52 |
| A44 | 53 | 55 | 58 | 56 | 60 |
| A45 | 54 | 57 | 60 | 61 | 63 |
| A46 | 53 | 55 | 58 | 59 | 62 |
| A47 | 51 | 53 | 53 | 55 | 60 |
| A48 | 46 | 47 | 50 | 49 | 51 |
| A49 | 38 | 41 | 45 | 44 | 46 |
| A50 | 49 | 52 | 50 | 50 | 45 |
| A51 | 50 | 55 | 53 | 53 | 50 |
| A52 | 50 | 57 | 54 | 54 | 51 |
| A53 | 49 | 55 | 53 | 52 | 50 |
| A54 | 47 | 53 | 50 | 49 | 49 |
| A55 | 41 | 44 | 48 | 47 | 47 |
| A56 | 38 | 40 | 44 | 43 | 45 |

TABLE 6

| ALLOY NO. | ALUMINA-SILICA FIBER VOLUME PROPORTION 5% | 10% | 20% | 30% | 40% |
|---|---|---|---|---|---|
| A1 | 38 | 41 | 45 | 48 | 51 |
| A2 | 43 | 46 | 49 | 50 | 53 |
| A3 | 44 | 47 | 50 | 51 | 54 |
| A4 | 48 | 52 | 54 | 57 | 58 |
| A5 | 49 | 53 | 55 | 58 | 59 |
| A6 | 48 | 50 | 52 | 57 | 57 |
| A7 | 39 | 43 | 44 | 53 | 51 |
| A8 | 40 | 43 | 47 | 51 | 55 |
| A9 | 50 | 53 | 55 | 59 | 62 |
| A10 | 51 | 54 | 56 | 60 | 63 |
| A11 | 56 | 58 | 61 | 68 | 72 |
| A12 | 57 | 59 | 62 | 71 | 74 |
| A13 | 56 | 57 | 57 | 68 | 72 |
| A14 | 40 | 45 | 46 | 57 | 52 |
| A15 | 44 | 47 | 51 | 60 | 63 |
| A16 | 52 | 55 | 58 | 66 | 68 |
| A17 | 52 | 55 | 59 | 67 | 69 |
| A18 | 59 | 61 | 66 | 73 | 75 |
| A19 | 59 | 62 | 67 | 74 | 76 |
| A20 | 57 | 59 | 62 | 71 | 72 |
| A21 | 39 | 44 | 46 | 57 | 52 |
| A22 | 46 | 50 | 55 | 66 | 68 |
| A23 | 54 | 57 | 60 | 70 | 72 |
| A24 | 54 | 58 | 62 | 71 | 72 |
| A25 | 61 | 64 | 70 | 76 | 79 |
| A26 | 62 | 65 | 71 | 75 | 78 |
| A27 | 59 | 61 | 65 | 70 | 72 |
| A28 | 38 | 45 | 45 | 56 | 50 |
| A29 | 50 | 53 | 58 | 65 | 66 |
| A30 | 55 | 58 | 62 | 69 | 70 |
| A31 | 56 | 68 | 63 | 70 | 71 |
| A32 | 63 | 65 | 72 | 74 | 77 |
| A33 | 62 | 65 | 72 | 74 | 76 |
| A34 | 58 | 60 | 66 | 71 | 71 |
| A35 | 37 | 44 | 47 | 46 | 50 |
| A36 | 51 | 54 | 59 | 62 | 64 |
| A37 | 55 | 57 | 62 | 67 | 69 |
| A38 | 55 | 57 | 62 | 68 | 69 |
| A39 | 61 | 63 | 69 | 74 | 74 |
| A40 | 60 | 63 | 69 | 73 | 73 |
| A41 | 58 | 59 | 63 | 69 | 70 |
| A42 | 38 | 43 | 46 | 55 | 51 |
| A43 | 53 | 56 | 60 | 61 | 63 |
| A44 | 54 | 57 | 61 | 62 | 64 |
| A45 | 54 | 57 | 61 | 62 | 64 |
| A46 | 58 | 61 | 65 | 65 | 67 |
| A47 | 57 | 61 | 64 | 64 | 66 |
| A48 | 56 | 57 | 62 | 61 | 64 |
| A49 | 39 | 48 | 45 | 55 | 54 |
| A50 | 49 | 53 | 54 | 58 | 60 |
| A51 | 49 | 53 | 54 | 58 | 61 |
| A52 | 49 | 53 | 54 | 58 | 61 |
| A53 | 48 | 52 | 53 | 59 | 63 |
| A54 | 46 | 50 | 51 | 58 | 62 |
| A55 | 44 | 48 | 49 | 56 | 59 |
| A56 | 37 | 42 | 48 | 51 | 52 |

TABLE 7

| ALLOY NO. | ALUMINA-SILICA FIBER VOLUME PROPORTION 30% | 10% |
|---|---|---|
| A1 | 39 | 45 |
| A2 | 43 | 47 |
| A3 | 44 | 48 |
| A4 | 48 | 52 |
| A5 | 49 | 53 |
| A6 | 48 | 51 |
| A7 | 40 | 44 |
| A8 | 41 | 48 |
| A9 | 51 | 57 |
| A10 | 52 | 58 |
| A11 | 57 | 64 |
| A12 | 58 | 65 |
| A13 | 55 | 63 |
| A14 | 39 | 45 |
| A15 | 45 | 56 |

TABLE 7-continued

| ALLOY NO. | ALUMINA-SILICA FIBER VOLUME PROPORTION 30% | 10% |
|---|---|---|
| A16 | 53 | 62 |
| A17 | 53 | 62 |
| A18 | 59 | 68 |
| A19 | 59 | 68 |
| A20 | 56 | 64 |
| A21 | 38 | 47 |
| A22 | 47 | 61 |
| A23 | 55 | 65 |
| A24 | 55 | 66 |
| A25 | 62 | 71 |
| A26 | 61 | 71 |
| A27 | 57 | 65 |
| A28 | 39 | 50 |
| A29 | 51 | 60 |
| A30 | 56 | 63 |
| A31 | 57 | 63 |
| A32 | 63 | 70 |
| A33 | 61 | 69 |
| A34 | 56 | 64 |
| A35 | 38 | 46 |
| A36 | 52 | 57 |
| A37 | 56 | 62 |
| A38 | 56 | 63 |
| A39 | 62 | 68 |
| A40 | 60 | 67 |
| A41 | 55 | 63 |
| A42 | 38 | 48 |
| A43 | 52 | 56 |
| A44 | 55 | 58 |
| A45 | 55 | 58 |
| A46 | 58 | 62 |
| A47 | 57 | 60 |
| A48 | 54 | 56 |
| A49 | 38 | 45 |
| A50 | 51 | 55 |
| A51 | 51 | 55 |
| A52 | 51 | 55 |
| A53 | 50 | 57 |
| A54 | 48 | 54 |
| A55 | 46 | 51 |
| A56 | 39 | 44 |

TABLE 8

| ALLOY NO. | ALUMINA-SILICA FIBER VOLUME PROPORTION I 5% | II 10% | III 20% | IV 30% |
|---|---|---|---|---|
| A1 | 42 | 46 | 47 | 38 |
| A2 | 46 | 48 | 49 | 42 |
| A3 | 47 | 48 | 50 | 43 |
| A4 | 52 | 52 | 56 | 47 |
| A5 | 53 | 53 | 57 | 47 |
| A6 | 50 | 52 | 56 | 46 |
| A7 | 43 | 45 | 50 | 39 |
| A8 | 42 | 49 | 51 | 40 |
| A9 | 52 | 58 | 59 | 51 |
| A10 | 55 | 59 | 60 | 52 |
| A11 | 59 | 65 | 58 | 57 |
| A12 | 60 | 65 | 69 | 57 |
| A13 | 59 | 63 | 68 | 56 |
| A14 | 47 | 47 | 51 | 38 |
| A15 | 47 | 56 | 59 | 44 |
| A16 | 55 | 62 | 65 | 52 |
| A17 | 55 | 63 | 66 | 53 |
| A18 | 62 | 68 | 72 | 58 |
| A19 | 62 | 68 | 72 | 58 |
| A20 | 60 | 64 | 69 | 56 |
| A21 | 46 | 46 | 51 | 37 |
| A22 | 51 | 61 | 65 | 46 |
| A23 | 57 | 65 | 68 | 54 |
| A24 | 58 | 65 | 68 | 54 |
| A25 | 64 | 71 | 73 | 62 |
| A26 | 65 | 70 | 72 | 59 |
| A27 | 61 | 64 | 68 | 55 |
| A28 | 46 | 45 | 49 | 47 |
| A29 | 53 | 60 | 64 | 50 |
| A30 | 58 | 63 | 67 | 55 |

TABLE 8-continued

| ALLOY NO. | ALUMINA-SILICA FIBER VOLUME PROPORTION I 5% | II 10% | III 20% | IV 30% |
|---|---|---|---|---|
| A31 | 59 | 63 | 68 | 55 |
| A32 | 66 | 69 | 71 | 61 |
| A33 | 65 | 68 | 71 | 58 |
| A34 | 60 | 63 | 67 | 54 |
| A35 | 45 | 44 | 49 | 36 |
| A36 | 54 | 57 | 61 | 51 |
| A37 | 57 | 62 | 65 | 54 |
| A38 | 57 | 63 | 65 | 54 |
| A39 | 63 | 67 | 70 | 59 |
| A40 | 62 | 66 | 59 | 57 |
| A41 | 59 | 62 | 56 | 64 |
| A42 | 44 | 43 | 48 | 37 |
| A43 | 56 | 56 | 59 | 63 |
| A44 | 58 | 58 | 61 | 54 |
| A45 | 58 | 58 | 61 | 54 |
| A46 | 62 | 62 | 63 | 58 |
| A47 | 61 | 61 | 63 | 57 |
| A48 | 58 | 59 | 62 | 54 |
| A49 | 44 | 46 | 50 | 36 |
| A50 | 53 | 55 | 57 | 50 |
| A51 | 53 | 56 | 58 | 51 |
| A52 | 53 | 56 | 58 | 51 |
| A53 | 54 | 57 | 58 | 50 |
| A54 | 51 | 55 | 57 | 47 |
| A55 | 48 | 51 | 54 | 43 |
| A56 | 43 | 42 | 47 | 35 |

What is claimed is:

1. A composite material comprising a mass of alumina-silica short fibers embedded in a matrix of metal, said alumina-silica short fibers having a composition of from about 35% to about 80% of $Al_2O_3$ and from about 65% to about 20% of $SiO_2$ with less than about 10% of other included constituents; said matrix metal being an alloy consisting essentially of from more than 45% to 6% of copper, from more than 2% to approximately 3.5% of magnesium, and remainder substantially aluminum; and the volume proportion of said alumina-silica short fibers being from about 5% to about 50%.

2. A composite material according to claim 1, wherein said alumina-silica short fibers have a composition of from about 35% to about 65% of $Al_2O_3$ and from about 65% to about 35% of $SiO_2$ with less than about 10% of other included constituents.

3. A composite material according to claim 1, wherein said alumina-silica short fibers have a composition of from about 65% to about 80% of $Al_2O_3$ and from about 35% to about 20% of $SiO_2$ with less than about 10% of other included constituents.

4. A composite material according to claim 1, wherein the volume proportion of said alumina-silica short fibers being from about 5% to about 40%.

5. A composite material according to claim 2, wherein the volume proportion of said alumina-silica short fibers being from about 5% to about 40%.

6. A composite material according to claim 3, wherein the volume proportion of said alumina-silica short fibers being from about 5% to about 40%.

7. A composite material comprising a mass of alumina-silica short fibers embedded in a matrix of metal, said alumina-silica short fibers having a composition of from about 35% to about 80% of $Al_2O_3$ and from about 65% to about 20% of $SiO_2$ with less than about 10% of other included constituents; said matrix metal being an alloy consisting essentially of from approximately 5% to approximately 6% of copper, from approximately 2.0% to approximately 3.5% of magnesium, and remainder substantially aluminum and the volume proportion of said alumina-silica short fibers being from about 5% to about 50%.

8. The composite material of claim 7, wherein said alumina-silica short fibers have a composition of from about 35% to about 65% of $Al_2O_3$ and from about 65% to about 35% of $SiO_2$ with less than about 10% of other included constituents.

9. The composite material of claim 7, wherein said alumina-silica short fibers have a composition of from about 65% to about 80% of $Al_2O_3$ and from about 35% to about 20% of $SiO_2$ with less than about 10% of other included constituents.

10. The composite material according to claim 7, wherein the volume proportion of said alumina-silica short fibers is from about 5% to about 40%.

11. The composite material of claim 8, wherein the volume proportion of said alumina-silica short fibers is from about 5% to about 40%.

12. The composite material of claim 9, wherein the volume proportion of said alumina-silica short fibers is from about 5% to about 40%.

13. A composite material comprising a mass of alumina-silica short fibers embedded in a matrix of metal, said alumina-silica short fibers having a composition of from 35% to about 80% of $Al_2O_3$ and from about 65% to about 20% of $SiO_2$ with less than about 10% of other included constituents; said matrix metal being an alloy consisting of from approximately 2% to approximately 6% of copper, from approximately 0.5% to approximately 3.5% of magnesium, and the remainder substantially aluminum; and the volume proportion of said alumina-silica short fibers being from about 5% to about 50%.

14. The composite material of claim 13, wherein said alumina-silica short fibers have a composition of from about 35% to about 60% of $Al_2O_3$ and from about 65% to about 35% of $SiO_2$ with less than about 10% of other included constituents.

15. The composite material of claim 13, wherein said alumina-silica short fibers have a composition of from about 65% to about 80% of $Al_2O_3$ and from about 35% to about 20% of $SiO_2$ with less than about 10% of other included constituents.

16. The composite material of claim 13, wherein the volume proportion of said alumina-silica short fibers is from about 5% to about 40%.

17. The composite material of claim 14, wherein the volume proportion of said alumina-silica fibers is from about 5% to about 40%.

18. The composite material of claim 15, wherein the volume proportion of said alumina-silica short fibers is from about 5% to about 40%.

* * * * *